US007791631B2

(12) United States Patent
Inoue et al.

(10) Patent No.: US 7,791,631 B2
(45) Date of Patent: Sep. 7, 2010

(54) LINE HEAD, AN EXPOSURE METHOD USING THE LINE HEAD, AN IMAGE FORMING APPARATUS, AN IMAGE FORMING METHOD AND A LINE HEAD ADJUSTMENT METHOD

(75) Inventors: Nozomu Inoue, Matsumoto (JP); Kiyoshi Tsujino, Matsumoto (JP); Ken Ikuma, Suwa (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/024,910

(22) Filed: Feb. 1, 2008

(65) Prior Publication Data

US 2008/0187362 A1 Aug. 7, 2008

(30) Foreign Application Priority Data

Feb. 2, 2007 (JP) ..... 2007-024707
Dec. 14, 2007 (JP) ..... 2007-323666

(51) Int. Cl.
*B41J 2/45* (2006.01)

(52) U.S. Cl. ..... 347/238

(58) Field of Classification Search ..... 347/238, 347/241, 244, 256, 258
See application file for complete search history.

(56) References Cited

U.S. PATENT DOCUMENTS 4,435,064 A * 3/1984 Tsukada et al. ..... 355/1
7,186,004 B2 * 3/2007 Powell et al. ..... 362/244
7,417,659 B2 8/2008 Yamamura
2006/0001733 A1 1/2006 Yamamura

FOREIGN PATENT DOCUMENTS

JP 09-052385 2/1997
JP 10-016295 1/1998
JP 11048526 A * 2/1999
JP 2000218856 A * 8/2000
JP 2002361923 A 12/2002
JP 2004082361 A 3/2004

OTHER PUBLICATIONS

European search report for corresponding European application 08001903.7 lists the references above.

* cited by examiner

*Primary Examiner*—Hai C Pham
(74) *Attorney, Agent, or Firm*—Hogan & Hartson LLP

(57) ABSTRACT

A line head, includes: an element substrate that includes luminous element groups as groups of a plurality of luminous elements; and a lens array that includes lenses which have an optical property of inverting or non-unity-magnification, focus light from the luminous element groups to form spot groups on an image plane, and are provided corresponding to the respective luminous element groups, wherein the plurality of luminous elements are two-dimensionally arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the image plane and a center of gravity position of the spot group is shorter than a specified distance.

18 Claims, 39 Drawing Sheets

FIG. 27
<CROSSHAIR CURSOR>
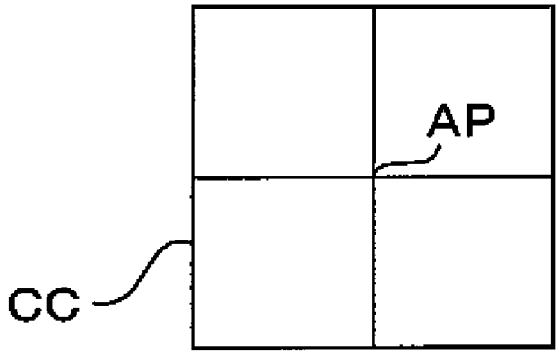
<CIRCLED CROSSHAIR CURSOR>
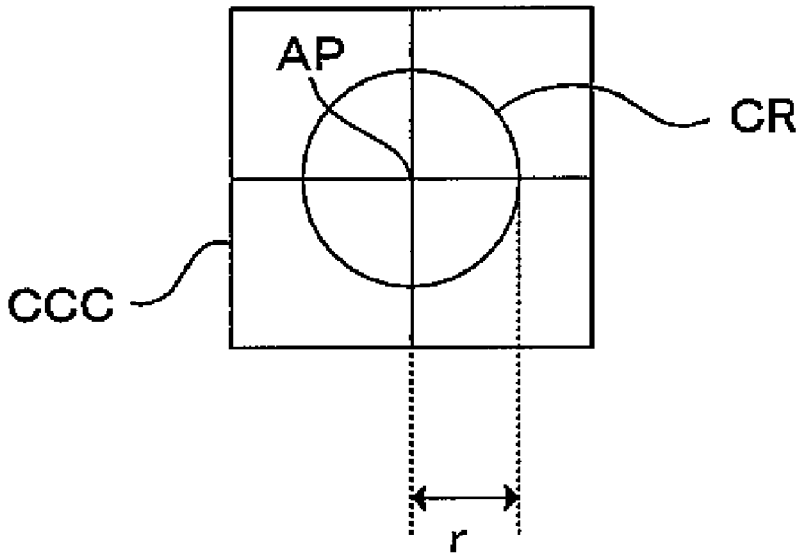

FIG. 36

| SURFACE NUMBER | R (CURVATURE RADIUS) | d | nd | νd | K, A (ASPHERIC DATA) |
|---|---|---|---|---|---|
| S1 (OBJECT SURFACE) | R1=∞ | d1=0.5000 | nd1=1.5168 | νd1=64.2 | |
| S2 | R2=∞ | d2= 2.3394 | | | |
| S3 (APERTURE) | R3=∞ | d3= 0.6535 | | | |
| S4 (ASPHERIC) | R4=1.15827 | d4=1.6000 | nd4=1.5311 | νd4=56.0 | K4 =−2.81586<br>A4 =7.757025e3 |
| S5 (ASPHERIC) | R5=−0.99295 | d5=1.3945 | | | K5 =−2.32468<br>A5 =−8.77875e3 |
| S6 (IMAGING SURFACE) | R6=∞ | | | | |

DEFINITIONAL EQUATION OF ASPHERIC…

$$\frac{cr^2}{1+\sqrt{1-(1+K)c^2r^2}}+Ar^4$$

r: DISTANCE FROM OPTICAL AXIS,
c: CURVATURE ON OPTICAL AXIS,
K: CONIC CONSTANT,
A: ASPHERIC CONSTANT
WAVELENGTH 632.5nm
LENS FOCAL LENGTH 1.3605mm

SECTION OF OPTICAL SYSTEM ALONG MAIN SCANNING DIRECTION

SECTION OF OPTICAL SYSTEM ALONG SUB SCANNING DIRECTION

LINE HEAD, AN EXPOSURE METHOD USING THE LINE HEAD, AN IMAGE FORMING APPARATUS, AN IMAGE FORMING METHOD AND A LINE HEAD ADJUSTMENT METHOD

CROSS REFERENCE TO RELATED APPLICATION

The disclosure of Japanese Patent Applications No. 2007-024707 filed on Feb. 2, 2007 and No. 2007-323666 filed on Dec. 14, 2007 including specification, drawings and claims is incorporated herein by reference in its entirety.

BACKGROUND

1. Technical Field

The invention relates to a line head for focusing lights emitted from luminous elements on an imaging surface by microlenses.

2. Related Art

The following technology for the purpose of aligning the positions of microlenses and luminous elements is disclosed in JP-A-9-52385 and JP-A-10-16295. In the related art disclosed in these patent literatures, light quantities of light beams emitted from the luminous elements are measured via the microlenses. The positional relationship of the microlenses and the luminous elements is determined such that a measurement result exhibits a specified light quantity distribution. The microlenses disclosed in JP-A-9-52385 and JP-A-10-16295 are a rod lens array in which rod lenses with a refractive index distribution are arranged in an offset manner and have an optical property of erecting and unity-magnification.

SUMMARY

In a line head using microlenses exhibiting an optical property of erecting and unity-magnification, image positions of light beams emitted from luminous elements do not vary in principle due to the optical characteristic of the lenses even if the positional relationship of the luminous elements and the microlenses varies. In other words, the image positions are independent of the positional relationship of the luminous elements and the microlenses. On the other hand, in a line head using microlenses exhibiting an optical property of inverting or non-unity-magnification, image positions of light beams emitted from luminous elements vary if the positional relationship of the luminous elements and the microlenses varies. In this specification, the optical property of inverting or non-unity-magnification means any optical property other than that of erecting and unity-magnification (i.e. inverting, or erecting and non-unity-magnification).

In short, in an optical system with an inverting or non-unity-magnification, the image positions are dependent on the positional relationship of the luminous elements and the microlenses. If the positions of the luminous elements and the microlenses deviate, not only a problem of varying the image positions, but also a problem of being unable to obtain an original imaging performance due to the deterioration of aberrations and the like occur in some cases.

An advantage of some aspects of the invention is to provide a technology for suppressing deviations of image positions and the deterioration of aberrations resulting from the positional relationship of luminous elements and microlenses.

According to a first aspect of the invention, there is provided a line head, comprising: an element substrate that includes luminous element groups as groups of a plurality of luminous elements; and a lens array that includes lenses which have an optical property of inverting or non-unity-magnification, focus light from the luminous element groups to form spot groups on an image plane, and are provided corresponding to the respective luminous element groups, wherein the plurality of luminous elements are two-dimensionally arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the image plane and a center of gravity position of the spot group is shorter than a specified distance.

According to a second aspect of the invention, there is provided a line head adjustment method, comprising: arranging an element substrate that includes a plurality of luminous elements grouped into luminous element groups, in each of which group two or more luminous elements are arranged in point symmetry, obtaining a position of a symmetry center of each luminous element group of the element substrate, arranging a lens array, which includes lenses which have an optical property of inverting or non-unity-magnification, focus light from the luminous element groups, and are provided corresponding to the respective luminous element groups, to face the element substrate, performing an optical axis adjustment process to the luminous element group to adjust the positional relationship of the element substrate and the lens array arranged to face the element substrate, wherein a virtual plane perpendicular to the optical axes of the lenses is a virtual perpendicular plane, and the optical axis adjustment process is a process for adjusting the positional relationship of the element substrate and the lens array such that an in-plane distance between a projected position of the obtained symmetry center on the virtual perpendicular plane and a projected position of a midpoint of two images on the virtual perpendicular plane satisfies a specified condition, the two images being formed by focusing lights emitted from two luminous elements point-symmetric with respect to the symmetry center by means of the lens.

According to a third aspect of the invention, there is provided an exposure method using a line head, comprising: exposing an image plane using a line head that includes an element substrate having luminous element groups as groups of a plurality of luminous elements, and a lens array having lenses which have an optical property of inverting or non-unity-magnification, focus light from the luminous element groups to form spot groups on the image plane, and are provided corresponding to the respective luminous element groups, wherein the plurality of luminous elements are two-dimensionally arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the image plane and a center of gravity position of the spot group is shorter than a specified distance.

According to a fourth aspect of the invention, there is provided an image forming apparatus, comprising: a latent image carrier; and a line head including an element substrate that has luminous element groups as groups of a plurality of luminous elements, and a lens array that has lenses which have an optical property of inverting or non-unity-magnification, focus light from the luminous element groups to form spot groups on a surface of the latent image carrier, and are provided corresponding to the respective luminous element groups, wherein the plurality of luminous elements are arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the surface of the latent image carrier and a center of gravity position of the spot group is shorter than a specified distance.

According to a fifth aspect of the invention, there is provided an image forming method, comprising: forming a latent image on a surface of a latent image carrier using a line head that includes an element substrate having luminous element groups as groups of a plurality of luminous elements, and a lens array having lenses which have an optical property of inverting or non-unity-magnification, focus light from the luminous element groups to form spot groups on the surface of the latent image carrier, and are provided corresponding to the respective luminous element groups, wherein the plurality of luminous elements are arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the surface of the latent image carrier and a center of gravity position of the spot group is shorter than a specified distance.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 27 is a group of diagrams showing a crosshair cursor used in the fifth adjustment example.

FIG. 36 is a table showing optical factors in this example.

DESCRIPTION OF EXEMPLARY EMBODIMENTS

Hereinafter, embodiments of the invention are described. First, the constructions of an image forming apparatus using a line head as an application subject of the invention and the line head, and a latent image forming operation are described. After the description of these, specific adjustment examples of the relative positional relationship of a microlens array and an element substrate are described.

A. Construction of an Image Forming Apparatus

Figure 1:
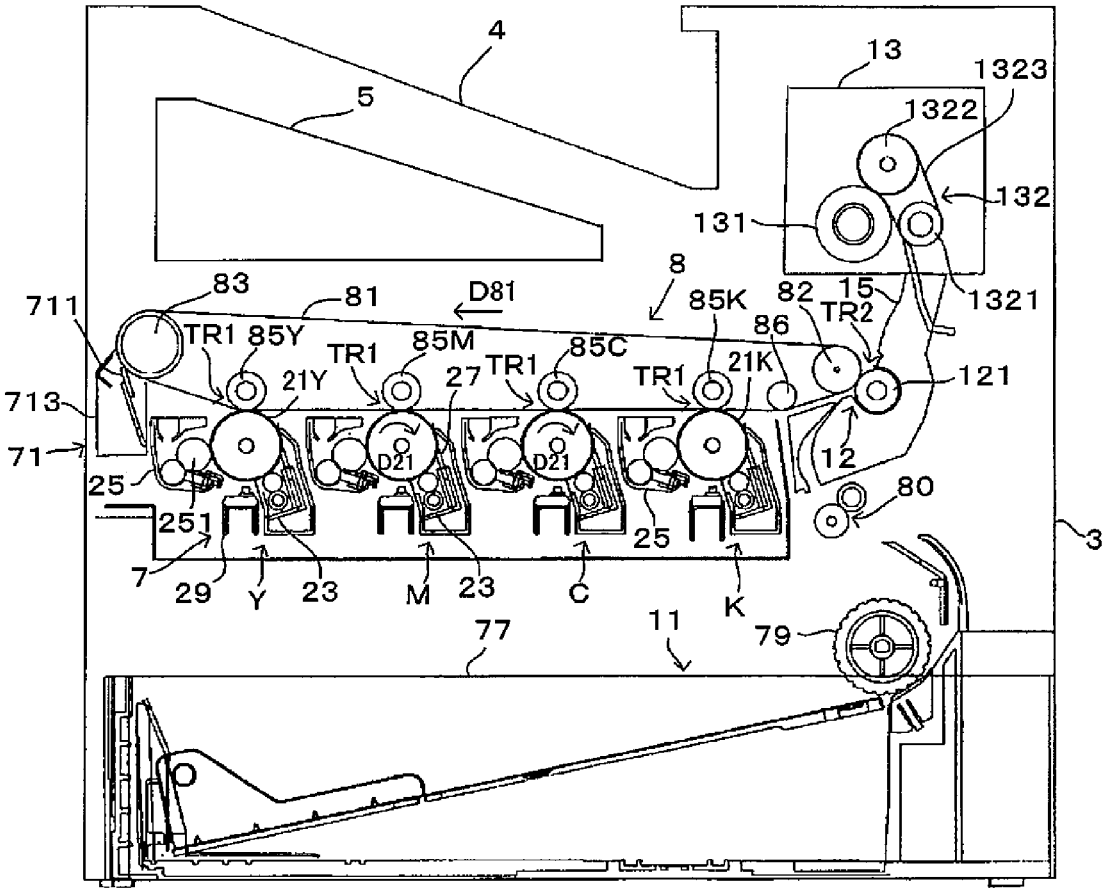
FIG. 1 is a diagram showing an image forming apparatus using a line head as an application subject of the invention.
Figure 2:
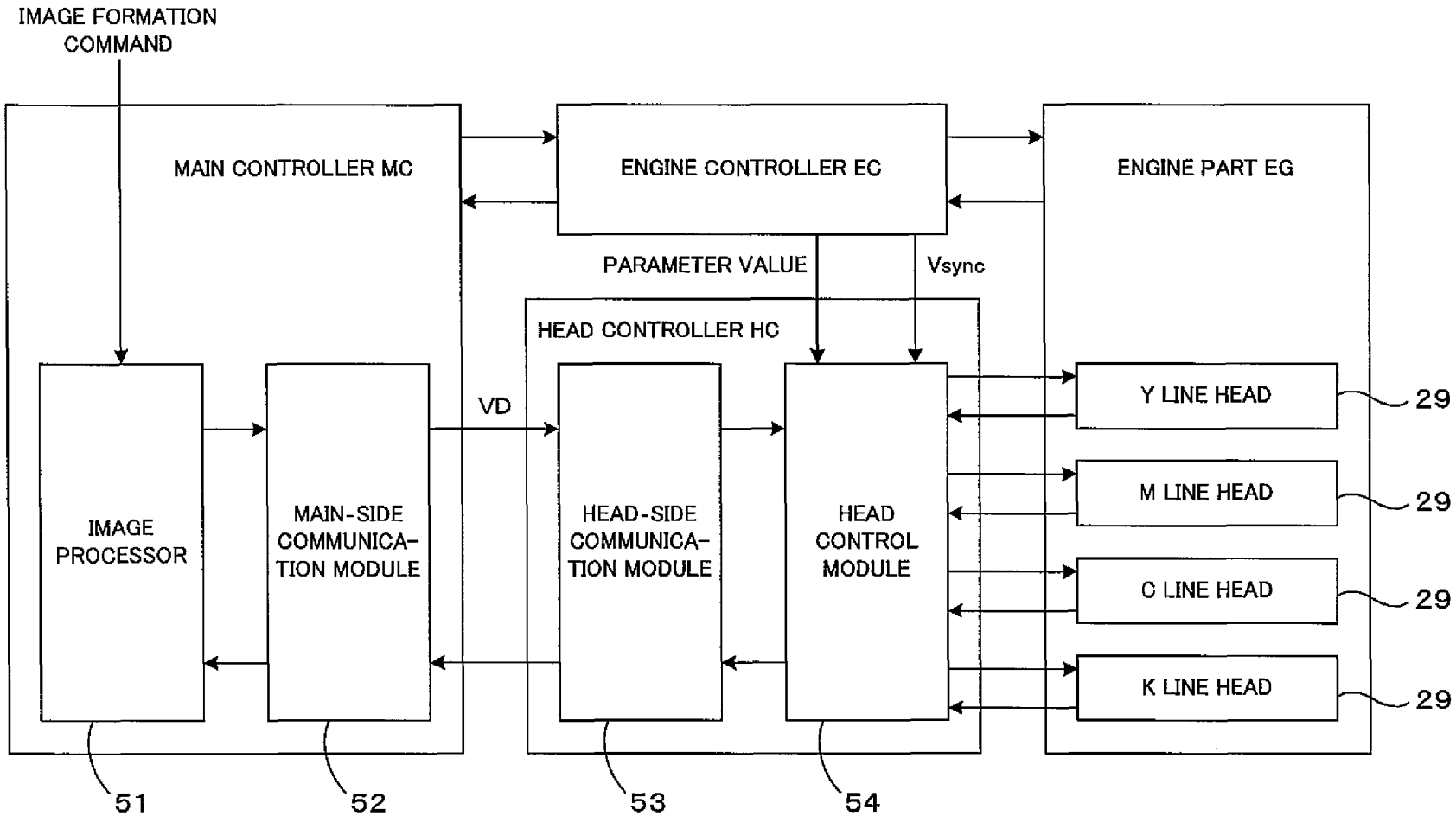
FIG. 2 is a diagram showing the electrical construction of the image forming apparatus of FIG. 1.

FIG. 1 is a diagram showing an image forming apparatus using a line head as an application subject of the invention, and FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively. Meanwhile, since the respective image forming stations of the image forming unit 7 are identically constructed, reference characters are given to only some of the image forming stations while being not given to the other image forming stations in order to facilitate the diagrammatic representation in FIG. 1.

The image forming unit 7 includes four image forming stations Y (for yellow), M (for magenta), C (for cyan) and K (for black) which form a plurality of images having different colors. Each of the image forming stations Y, M, C and K includes a photosensitive drum 21 on the surface of which a toner image of the corresponding color is to be formed. Each photosensitive drum 21 is connected to its own driving motor and is driven to rotate at a specified speed in a direction of arrow D21 in FIG. 1, whereby the surface of the photosensitive drum 21 is transported in a sub scanning direction. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

Each line head 29 includes a plurality of luminous elements arrayed in the axial direction of the photosensitive drum 21 (direction normal to the plane of FIG. 1) and is positioned separated from the photosensitive drum 21. Light beams are emitted from these luminous elements to the surface of the photosensitive drum 21 charged by the charger 23 (to expose the surface), thereby forming a latent image on this surface. In this image forming apparatus, the head controller HC is provided to control the line heads 29 of the respective colors, and controls the respective line heads 29 based on the video data VD from the main controller MC and a signal from the engine controller EC. Specifically, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the luminous elements in the respective line heads 29 are suitably controlled to form latent images corresponding to the image formation command.

In this image forming apparatus, the photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this image forming apparatus, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers and driven to turn in a direction of arrow D81 in FIG. 1 (conveying direction). The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

B. First Construction of Line Head

Figure 3:
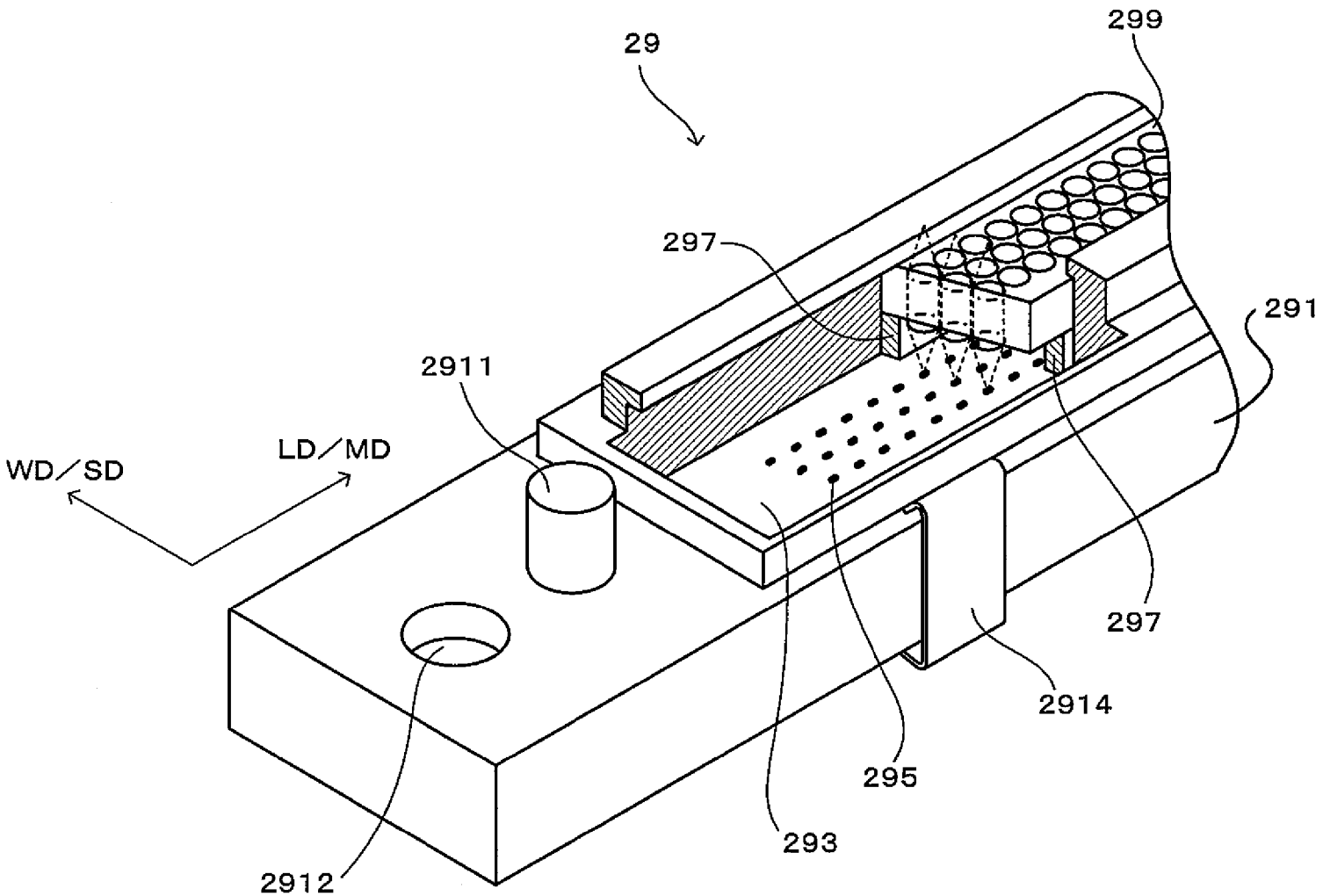
FIG. 3 is a perspective view schematically showing a first construction of the line head as the application subject of the invention.
Figure 4:
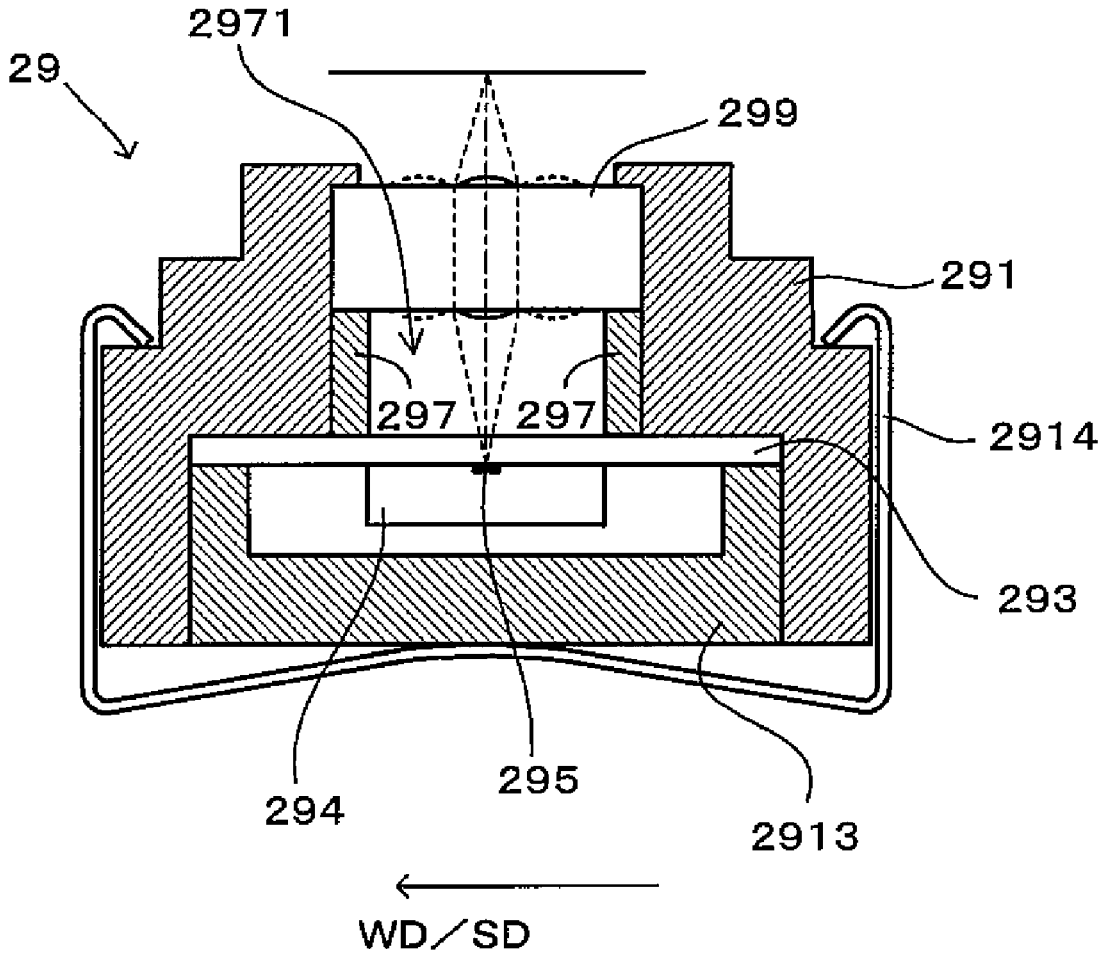
FIG. 4 is a section along width direction showing the first construction of the line head.
Figure 5:
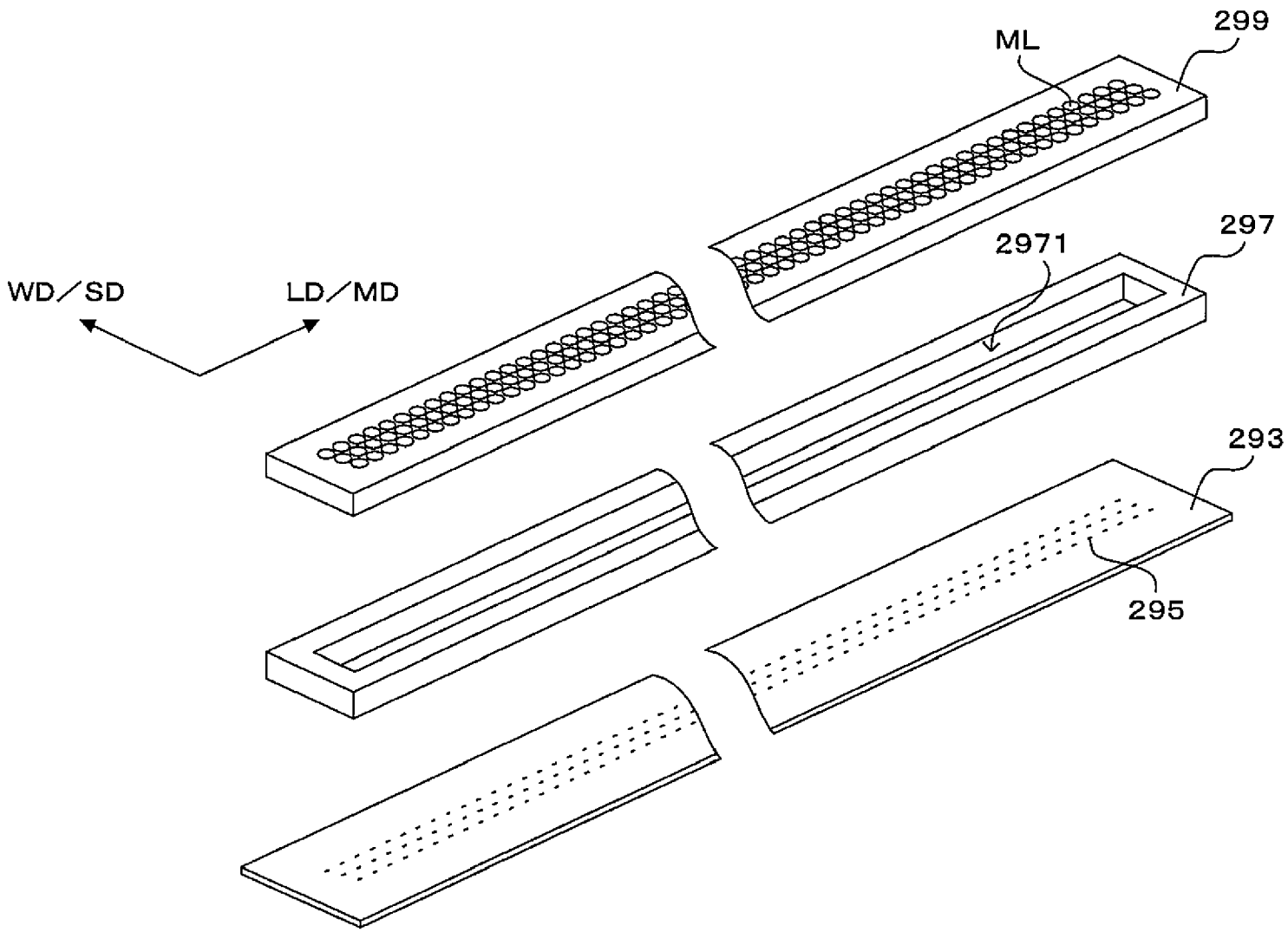
FIG. 5 is an exploded perspective view of the line head.

FIG. 3 is a perspective view schematically showing a first construction of the line head as the application subject of the invention. FIG. 4 is a section along width direction showing the first construction of the line head. FIG. 5 is an exploded perspective view of the line head. In FIG. 5, some members such as a case are not shown. In the line head 29, a main scanning direction MD is set to a longitudinal direction LD and a sub scanning direction SD is set to a width direction WD. The line head 29 includes a case 291, and a position pin 2911 and a screw insertion hole 2912 are provided at each of the opposite ends of the case 291. The line head 29 is positioned with respect to the photosensitive drum 21 by fitting the positioning pins 2911 into positioning holes (not shown) formed in a photosensitive drum cover (not shown), which covers the photosensitive drum 21 and is positioned with respect to the photosensitive drum 21. Further, the line head 29 is fixed with respect to the photosensitive drum 21 by screwing fixing screws into screw holes (not shown) of the photosensitive drum cover through the screw insertion holes 2912 to fix.

The case 291 carries a microlens array 299 at a position facing the surface of the photosensitive drum 21, and internally includes a spacer 297 and an element substrate 293 in this order from the microlens array 299. The spacer 297 functions to define the spacing between the microlens array 299 and the element substrate 293 and has a hollow part 2971 formed inside. The element substrate 293 is a transparent glass substrate and has a plurality of luminous element groups 295 arranged on the underside surface thereof (surface opposite to the one where the microlens array 299 is disposed out of two surfaces of the element substrate 293). Specifically, the plurality of luminous element groups 295 are two-dimensionally arranged on the underside of the element substrate 293 while being spaced apart at specified pitches from each other in the longitudinal direction LD and the width direction WD. Here, each of the plurality of luminous element groups 295 is formed by arraying a plurality of luminous elements. This is described later. In this line head 29, an organic EL (electroluminescence) device is used as the luminous element. In other words, the organic EL devices are arranged on the underside surface of the element substrate 293 as the luminous elements. Light beams emitted from the plurality of respective luminous elements in a direction toward the photosensitive drum 21 are headed for the microlens array 299 via the hollow part 2971 of the spacer 297.

As shown in FIG. 4, an underside lid 2913 is pressed to the case 291 via the element substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and light does not intrude into the case 291 from the outside) by pressing the underside lid 2913 by means of the elastic force. It should be noted that a plurality of the retainers 2914 are provided at a plurality of positions in the longitudinal direction LD of the case 291. The luminous element groups 295 are covered with a sealing member 294.

Figure 6:
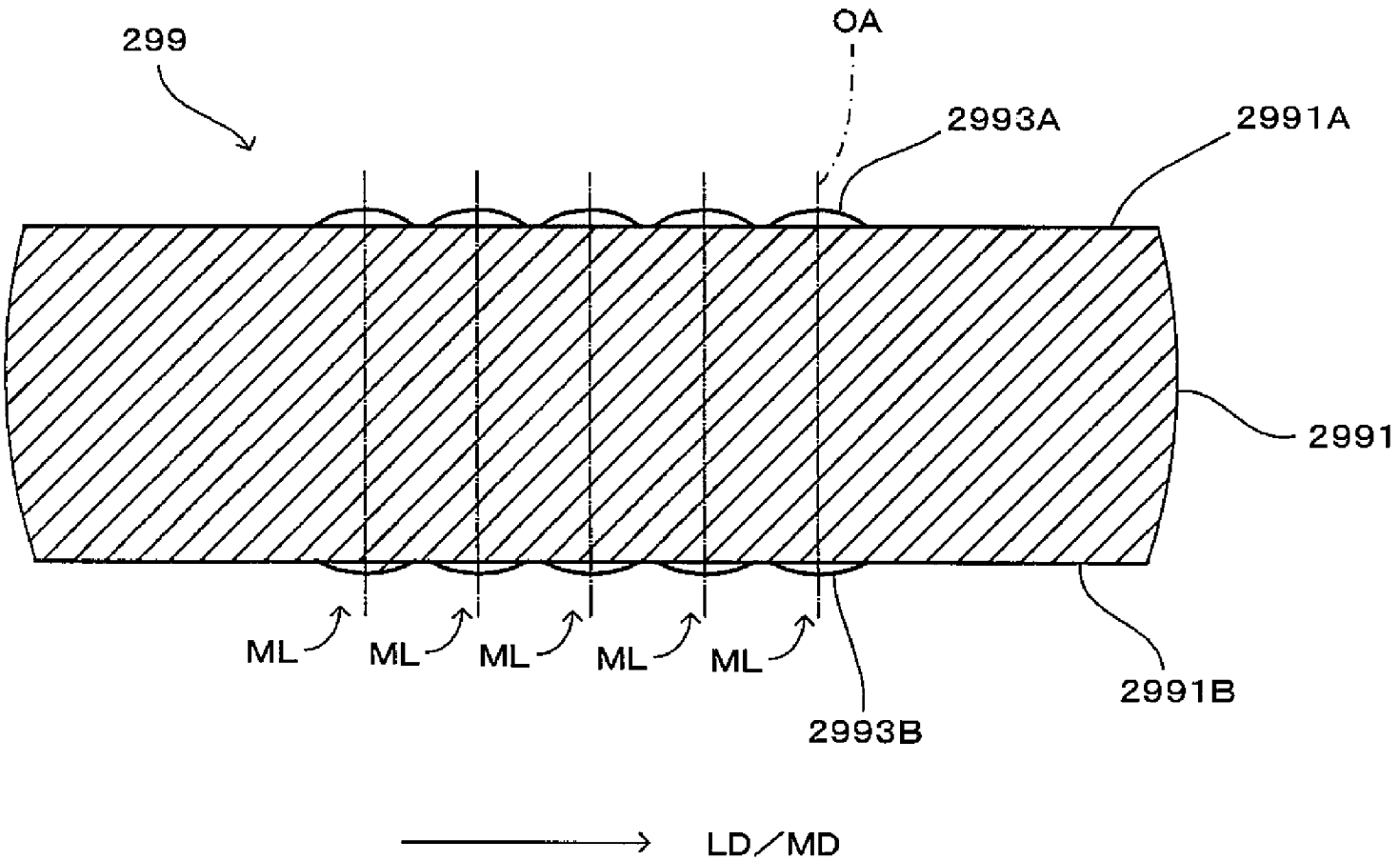
FIG. 6 is a longitudinal sectional view of the microlens array.

FIG. 6 is a longitudinal sectional view of the microlens array. The microlens array 299 includes a glass substrate 2991 and a plurality of lens pairs each comprised of two lenses 2993A and 2993B arranged in a one-to-one correspondence at the opposite sides of the glass substrate 2991. These lenses 2993A and 2993B can be formed of resin.

Specifically, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA. These plurality of lens pairs are arranged in a one-to-one correspondence with the plurality of luminous element groups 295. In this specification, an optical system which includes one-to-one pairs of lenses 2993A and 2993B and the glass substrate 2991 located between such lens pairs is called "microlens ML". These plurality of lens pairs (microlenses ML) are two-dimensionally arranged and spaced apart from each other at specified pitches in the longitudinal direction LD and in the width direction WD in accordance with the arrangement of the luminous element groups 295. The optical axes OA of the respective plurality of microlenses ML are substantially parallel to each other.

Figure 7:
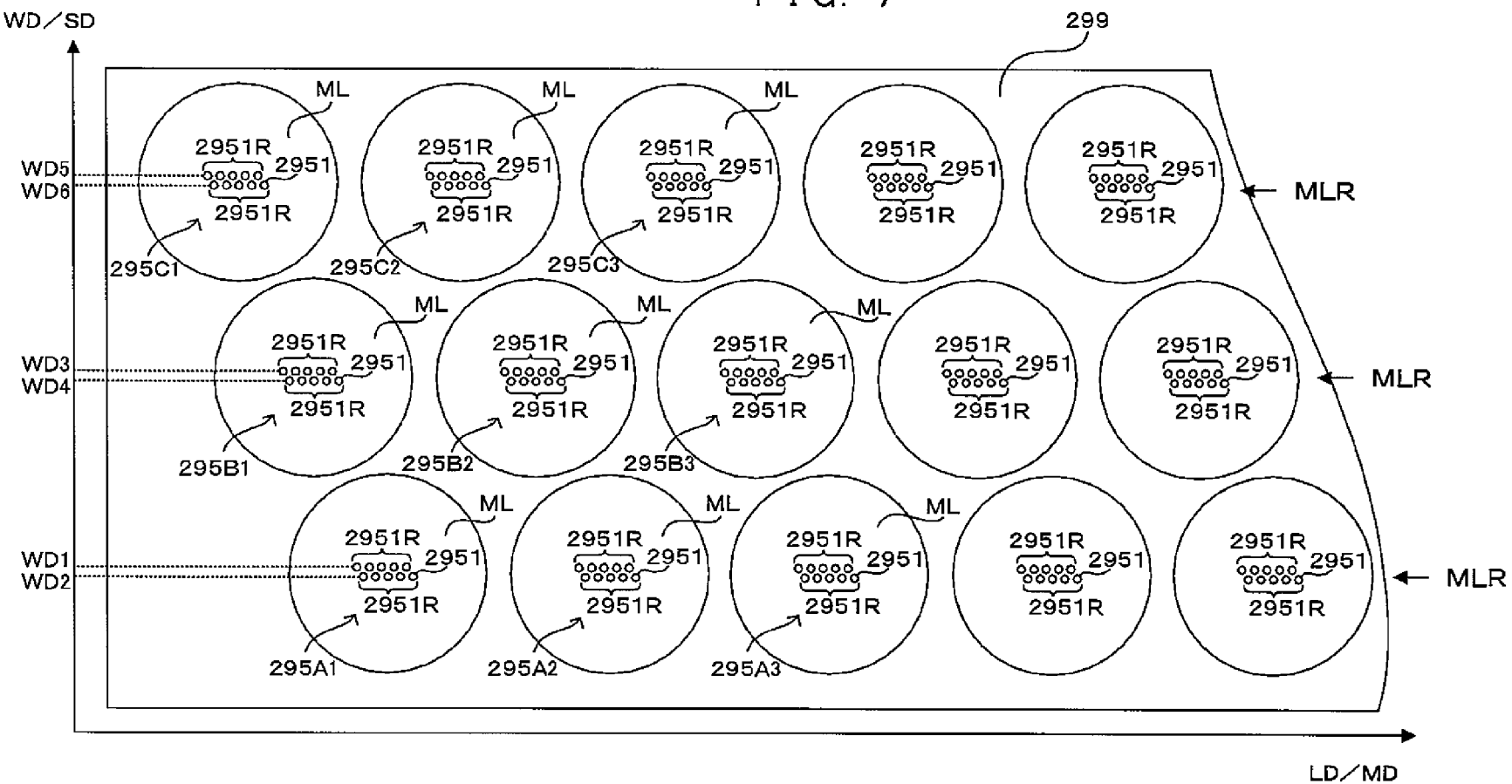
FIG. 7 is a diagram showing the configurations of the microlens array and the luminous element groups.

FIG. 7 is a diagram showing the configurations of the microlens array and the luminous element groups. The microlens array 299 has such a structure that three lens rows MLR, in which a plurality of microlenses ML are aligned in the longitudinal direction LD, are arranged in the width direction WD. These lens rows MLR are arranged at equal pitches in the width direction WD. The positions of the plurality of microlenses ML respectively differ in the longitudinal direction LD, and the plurality of microlenses ML are arranged at equal pitches in the longitudinal direction LD. The plurality of luminous element groups 295 are arranged in a one-to-one correspondence with the plurality of microlenses ML.

Figure 8:
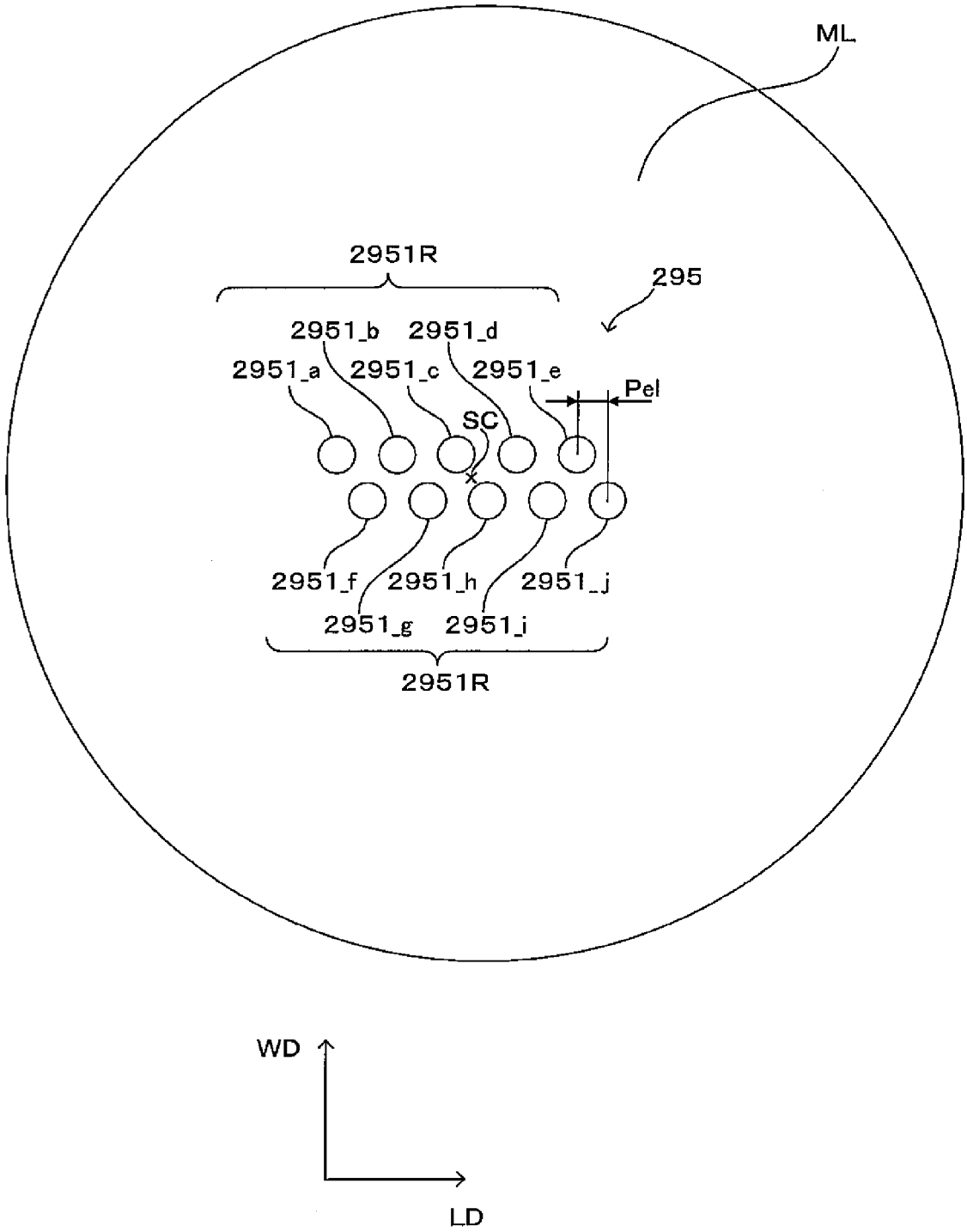
FIG. 8 is a diagram showing the configuration of the luminous element group.

FIG. 8 is a diagram showing the configuration of the luminous element group. In this embodiment, ten luminous elements 2951_*a* to 2951_*j* are arranged in point symmetry with respect to a symmetry center SC to form one luminous element group 295. At this time, two luminous elements 2951 of each of the five pairs listed below are point-symmetric with respect to the symmetry center SC. Here, the five pairs are the one comprised of luminous elements 2951_*a* and 2951_*j*, the one comprised of luminous elements 2951_*b* and 2951_*i*, the one comprised of luminous elements 2951_*c* and 2951_*h*, the one comprised of luminous elements 2951_*d* and 2951_*g*, and the one comprised of luminous elements 2951_*e* and 2951_*f*. Of course, a middle point between the two point-symmetric luminous elements 2951 constituting one pair coincides with the symmetry center SC. The symmetry center SC is shown by a mark x in FIG. 8, but such a mark x is not physically present and is imaginarily drawn in FIG. 8 to indicate the position of symmetry center SC. In some of the drawings attached to this specification, marks x are used to indicate points, but in any one of these cases, such marks x are not physically present and are drawn to indicate imaginary points.

As shown in FIG. 8, five luminous elements 2951_*a* to 2951_*e* are aligned in the longitudinal direction LD to form one luminous element row 2951R, and five luminous elements 2951_*f* to 2951_*j* are aligned in the longitudinal direction LD to form one luminous element row 2951R. These two luminous element rows 2951R are arranged in the width direction WD to form one luminous element group 295. Further the positions of the ten luminous elements 2951_*a* to 2951_*j* belonging to one luminous element group in the longitudinal direction LD differ from each other. Light beams emitted from the luminous elements 2951 are focused on the surface of the photosensitive drum 21 by the microlenses ML facing these luminous elements 2951. At this time, the microlenses ML focus the light beams at an inverting unity magnification.

Figure 9:
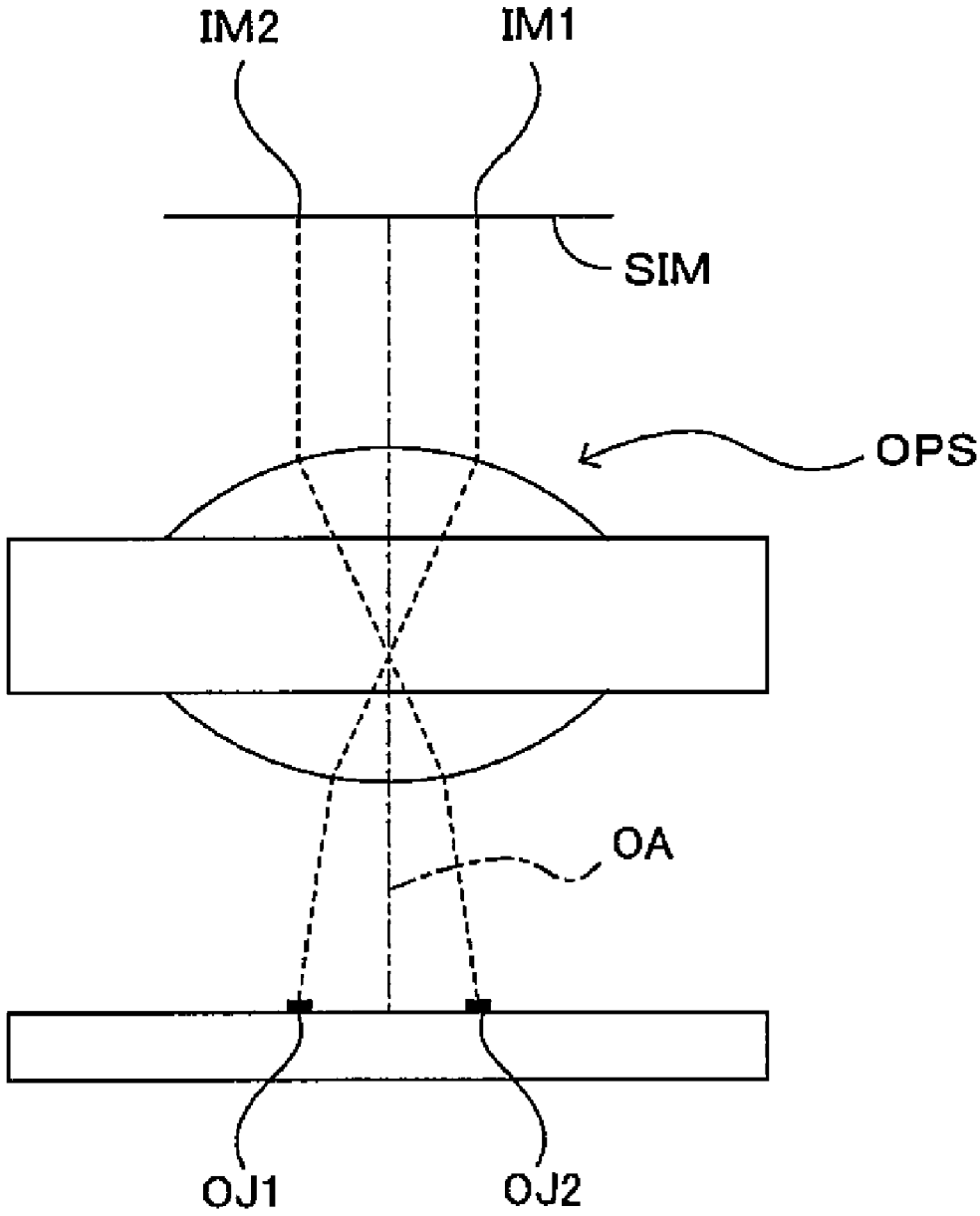
FIG. 9 is a diagram showing an optical property of inverting unity-magnification.

FIG. 9 is a diagram showing an optical property of inverting unity-magnification. In this diagram, an imaging optical system OPS having an optical property of inverting unity-magnification is opposed to two luminous elements OJ1, OJ2. Light beams emitted from the respective luminous elements OJ1, OJ2 are focused on an image plane SIM by the imaging optical system OPS. At this time, the light beam emitted from the luminous element OJ1 is focused at an image position IM1 at a side of an optical axis OA opposite to the luminous element OJ1. A distance from the luminous element OJ1 to the optical axis OA and the one from the image position IM1 to the optical axis OA are equal. Further, the light beam emitted from the luminous element OJ2 is focused at an image position IM2 at a side of the optical axis OA opposite to the luminous element OJ2. A distance from the luminous element OJ2 to the optical axis OA and the one from the image position IM2 to the optical axis OA are equal. In other words, the imaging optical system having the optical property of inverting unity-magnification forms an inverted image and the imaging magnification thereof is one.

As described above, in the line head 29 of this embodiment, ten luminous elements are two-dimensionally arrayed to form the luminous element group 295. Further, in the luminous element group 295, the respective luminous elements 2951 are arranged in point symmetry with respect to the symmetry center SC. The microlens ML is arranged to face the luminous element group 295 and, when the respective luminous elements 2951 of the luminous element group 295 emit light beams, a plurality of spots SP are formed on the photosensitive drum surface as a spot group SG. In this embodiment, the line head 29 is constructed such that the luminous element group 295 and the spot group SG satisfy the following relationship.

Figure 10:
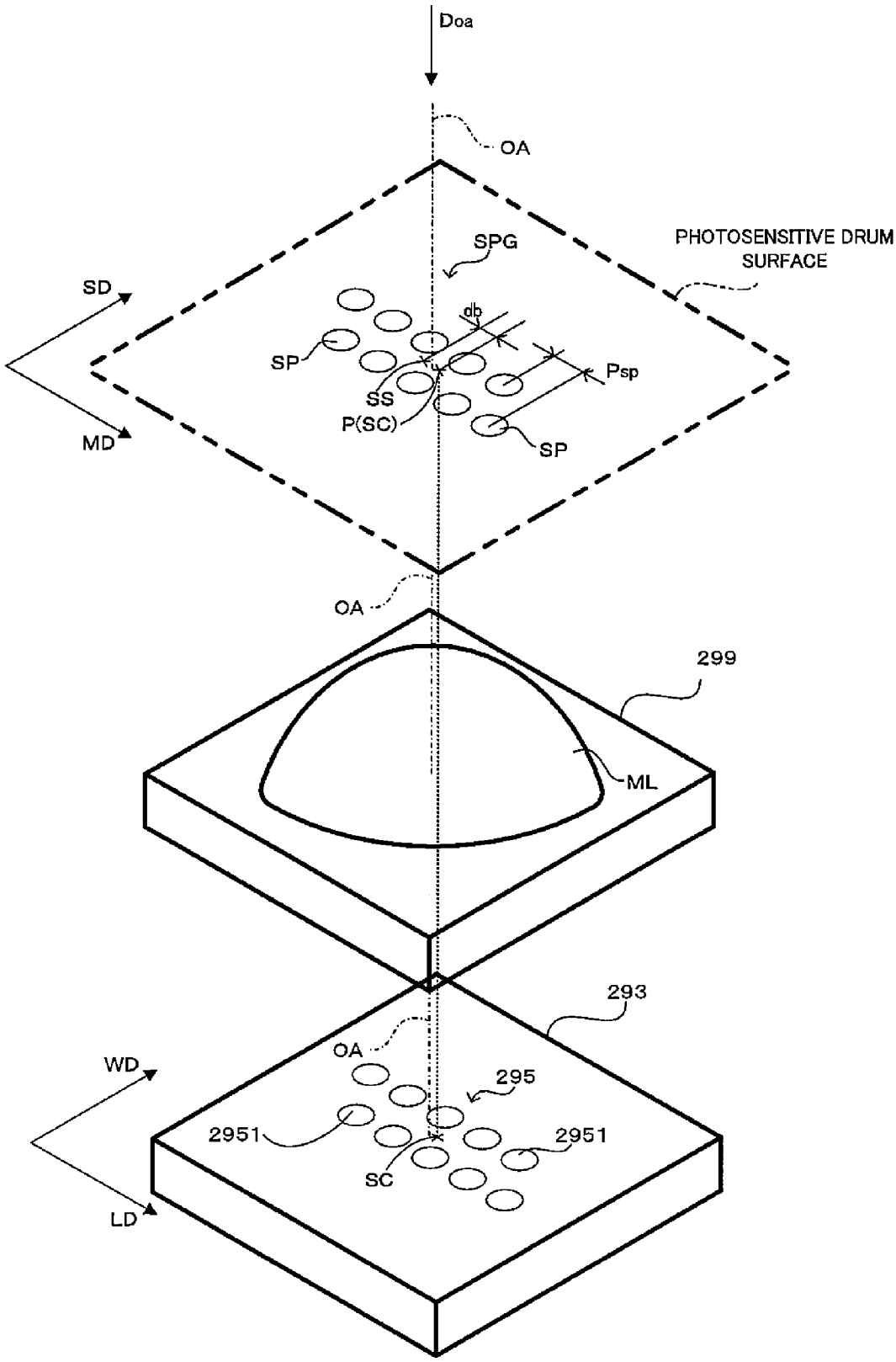
FIG. 10 is a perspective view showing the relationship of the luminous element group and the spot group in the first construction of the line head.
Figure 11:
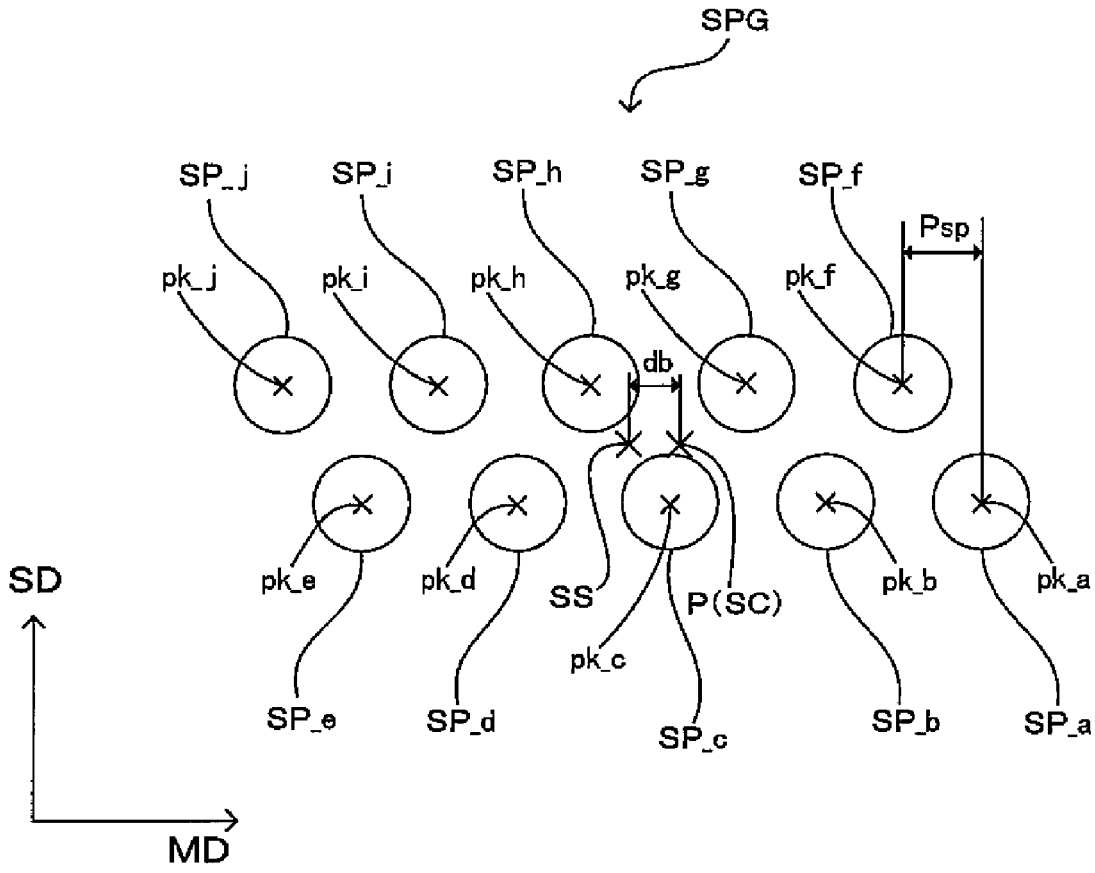
FIG. 11 is a plan view showing the relationship of the luminous element group and the spot group of the first construction of the line head.

FIG. 10 is a perspective view showing the relationship of the luminous element group and the spot group in the first construction of the line head, and FIG. 11 is a plan view showing the relationship of the luminous element group and the spot group of the first construction of the line head. FIG. 11 shows the spot group formed on the photosensitive drum surface. As shown in FIG. 10, the respective luminous elements 2951 of the luminous element group 295 are arranged in point symmetry with respect to the symmetry center SC on the element substrate 293. The microlens ML is arranged to face the luminous element group 295, so that the light beams emitted from the luminous element group 295 are focused by the microlens ML to form the spot group SG on the photosensitive drum surface. This spot group SG is comprised of ten spots SP_a, SP_b, . . . , SP_j formed at mutually different positions in the main scanning direction MD, and are aligned at substantially equal pitches Psp in the main scanning direction MD in the example shown in FIGS. 10 and 11. The spot pitches Psp are the pitches of the respective spots SP forming the spot group SG in the main scanning direction MD.

Here, a point where a line passing the symmetry center SC of the luminous element group 295 and extending in a direction of the optical axis OA intersects with the photosensitive drum surface is defined to be a symmetry center projected point P(SC). At this time, an inter-point distance between the symmetry center projected point P(SC) and a center of gravity point BC of the spot group SG is shorter than the spot pitch (specified distance) Psp in this embodiment. The center of gravity point BC of the spot group SG can be obtained, for example, as follows. Specifically, positions where a light quantity distribution peaks in the respective spots SP_a, SP_b, . . . , SP_j are obtained as peak positions pk_a, pk_b, . . . , pk_j, and the geometric center of gravity of these peak positions pk_a, pk_b, . . . , pk_j can be obtained as the center of gravity point BC of the spot group SG.

As described above, in this embodiment, it is constructed that a distance between the symmetry center projected point P(SC) and a center of gravity point BC of the spot group SG is shorter than a specified distance. Here, the reason that not a distance between the symmetry center projected point P(SC) and a symmetry center of the spot group SG but a distance between the symmetry center projected point P(SC) and a center of gravity point BC of the spot group SG is shorter than a specified distance is as follows. Specifically, there are cases that spots SP formed by the microlens array 299 are not accurately arranged in point symmetry because of the manufacturing error of the microlens array 299 or the aberration of the microlens ML or the like. Consequently, in this embodiment, it is constructed that a distance between the symmetry center projected point P(SC) and a center of gravity point BC of the spot group SG is shorter than a specified distance. Meanwhile, when there is little aberration or manufacturing error mentioned above, spots SP are arranged in point symmetry, and accordingly the symmetry center thereof coincides with the center of gravity point thereof.

As described above, in this embodiment, luminous elements 2951 are arranged in point symmetry and, when the respective luminous elements of the luminous element group 295 emit lights, a plurality of spots SP are formed as the spot group SG. In addition, the inter-point distance between the symmetry center projected point P(SC) and the center of gravity point BC of the spot group SG is shorter than the specified distance. Accordingly, the deviations of the image positions and the deterioration of aberrations resulting from the positional relationship of the luminous elements 2951 and the microlenses ML can be suppressed.

Further, in the luminous element group 295 of this embodiment, a plurality of luminous element rows 2951R, in each of which a plurality of luminous elements are aligned in the longitudinal direction LD, are arranged in the width direction WD. The luminous element group 295 emits lights to form a plurality of spots SP at mutually different positions in the main scanning direction MD. However, in the line head 29 having the above construction, the deterioration of aberrations tends to become pronounced particularly if the positional relationship of the luminous elements 2951 and the microlenses deviates in the longitudinal direction LD (main scanning direction MD). Hence, it is particularly suitable to apply the invention to such a line head 29 as described in the above embodiment.

Further, in the above embodiment, the spacer 297 is provided between the element substrate 293 and the microlens array 299, and one side of the spacer 297 is held in contact with the element substrate 293 and the other side thereof is held in contact with the microlens array 299, thereby defining the spacing between the element substrate 293 and the microlens array 299. Accordingly, the spacing between the element substrate 293 and the microlens array 299 can be defined by the spacer 297, which provides a construction advantageous in suppressing the deviation of the image positions and the deterioration of aberrations resulting from the positional relationship of the luminous elements 2951 and the microlenses ML.

In the above embodiment, the organic EL devices are preferably used as the luminous elements 2951. This is because the organic EL devices are advantageous in suppressing the deviation of the image positions and the deterioration of aberrations resulting from the positional relationship of the luminous elements 2951 and the microlenses ML since being formed with high positional accuracy by a semiconductor process.

In the microlens array 299 of the above embodiment, the microlenses ML are preferably constructed by forming the lenses on the glass substrate 2991. This is because glass is advantageous in suppressing the deviation of the image positions and the deterioration of aberrations resulting from the positional relationship of the luminous elements 2951 and the microlenses ML since it can suppress displacements of the microlenses ML caused by a temperature change by having a smaller thermal expansion coefficient than resin or the like.

C. Second Construction of Line Head

In the first construction example of the line head 29, the inter-point distance db between the symmetry center projected point P(SC) and the center of gravity point BC of the spot group SG is set to the spot pitch Psp. However, there are cases where the spot pitches Psp are not uniform in the spot group SG due to the aberrations of the microlenses ML and the like. In such cases, the line head 29 may be constructed such that the inter-point distance db is shorter than an average value AV(Psp) of the spot pitches. An average value of spot pitches can be obtained, for example, as follows.

Figure 12:
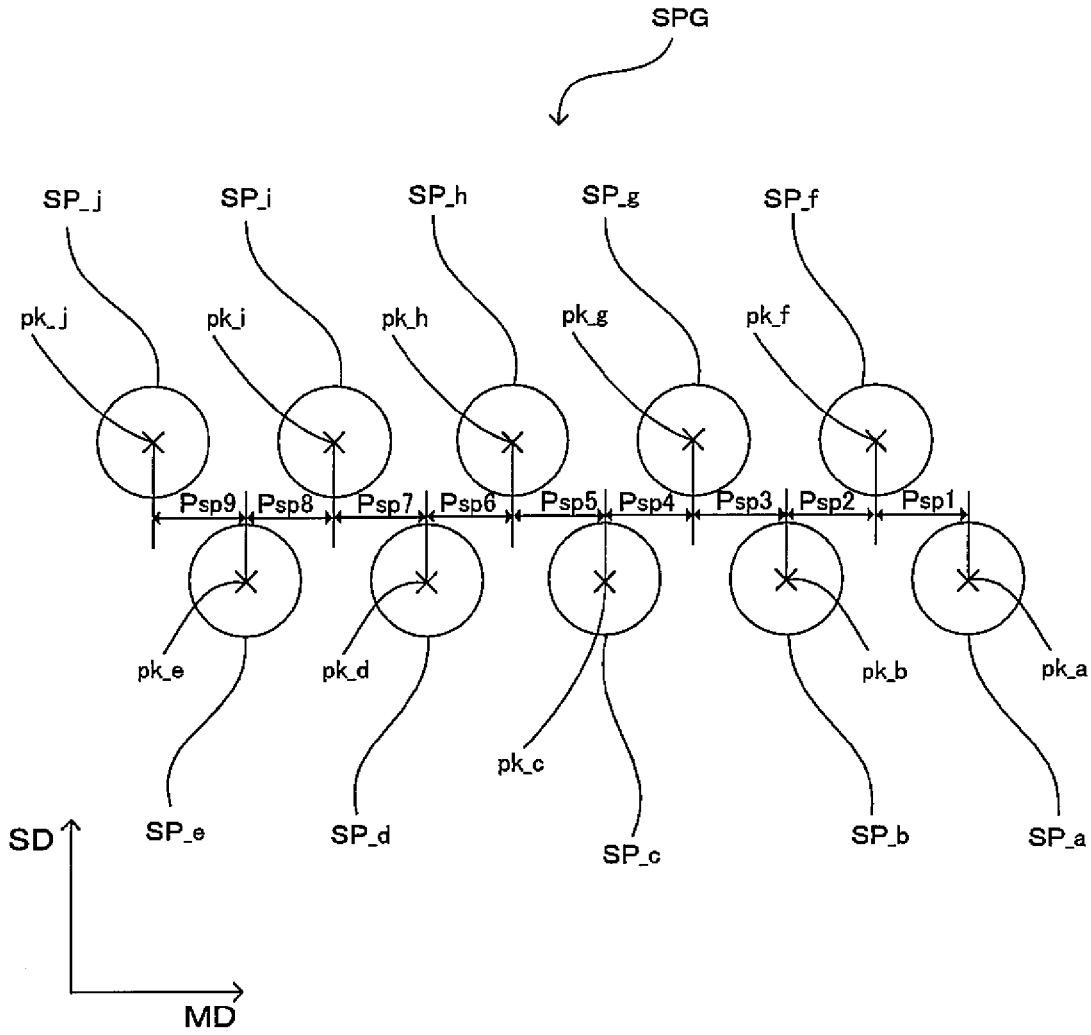
FIG. 12 is a diagram showing a spot group formed on the photosensitive drum surface for describing an average value of spot pitches.

FIG. 12 is a diagram showing a spot group formed on the photosensitive drum surface for describing an average value of spot pitches. In an example of FIG. 12, a spot group SG is formed by ten spots SP_a, SP_b, . . . , SP_j. Spot pitches Psp1 to Psp9 can be respectively calculated as distances between peak positions pk_a, pk_b, . . . , pk_j of the light quantity distributions of the spots SP. Specifically, the spot pitch Psp1 can be calculated as a distance between the peak position pk_a of the spot SP_a and the peak position pk_b of the spot SP_b. An average value of the respective spot pitches Psp1 to Psp9 thus calculated can be calculated as the average value AV(Psp) of the spot pitches.

As described above, in the second construction example of the line head, the inter-point distance db is shorter than the average (specified distance) of the spot pitches Psp in the main scanning direction MD of the plurality of spots SP (spot group SG) formed by the light emission of the luminous element group 295. Accordingly, the deviations of the image positions and the deterioration of aberrations resulting from the positional relationship of the luminous elements 2951 and the microlenses ML can be effectively suppressed.

d. Third Construction of Line Head

Figure 13:
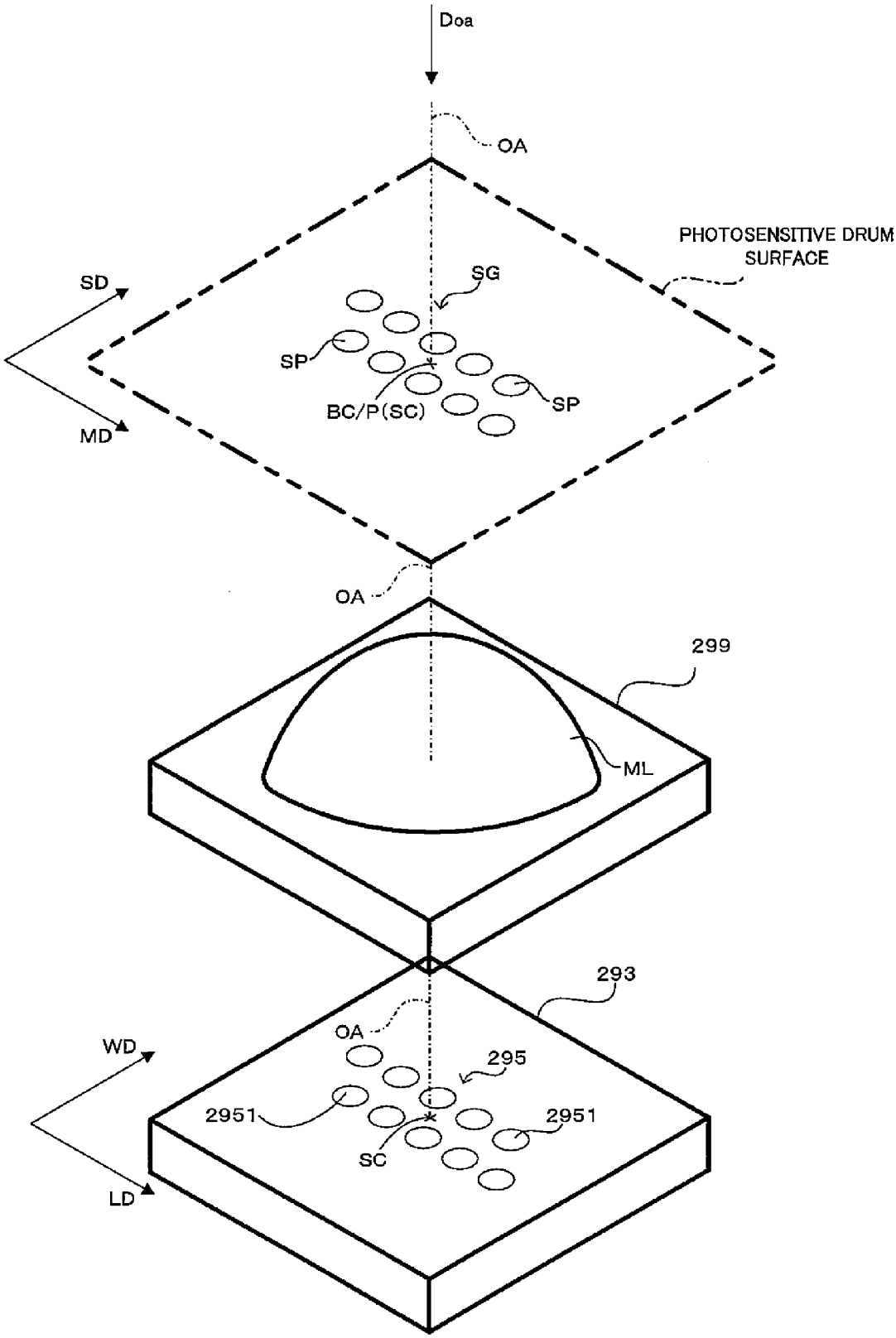
FIG. 13 is a perspective view showing the relationship of the luminous element group and the spot group in the third construction of the line head.
Figure 14:
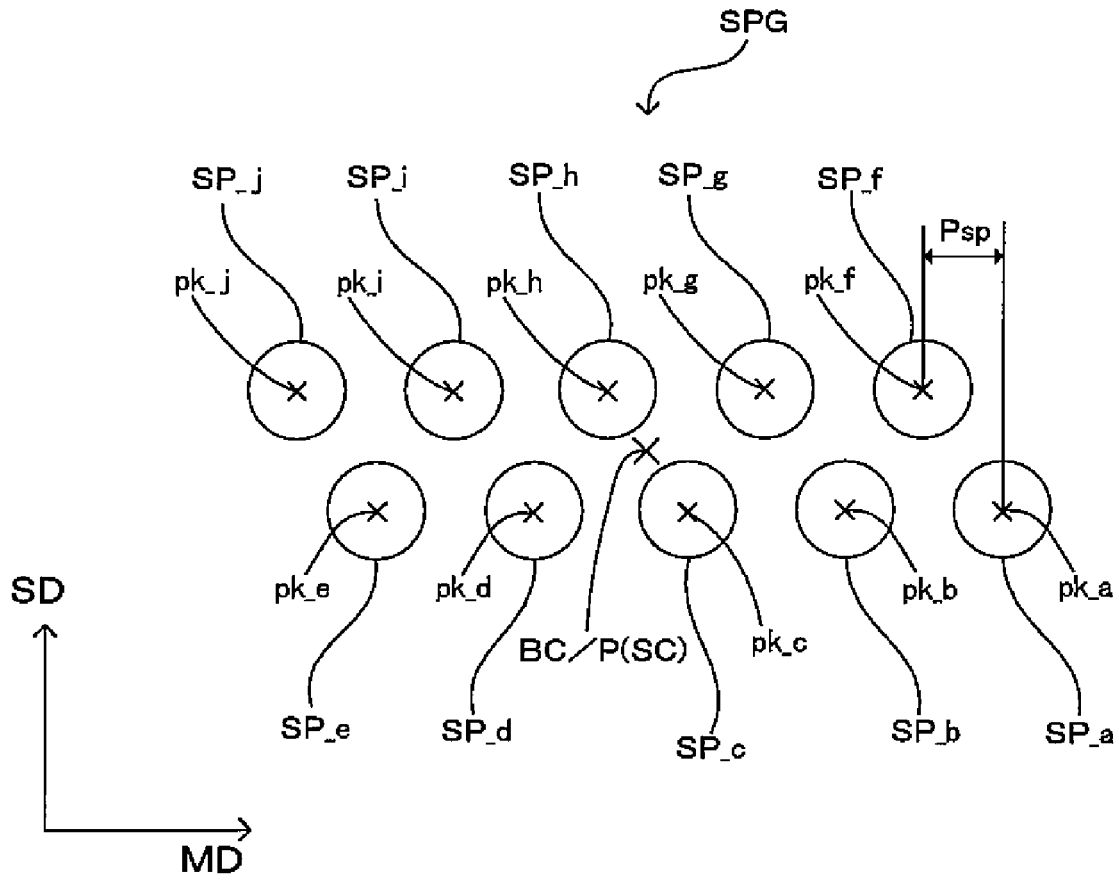
FIG. 14 is a plan view showing the relationship of the luminous element group and the spot group of the third construction of the line head.

FIG. 13 is a perspective view showing the relationship of the luminous element group and the spot group in the third construction of the line head, and FIG. 14 is a plan view showing the relationship of the luminous element group and the spot group of the third construction of the line head. FIG. 14 shows the spot group formed on the photosensitive drum surface. Points of difference between the first and third construction examples are mainly described below, and common parts are not described by being identified by corresponding reference numerals. As shown in FIGS. 13 and 14, the symmetry center projected position P(SC) and the center of gravity point BC of the spot group SG substantially coincide with each other and the inter-point distance db is substantially zero in the third construction example.

As described above, in the third construction example of the line head, the luminous elements 2951 of the luminous element group 295 are arranged in point symmetry and, when the respective luminous elements of the luminous element group 295 emit lights, a plurality of spots SP are formed as the spot group SG. In addition, the symmetry center projected position P(SC) and the center of gravity point BC of the spot group SG substantially coincide with each other. Accordingly, the deviations of the image positions and the deterioration of aberrations resulting from the positional relationship of the luminous elements 2951 and the microlenses ML can be very effectively suppressed.

E. Latent Image Forming Operation of Line Head

By using the above-mentioned line head 29 in this way, it becomes possible to satisfactorily form a latent image by suppressing the deviations of the image positions and the deterioration of aberrations. This line head 29 forms a latent image by forming spots on the moving photosensitive drum as described below.

Figure 15:
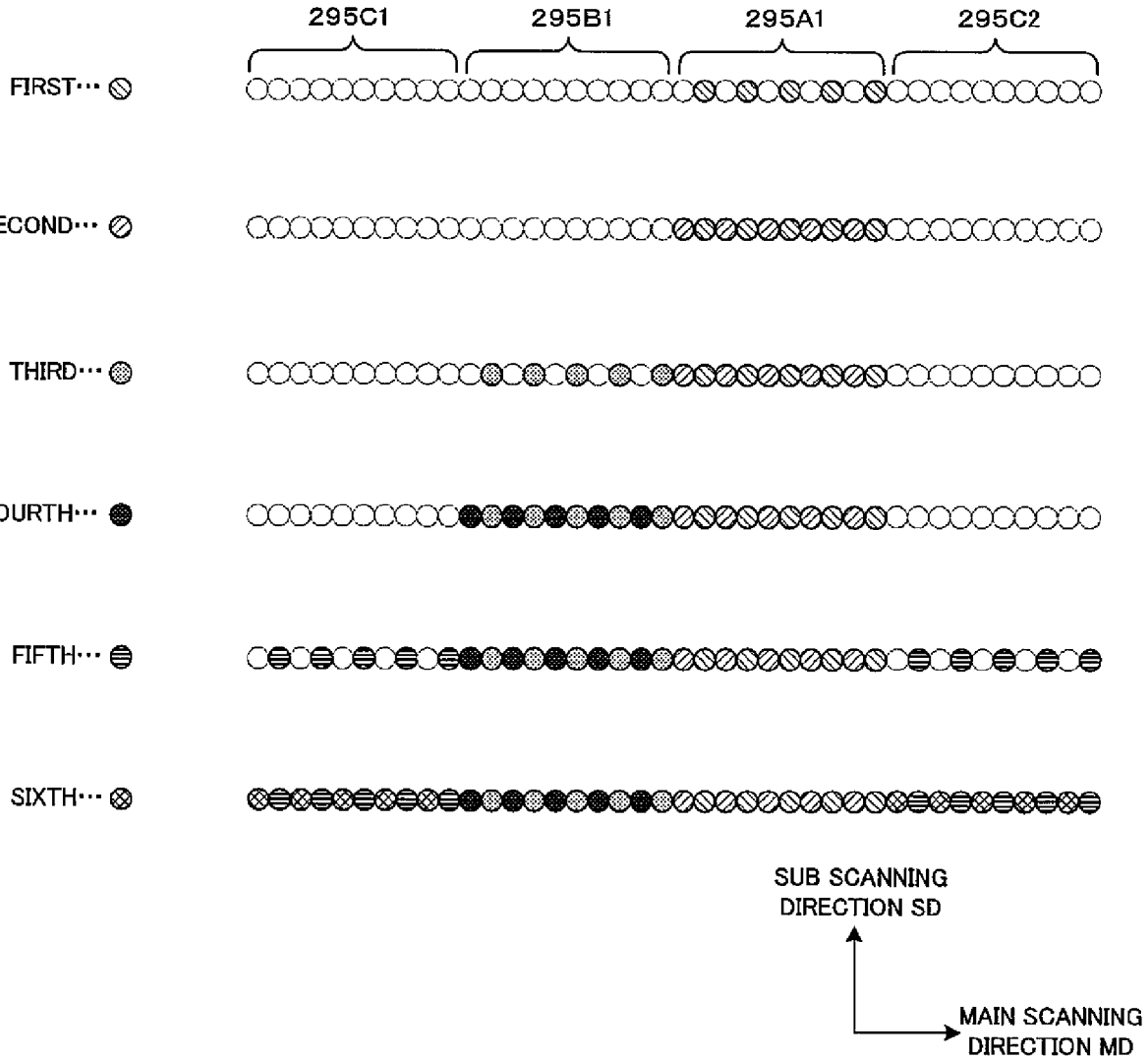
FIG. 15 is a diagram showing a spot forming operation by the above-mentioned line head.

FIG. 15 is a diagram showing a spot forming operation by the above-mentioned line head. The spot forming operation in this embodiment by the line head is described with reference to FIGS. 2, 7 and 15. In order to facilitate the understanding of the invention, there is described a case where a line latent image is formed by aligning a plurality of spots on a straight line extending in the main scanning direction MD. Roughly speaking, in such a latent image forming operation, the plurality of spots are formed while being aligned on the straight line extending in the main scanning direction MD (longitudinal direction LD) by causing the plurality of luminous elements to emit lights at specified timings by means of the head control module 54 while the surface of the photosensitive drum 21 is conveyed in the sub scanning direction SD (width direction WD). This operation is described in detail below.

Specifically, in the line head of this embodiment, six luminous element rows 2951R are arranged in the width direction WD in accordance with width-direction positions WD1 to WD6 (FIG. 7). Thus, in this embodiment, the luminous element rows 2951R located at the same width-direction position are driven to emit lights substantially at the same timing, and those located at different width-direction positions are caused to emit lights at mutually different timings. More specifically, the luminous element rows 2951R are driven to emit lights in an order of the width-direction positions WD1 to WD6. By driving the luminous element rows 2951R to emit lights in the above order while the surface of the photosensitive drum 21 is conveyed in the width direction WD (sub scanning direction SD), the plurality of spots are formed while being aligned on the straight line extending in the longitudinal direction LD (main scanning direction MD) of this surface.

Such an operation is described with reference to FIGS. 7 and 15. First of all, the luminous elements 2951 of the luminous element rows 2951R at the width-direction position WD1 belonging to the most upstream luminous element groups 295A1, 295A2, 295A3, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "first operation" of FIG. 15. In FIG. 15, white circles represent spots that are not formed yet, but planned to be formed later. In FIG. 15, spots labeled by numerals 295C1, 295B1, 295A1 and 295C2 are those to be formed by the luminous element groups 295 corresponding to the respective attached numerals.

Subsequently, the luminous elements 2951 of the luminous element rows 2951R at the width-direction position WD2 belonging to the same luminous element groups 295A1, 295A2, 295A3, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "second operation" of FIG. 15. Here, whereas the surface of the photosensitive drum 21 is conveyed in the width direction WD, the luminous element rows 2951R are successively driven to emit lights from the downstream ones in the width direction WD (that is, in the order of the width-direction positions WD1, WD2). This is to deal with the inverting property of the microlenses ML.

Subsequently, the luminous elements 2951 of the luminous element rows 2951R at the width-direction position WD3 belonging to the second most upstream luminous element groups 295B1, 295B2, 295B3, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "third operation" of FIG. 15.

Subsequently, the luminous elements 2951 of the luminous element rows 2951R at the width-direction position WD4 belonging to the same luminous element groups 295B1, 295B2, 29583, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "fourth operation" of FIG. 15.

Subsequently, the luminous elements 2951 of the luminous element rows 2951R at the width-direction position WD5 belonging to the most downstream luminous element groups 295C1, 295C2, 295C3, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "fifth operation" of FIG. 15.

Finally, the luminous elements 2951 of the luminous element rows 2951R at the width-direction position WD6 belonging to the same luminous element groups 295C1, 295C2, 295C3, . . . in the width direction WD are driven to emit lights. A plurality of light beams emitted by such a light emitting operation are focused on the photosensitive drum surface by the microlenses ML having the above-mentioned inverting unity magnification property. In other words, spots are formed at hatched positions of the "sixth operation" of FIG. 15. By performing the first to sixth light emitting operations in this way, a plurality of spots are formed while being aligned on the straight line extending in the longitudinal direction LD (main scanning direction MD).

F. Line Head Adjustment Method

In the above-mentioned line head 29, the light beams emitted from the luminous elements 2951 are focused by the microlenses ML having the optical property of inverting unity-magnification, that is, the optical property of inverting or non-unity-magnification. Accordingly, the respective symmetry centers SC of all the luminous element groups 295 are ideally present on the optical axes OA of the corresponding microlenses ML. In other words, all the microlenses ML are preferably located at ideal positions. This is because the image positions of the light beams deviate if the microlenses ML deviate from the ideal positions. In this specification, a state where the microlens ML is arranged such that the optical axis OA thereof passes the symmetry center SC of the corresponding luminous element group 295 is expressed as that the microlens ML is located at the ideal position. Thus, upon assembling the line head using the microlenses ML with an inverting or non-unity-magnification as described above, it is essential to adjust the relative positional relationship of the microlens array 299 and the element substrate 293 with high accuracy. In the following point as well, it is essential to adjust the relative positional relationship of the microlens array 299 and the element substrate 293 with high accuracy.

Specifically, in this embodiment, each of the plurality of luminous element groups 295 is comprised of a plurality of luminous elements 2951. Accordingly, the light beams emitted from one luminous element group 295 are focused by one microlens ML. However, in the construction in which each luminous element group 295 is comprised of a plurality of luminous elements 295 as in this embodiment, some luminous elements 2951 are located near the optical axes OA of the microlenses ML and some distant from the optical axes OA. Thus, if the positional relationship of the element substrate 293 and the microlens array 299 is not proper, distances between the luminous elements 2951 distant from the optical axes OA and the optical axes OA increase, resulting in a possibility of an occurrence of a problem that imaging characteristics (distortions, coma aberrations, etc.) of the images of the light beams emitted from the luminous elements 2951 distant from the optical axes OA reach impermissible levels. In the case of performing an image formation using the line head 29 having such a problem, density non-uniformity appears in the arrangement cycle of the microlenses ML. Therefore, in the above-mentioned line head 29 in which one luminous element group 295 is comprised of a plurality of luminous elements 2951, it is particularly necessary to adjust the above positional relationship with high accuracy.

However, for the line head 29 using the microlenses ML having the optical property of inverting or non-unity-magnification as in the above embodiment, there have been cases where the positional relationship cannot be adjusted with sufficient accuracy by a method for adjusting the positional relationship of the lenses and the luminous elements based on light quantity distributions in a state where the lens array is mounted as in the related art. A highly accurate position adjustment can be realized by adjusting the positional relationship as shown in the following adjustment examples.

FIRST ADJUSTMENT EXAMPLE

Figure 16:
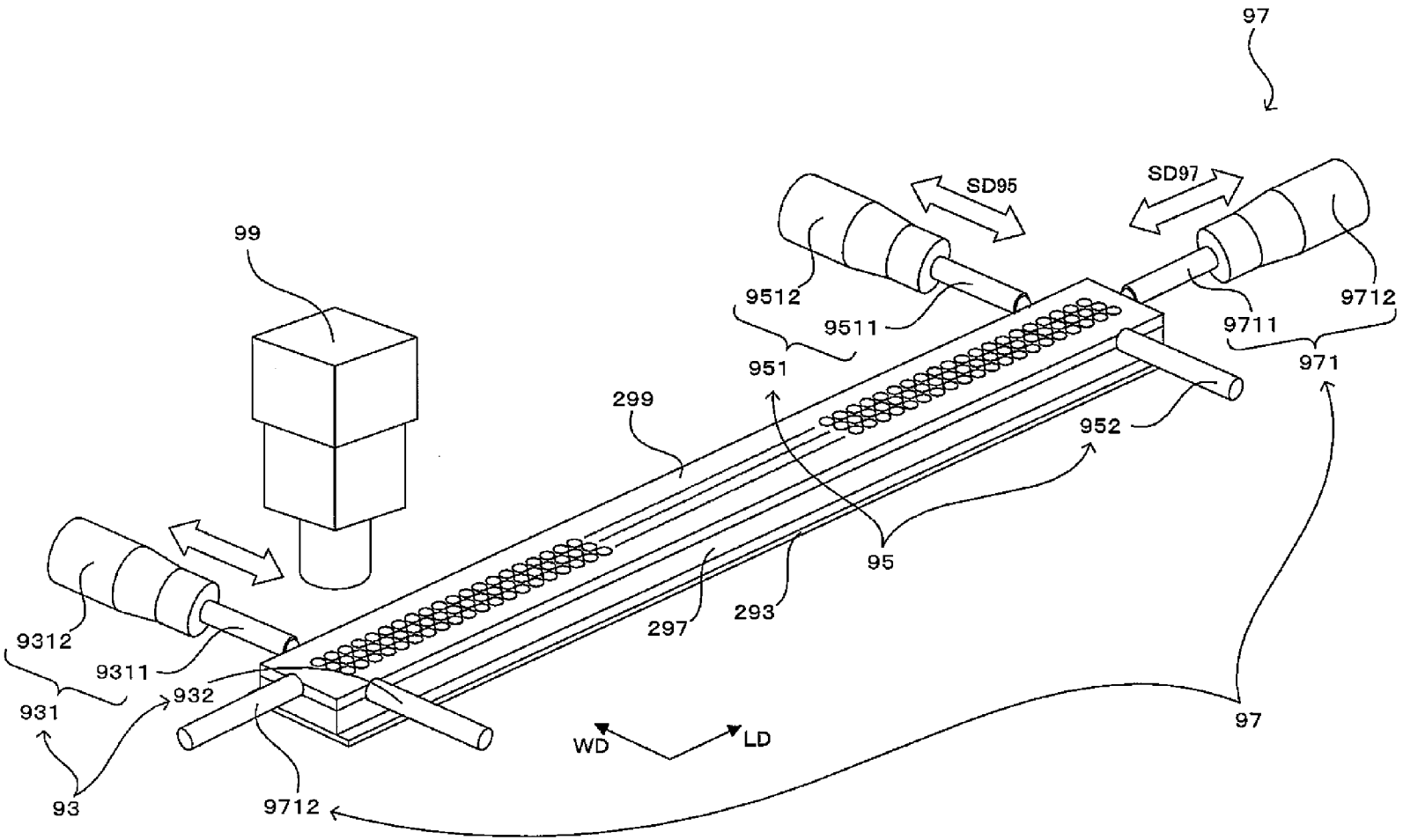
FIG. 16 is a perspective view showing array moving mechanisms and an observation optical system incorporated in a line head adjustment apparatus according to a first adjustment example of the invention.
Figure 17:
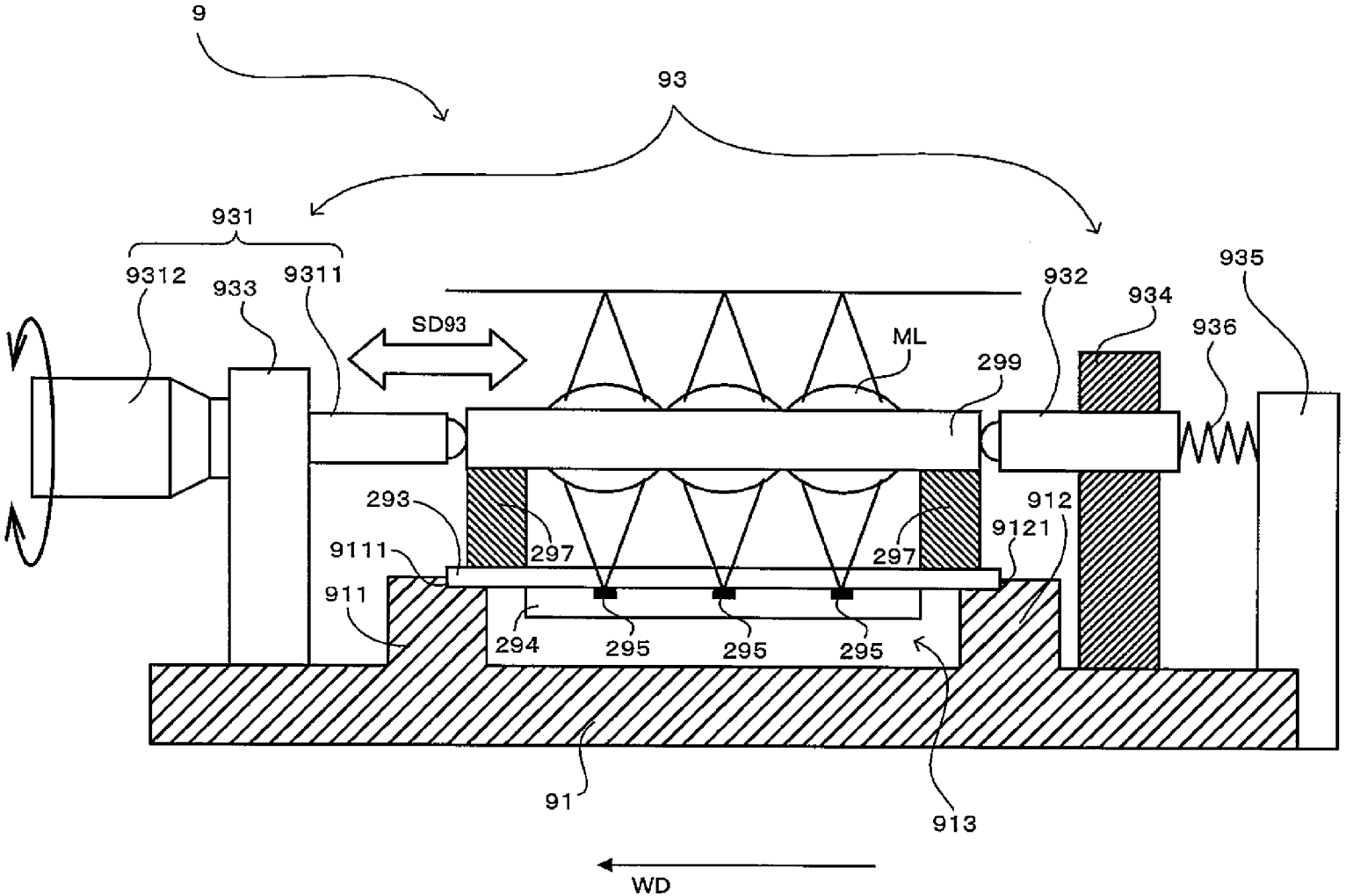
FIG. 17 is a diagram showing the line head adjustment apparatus when viewed in the longitudinal direction.

FIG. 16 is a perspective view showing array moving mechanisms and an observation optical system incorporated in a line head adjustment apparatus according to a first adjustment example of the invention, and FIG. 17 is a diagram showing the line head adjustment apparatus when viewed in the longitudinal direction. A line head adjustment apparatus 9 includes a substrate retainer 91 capable of retaining the element substrate 293, three array moving mechanisms 93, 95 and 97 and an observation optical system 99.

The substrate retainer 91 is so constructed as to be able to retain the element substrate 293 including the luminous element groups 295 on the underside surface thereof. Specifically, the substrate retainer 91 includes two mounts 911, 912, and a retraction space 913 is defined between the two mounts 911, 912. L-shaped cutouts 9111, 9121 are formed in the two mounts 911, 912. These cutouts 9111, 9121 are formed to face each other. Upon retaining the element substrate 293 by means of the substrate retainer 91, one end of the element substrate 293 in the width direction WD is placed on the cutout 9111 and the other end of the element substrate 293 in the width direction WD is placed on the cutout 9121. A distance between the cutouts 9111 and 9121 is set to prevent movements of the element substrate 293 in the width direction WD. In other words, the element substrate 293 placed on the substrate retainer 91 is prevented from moving in the width direction WD by the cutouts 9111, 9121. The substrate retainer 91 also includes a similar mechanism for preventing movements of the placed element substrate 293 in the longitudinal direction LD substantially normal to the width direction WD. In this way, the substrate retainer 91 retains the placed element substrate 293 while preventing the element substrate 293 from moving in the width direction WD and in the longitudinal direction LD of the element substrate 293.

With the element substrate 293 placed on the substrate retainer 91, the luminous element groups 295 and the sealing member 294 on the underside surface of the element substrate 293 project downward from the element substrate 293 in a direction of gravitational force. However, the retraction space 913 is provided in the substrate retainer 91 as described above. In other words, in the first adjustment example, the luminous element groups 295 and the sealing member 294 are located in the retraction space 293 so as not to touch other members with the element substrate 293 placed on the substrate retainer 91.

The array moving mechanism 93 is described with reference to FIG. 17. The array moving mechanism 93 includes a micrometer head 931 and a biasing rod 932. The micrometer head 931 is supported by a supporting member 933 fixed to the substrate retainer 91. A moving rod 9311 as a stroke member of the micrometer head 931 moves back and forth in a stroke direction SD93 as a knob 9312 is turned. The biasing rod 932 is arranged to face the moving rod 9311. As shown in FIG. 17, the biasing rod 932 is fitted in a hole formed in a supporting member 934 and is movable in this hole in the stroke direction SD93. The supporting member 934 is fixed to the substrate retainer 91. A supporting member 935 fixed to the substrate retainer 91 and the biasing rod 932 are connected by a biasing member 936. As a result, the biasing rod 932 is biased in the stroke direction SD93.

The array moving mechanism 93 moves the microlens array 299 in the following manner. When the spacer 297 is placed on the element substrate 293 placed on the substrate retainer 91 and the microlens array 299 is further placed on the spacer 297, the microlens array 299 is located between the moving rod 9311 and the biasing rod 932. At this time, the respective optical axes OA of the plurality of microlenses ML are substantially orthogonal to the top surface of the element substrate 293. If the position of the moving rod 9311 is adjusted to move forward or backward by turning the knob 9312 in this state, the microlens array 299 is held between the moving rod 9311 and the biasing rod 932. By moving the moving rod forward or backward with the microlens array 299 held between the two rods 9311 and 932, the microlens array 299 is moved in the stroke direction SD93. At this time, the biasing rod 932 is biased toward the moving rod 9311 in the stroke direction SD93. Therefore, the microlens array 299 is moved while being held between the moving rod 9311 and the biasing rod 932 with such a biasing force.

As shown in FIG. 16, the array moving mechanism 95 includes a micrometer head 951 and a biasing rod 952. The microlens array 299 can be moved in a stroke direction SD 95 by moving a moving rod 9511 as a stroke member of the micrometer head 951 forward or backward by turning a knob 9512. Since the detailed construction and operation of the array moving mechanism 95 are similar to those of the array moving mechanism 93, they are not described.

The array moving mechanism 97 includes a micrometer head 971 and a biasing rod 972. The micrometer head 971 and the biasing rod 972 of the array moving mechanism 97 differ from those of the above-mentioned array moving mechanisms 93, 95 in holding the microlens array 299 in the longitudinal direction LD. The microlens array 299 can be moved in a stroke direction SD97 by moving a moving rod 9711 as a stroke member of the micrometer head 971 forward or backward by turning a knob 9712. Since the detailed construction and operation of the array moving mechanism 97 are similar to those of the array moving mechanism 93, they are not described.

As shown in FIG. 16, the stroke directions SD93, SD95 are substantially parallel to the width direction WD and the stroke direction SD97 is substantially parallel to the longitudinal direction LD. In other words, the array moving mechanisms 93, 95 fulfill a function of moving the microlens array 299 in the width direction WD and the array moving mechanism 97 fulfills a function of moving the microlens array 299 in the longitudinal direction LD.

The observation optical system 99 is arranged to face one end of the microlens array 299 in the longitudinal direction LD from above in the direction of gravitational force with the microlens array 299 placed on the spacer 297. At this time, the observation optical system 99 observes the microlens array 299 in the direction of the optical axes OA of the microlenses ML. In other words, the observation optical system 99 observes a video image projected on a plane perpendicular to the optical axes OA of the microlenses ML. The observation optical system 99 can observe the luminous elements 2951 and the images of the light beams emitted from the luminous elements 2951. Further, the observation optical system 99 includes a crosshair cursor and obtains position information on the positions of the luminous elements 2951 using this crosshair cursor. Such a crosshair cursor can be moved to and fixed at any arbitrary point of the video the observation optical system 99 is observing. The detail of the crosshair cursor and an operation of obtaining the position information using the crosshair cursor are clarified in the following description. Further, the line head adjustment method carried out using the aforementioned adjustment apparatus 9 is described.

Figure 18:
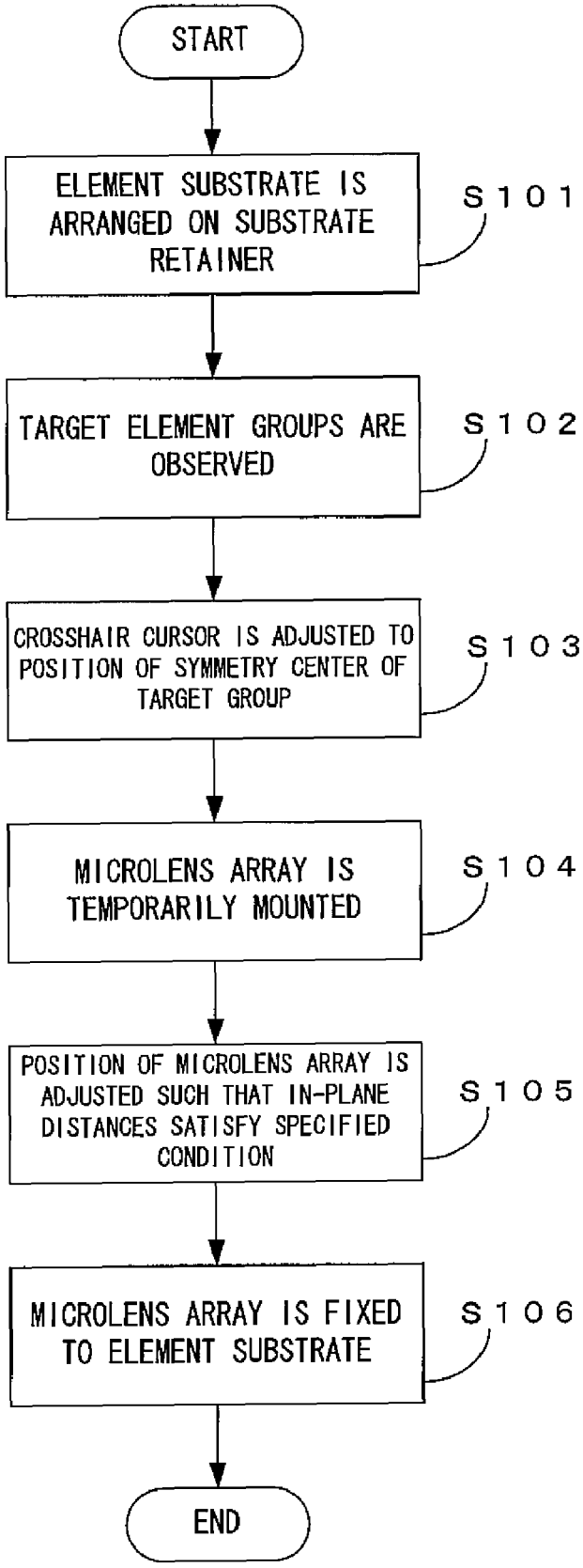
FIG. 18 is a flow chart showing the line head adjustment method.
Figure 19:
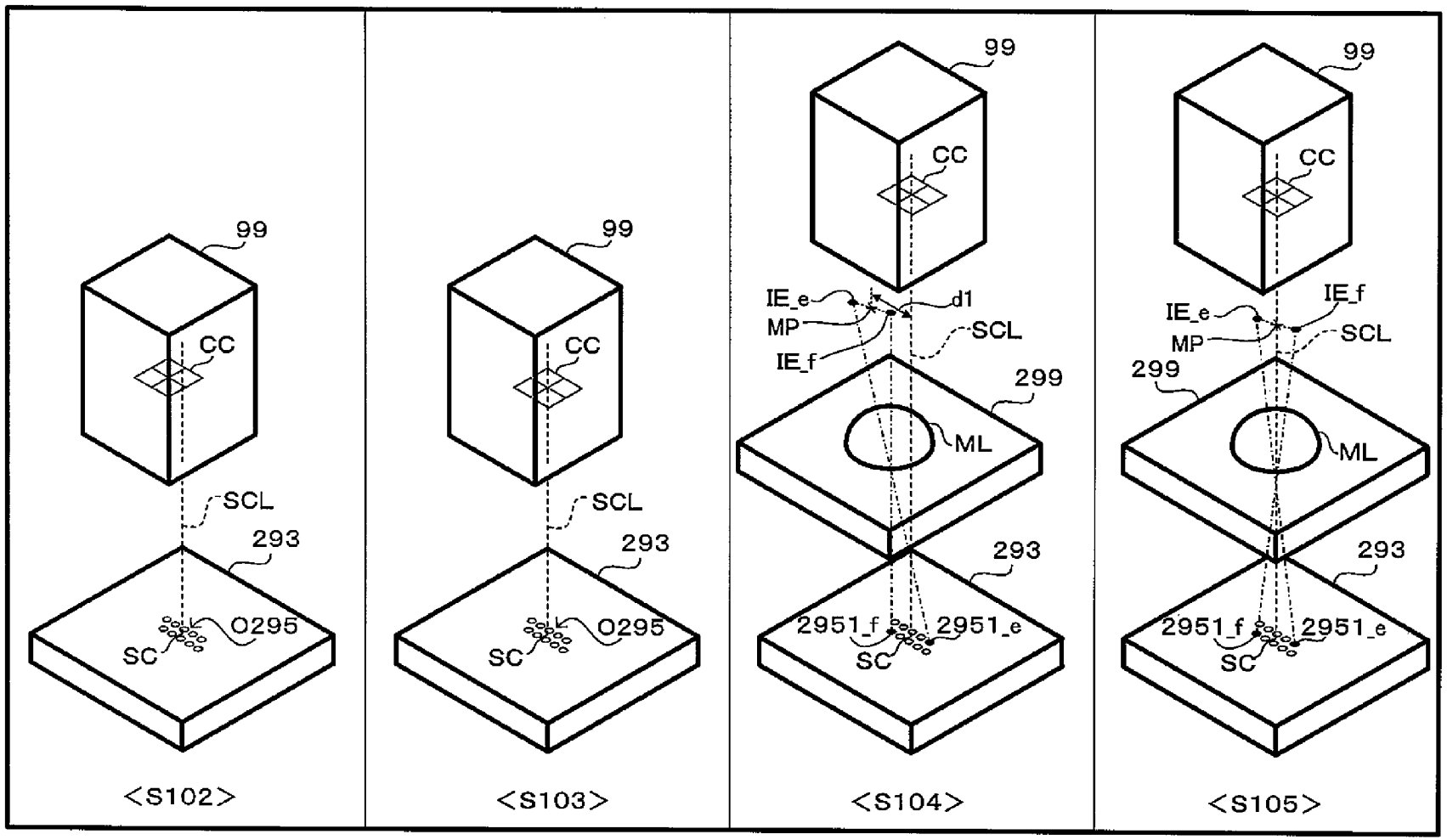
FIG. 19 is perspective views showing operations corresponding to the flow chart of FIG. 18.
Figure 20:
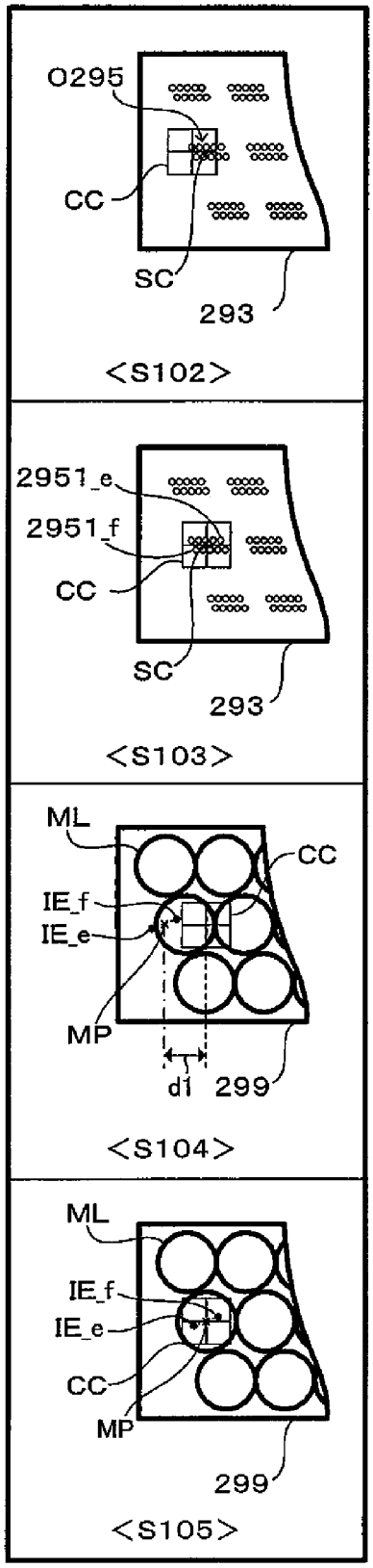
FIG. 20 is front views showing the operations corresponding to the flow chart of FIG. 18.

FIG. 18 is a flow chart showing the line head adjustment method, and FIG. 19 is perspective views showing operations corresponding to the flow chart of FIG. 18. In FIG. 19, only a target luminous element group and only the microlens facing the target group are shown in order to facilitate the understanding. FIG. 20 is front views showing the operations corresponding to the flow chart of FIG. 18. In other words, FIG. 20 shows adjustment operations observed by the observation optical system.

In Step S101, the element substrate 293 is arranged on the substrate retainer 91 (substrate arrangement step). In Step S102, the luminous element groups 295 are observed using the observation optical system 99. In the first adjustment example, the luminous element group 295 facing the microlens ML located at the leftmost position in FIG. 7 out of a plurality of microlenses ML belonging to the middle of the three lens rows MLR arranged in the width direction WD is set as the target group O295.

In Step S103, the aiming point of the crosshair cursor CC is adjusted to the position of the symmetry center SC of the target group O295 and the position of this aiming point is obtained as position information on the position of the symmetry center SC (position information obtaining step). At this time, upon adjusting the aiming point of the crosshair cursor CC to the symmetry center SC, the aiming point of the crosshair cursor CC may be adjusted to the midpoint of the point-symmetric luminous elements 2951 described above. Here, the aiming point of the crosshair cursor CC is an intersection of two straight lines forming a cross. In this specification, "to adjust the aiming point of the crosshair cursor CC to the position of the symmetry center SC" means to position the aiming point of the crosshair cursor CC on a straight line SCL extending from the symmetry center SC in the direction of the optical axis OA.

In Step S104, the microlens array 299 is temporarily mounted. It should be noted that "temporary mounting" means an operation of arranging the microlens array 299 at a position to face the element substrate 293 while holding it movably relative to the element substrate 293. In other words, in Step S104, the spacer 297 is placed on the element substrate 293 and the microlens array 299 is arranged on the spacer 297 as described with reference to FIG. 17. At this time, the microlens array 299 is arranged such that the respective microlenses ML face the corresponding luminous element groups 295 (array arrangement step).

Subsequently, an optical axis adjustment process is performed to the symmetry center SC. In this optical axis adjustment process, two luminous elements 2951 point-symmetric with respect to the symmetry center SC are driven to emit lights. At this time, there are five ways of selecting two luminous elements 2951 point-symmetric with respect to the symmetry center SC because there are five such pairs as described above. Here, it is assumed that the luminous elements 2951_*e*, 2951_*f* are driven to emit lights. At this time, the corresponding microlens ML is facing the luminous elements 2951_*e*, 2951_*f*. Accordingly, the respective light beams emitted from the luminous elements 2951_*e*, 2951_*f* are focused as images IE_e, IE_f by the microlens ML. Since the position of the target group O295 and those of the images IE_e, IE_f are spaced apart by the conjugation length of the microlens ML in the direction of the optical axis OA, the observation optical system 99 needs to be distanced from the element substrate 293 in the direction of the optical axis OA to observe the images IE_e, IE_f by means of the observation optical system 99.

Here, consideration is given to "a midpoint MP of the two images IE_e, IE_f formed by focusing the light beams emitted from the two symmetric luminous elements 2951_*e*, 2951_*f* by means of the microlens ML". Such a midpoint MP is a position, so to say, where an image of a virtual object point located at the symmetry center SC of the target group O295 can be formed. Accordingly, if the microlens ML is located at the ideal position relative to the luminous element group 295, both the symmetry center SC of the target group O295 and the midpoint MP of the two images IE_e, IE_f formed by focusing the light beams emitted from the two luminous elements 2951_*e*, 2951_*f* symmetric with each other are located on the optical axis OA of the microlens ML. Thus, in principle, an in-plane distance d1 (see FIGS. 19 and 20) between the symmetry center SC and the midpoint MP of the two images IE_e, IE_f should be zero. However, as shown in the column "S104" of FIGS. 19 and 20, the in-plane distance d1 is not zero. Here, the "in-plane distance" in this specification is described.

Figure 21:
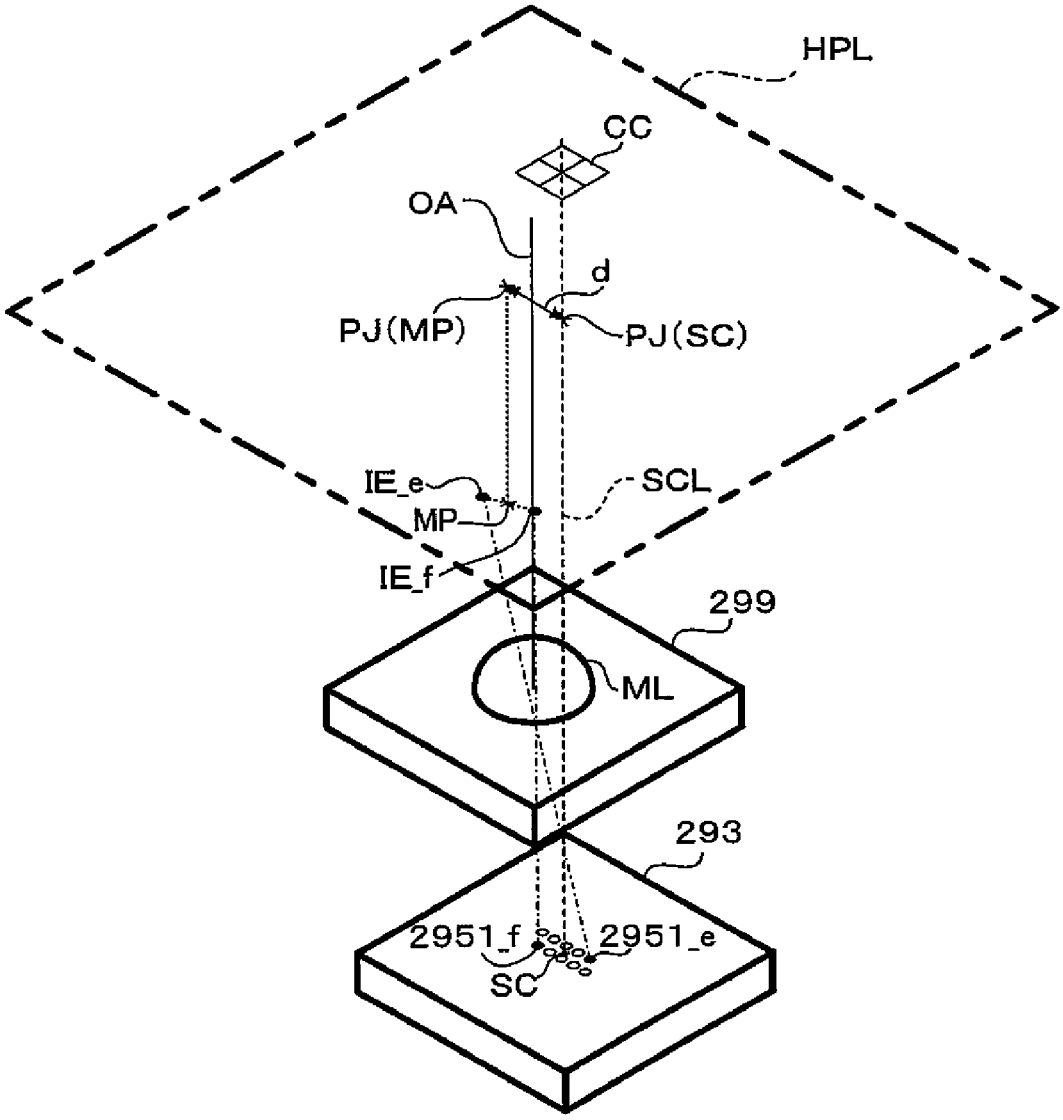
FIG. 21 is a diagram showing an in-plane distance.

FIG. 21 is a diagram showing an in-plane distance. In this specification, an in-plane distance d between the symmetry center SC of the target group O295 and the midpoint MP of the two images IE_e, IF_f formed by focusing the light beams emitted from the two luminous elements 2951 symmetric with each other is defined to be a distance between two points in a virtual perpendicular plane HPL, which is a virtual plane perpendicular to the optical axis OA of the microlens ML. In other words, when projected points of the symmetry center SC and the midpoint MP on the virtual perpendicular plane HPL are points PJ(SC) and PJ(MP), the in-plane distance d is a distance between the point PJ(SC) and the point PJ(MP). Here, projection onto the virtual perpendicular plane HPL means projection in the direction of the optical axis. At this time, it is apparent that the in-plane distance d is uniquely determined independently of the position in the optical axis direction of the virtual perpendicular plane HPL. Thus, it is sufficient for the virtual perpendicular plane HPL to be perpendicular to the optical axis OA, and the position on the optical axis direction can be arbitrarily set.

The projected position PJ(SC) of the symmetry center SC on the virtual perpendicular plane HPL is given by the position (position information) of the aiming point of the crosshair cursor CC. In other words, the aiming point of the crosshair cursor CC is present on the straight line SCL extending in the direction of the optical axis OA from the symmetry center SC as described above. Thus, the projected position of the aiming point of the crosshair cursor CC on the virtual perpendicular plane HPL is the projected position PJ(SC) of the symmetry center SC on the virtual perpendicular plane HPL. Therefore, the in-plane distance d is a distance between the position of the midpoint MP observed by the observation optical system 99 and the aiming point of the crosshair cursor CC in the above-described adjustment example. In the following description, "the in-plane distance of the symmetry center SC" means "the in-plane distance between the position of the symmetry center SC and the midpoint MP of the two images formed by focusing the light beams emitted from the luminous elements 2951 point-symmetric with respect to the symmetry center SC".

The in-plane distance d1 is created because the symmetry center SC is not on the optical axis OA, that is, the relative positional relationship of the luminous elements 2951 and the microlens ME is not ideal (the microlens ML is not located at the ideal position). In other words, the in-plane distance is a quantified amount of a deviation of the microlens ML from the ideal position. Accordingly, the optical axis adjustment process proceeds to Step S105, in which the position of the microlens array is adjusted such that the in-plane distance d1 satisfies a specified condition using the array moving mechanisms 93, 95 and 97 (position adjustment step). Specifically, in the first adjustment example, the position of the microlens array 299 is adjusted such that the in-plane distance d1 is zeroed (that is, such that the midpoint MP and the aiming point of the crosshair cursor CC overlap when viewed from the observation optical system 99). When the position adjustment process is completed by performing the optical axis adjustment process in this way, the microlens array 299 and the spacer 297 are fixed to the element substrate 293 in Step S106. In this way, the microlens array 299 is mounted on the element substrate 293.

As described above, in the first adjustment example, the aiming point of the crosshair cursor CC is first adjusted to the symmetry center SC of the target group O295 to obtain the position information of the target group O295 in an unmounted state of the microlens array 299. Subsequently, the microlens array 299 is arranged to face the element substrate 293 (that is, the microlens array 299 is temporarily mounted) to perform the optical axis adjustment process. In such an optical axis adjustment process, the relative positional relationship of the element substrate 293 and the microlens array 299 is so adjusted as to zero the in-plane distance d1 between the projected position OJ(SC) of the symmetry center SC on the virtual perpendicular plane HPL given from the previously obtained position information (position of the aiming point of the crosshair cursor CC) and the midpoint MP of the images IE_e, IE_f formed by focusing the light beams emitted from the two luminous elements 2951_*e*, 2951_f point-symmetric with respect to the symmetry center SC. In other words, the relative positional relationship of the element substrate 293 and the microlens array 299 is adjusted based on the comparison of the position of the symmetry center SC in the unmounted state of the microlens array 299 and the midpoint MP of the images IE_e, IE_f formed by focusing the light beams emitted from the two luminous elements 2951_*e*, 2951_*f* point-symmetric with respect to the symmetry center SC by means of the microlens ML in the state where the microlens array 299 is temporarily mounted. Thus, in this embodiment, a more accurate adjustment is possible as compared to the related art in which the relative positional relationship of the element substrate and the microlens array is adjusted only based on a light quantity distribution in the state where the microlens array is mounted. By assembling the line head 29 through such an adjustment, the microlens array 299 is mounted on the element substrate 293 in a state where the in-plane distance d1 satisfies the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

Particularly, in the first adjustment example, the relative positional relationship of the element substrate 293 and the microlens array 299 is so adjusted as to zero the in-plane distance d1 during the optical axis adjustment process. At this time, the symmetry center SC of the target group O295 is located on the optical axis of the corresponding microlens ML. This is preferable because the microlens ML corresponding to the target group O295 can be located at the ideal position.

In the array arrangement step, the spacer 297 for defining the spacing between the element substrate 293 and the microlens array 299 by having one side thereof held in contact with the element substrate 293 and the other side thereof held in contact with the microlens array 299 is arranged between the element substrate 293 and the microlens array 299. By such a line head adjustment method, the positions of the element substrate 293 and the microlens array 299 can be adjusted with the spacing between the element substrate 293 and the microlens array 299 defined by the spacer 297, wherefore a highly accurate position adjustment can be easily realized.

In the above line head 29, the spots SP are formed while being aligned in the direction normal to or substantially normal to the moving direction of the image plane by driving the respective luminous elements 2951 to emit lights at timings in conformity with the movement of the image plane (photosensitive drum surface). However, in such a construction for forming a plurality of spots SP by driving the respective luminous elements 2951 to emit lights at the timings in conformity with the movement of the image plane, it is much more desirable to suppress the deviations of the image positions resulting from the positional relationship of the luminous elements 2951 and the microlenses ML in order to form these spots SP at correct positions on the image plane. Therefore, the invention is particularly suitably applicable to such a construction.

In the above line head 29, an adjustment is made based on the positions of the images of the light beams emitted by driving the luminous elements 2951 and focused by the microlenses ML. Accordingly, even if the shapes of the luminous elements 2951 are difficult to read because the luminous elements 2951 are insufficiently illuminated with the microlenses ML temporarily mounted (that is, the images of the luminous elements 2951 by the microlenses ML cannot be satisfactorily observed and, as a result, the positions of the images of the luminous elements 2952 by the microlenses ML cannot be specified), the positions of the images of the luminous elements 2951 by the microlenses ML can be easily specified by turning the luminous elements 2951 on and observing the images of the light beams emitted from the luminous elements 2951 and focused by the microlenses ML. This is preferable.

SECOND ADJUSTMENT EXAMPLE

In the first adjustment example, the optical axis adjustment process is applied only to one target group O295. However, the optical axis adjustment process may be applied to two target groups O295. Accordingly, the optical axis adjustment process is applied to two target groups O295 in the second adjustment example.

Figure 22:
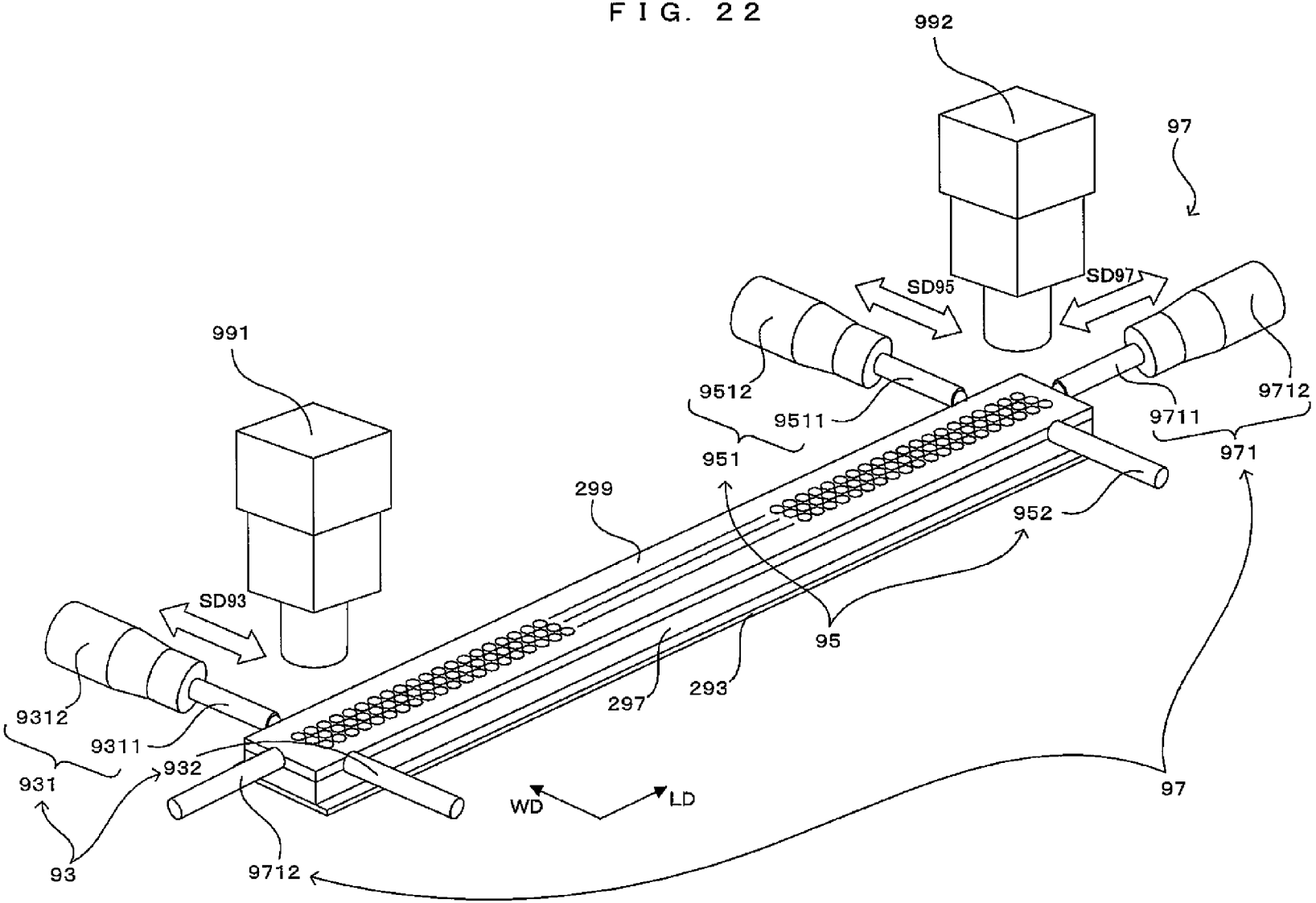
FIG. 22 is a perspective view showing a line head adjustment apparatus according to a second adjustment example.
Figure 23:
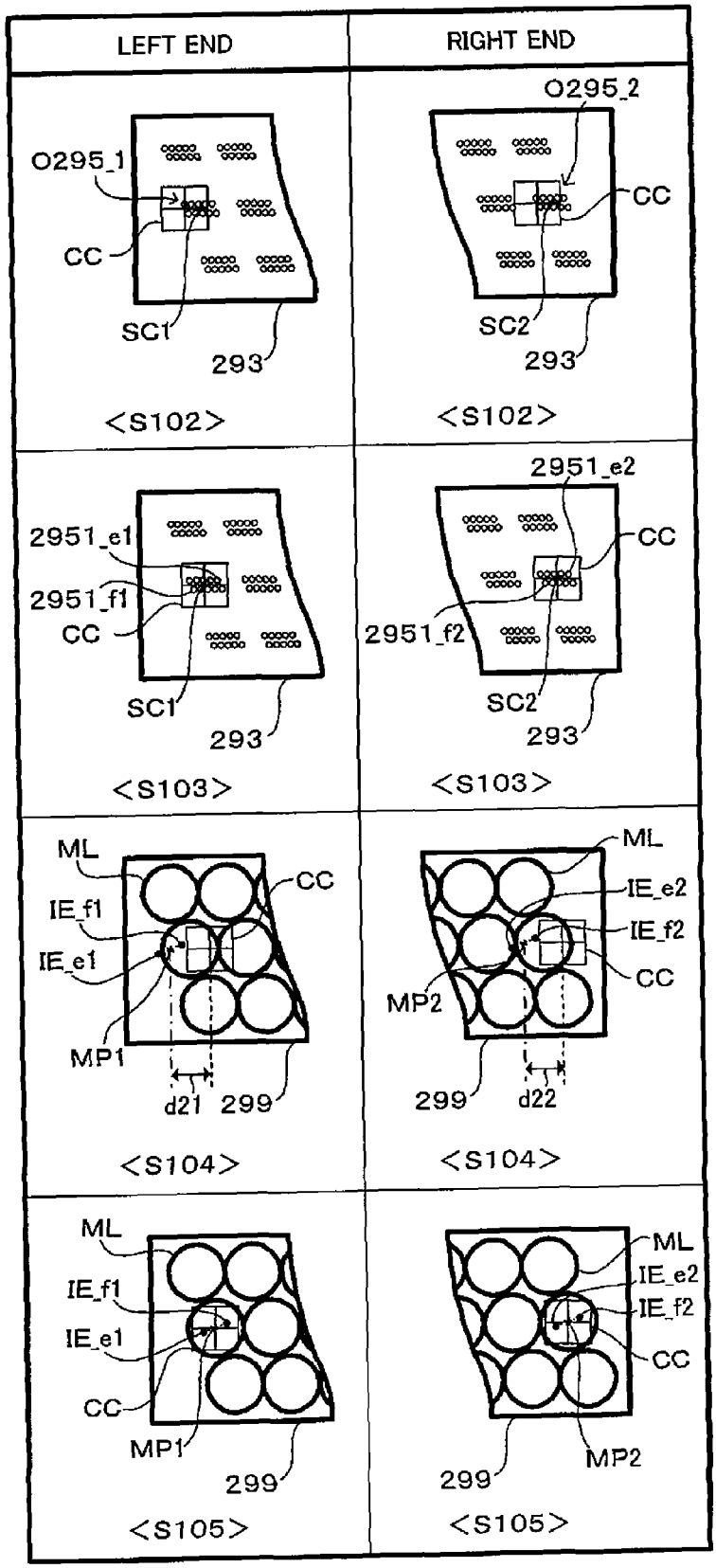
FIG. 23 is front views showing an adjustment operation in the second adjustment example.

FIG. 22 is a perspective view showing a line head adjustment apparatus according to a second adjustment example. As shown in FIG. 22, the line head adjustment apparatus of the second adjustment example is such that two observation optical systems 991, 992 are arranged at the opposite ends of the element substrate 293 in the longitudinal direction LD. In other words, the two observation optical systems 991, 992 are provided to correspond to the two target groups O295 as is clarified in the following description. The other construction of the adjustment apparatus is similar to that of the first adjustment example. FIG. 23 is front views showing an adjustment operation in the second adjustment example. In other words, FIG. 23 shows the adjustment operation observed by the observation optical systems. Since the flow of the adjustment operation performed in the second adjustment example is basically similar to that of the first adjustment example, the flow is described with reference to the flow chart of FIG. 18.

In Step S101, the element substrate 293 is placed on the substrate retainer 91 (substrate arrangement step). In Step S102, the target group O295_1 is observed using the observation optical system 991 and the target group O295_2 is observed using the observation optical system 992. In the second adjustment example, the luminous element groups 295 facing the two microlenses ML located at the opposite ends out of a plurality of microlenses ML belonging to the middle of the three lens rows MLR arranged in the width direction WD are set as the target groups O295. Reference numeral O295_1 is given to the target group at the left end, and reference numeral O295_2 is given to the target group at the right end. In Step S103, aiming points of crosshair cursors CC are adjusted to the position of a symmetry center SC1 of the target group O295_1 and that of a symmetry center SC 2 of the target group O295_2, and the positions of the aiming points are obtained as position information on the positions of the symmetry centers SC1, SC2 (position information obtaining step).

In Step S104, the microlens array 299 is temporarily mounted. In other words, in Step S104, the spacer 297 is placed on the element substrate 293 and the microlens array 299 is arranged on the spacer 297 as described with reference to FIG. 17. At this time, the microlens array 299 is arranged such that the plurality of respective microlenses ML face the corresponding luminous element groups 295 (array arrangement step).

Subsequently, the optical axis adjustment process is performed to the respective symmetry centers SC1, SC2. First in this optical axis adjustment process, two luminous elements 2951_*e*1, 2951_*f*1 point-symmetric with respect to the symmetry center SC1 are driven to emit lights, and two luminous elements 2951_*e*2, 2951_*f*2 point-symmetric with respect to the symmetry center SC2 are driven to emit lights. At this time, the corresponding microlenses ML are facing the target groups O295_1, O295_2. Accordingly, light beams emitted from the luminous elements 2951_*e*1, 2951_*f*1 are focused as images IE_e1, IE_f1 by the microlens ML, and light beams emitted from the luminous elements 2951_*e*2, 2951_*f*2 are focused as images IE_e2, IE_2 by the microlens ML. Here, a point MP1 is a midpoint between the images IE_e1 and IE_f1 and a point MP2 is a midpoint between the images IE_e2 and IE_f2. Then, Step S105 follows, in which the position of the microlens array 299 is adjusted such that the in-plane distances d21, d22 of the respective symmetry centers SC1, SC2 satisfy a specified condition (position adjustment step). Specifically, in the second adjustment example, the position of the microlens array 299 is adjusted to zero the in-plane distances d21, d22. In other words, the midpoints MP1, MP2 are brought into coincidence with the aiming points of the corresponding crosshair cursors CC when viewed from the observation optical systems 991, 992. Thus, the in-plane distances d21, d22 having finite lengths in the columns of "S104" in FIG. 23 become zero as shown in the column "S105" in FIG. 23. Upon completing the position adjustment step by performing the optical axis adjustment process in this way, the microlens array 299 and the spacer 297 are fixed to the element substrate 293 in Step S106. In this way, the microlens array 299 is mounted on the element substrate 293.

As described above, in the second adjustment example, the relative positional relationship of the element substrate 293 and the microlens array 299 is adjusted based on the comparison of the positions of the symmetry centers SC1, SC2 in the unmounted state of the microlens array 299 and the midpoints MP1, MP2 of the two luminous elements 2951 point-symmetric with each other in the state where the microlens array 299 is temporarily mounted. In other words, the relative positional relationship of the element substrate 293 and the microlens array 299 is adjusted to zero the two in-plane distances d21, d22. Thus, the relative positional relationship of the luminous elements 2951 and the microlenses ML can be adjusted with high accuracy. As a result, the relative positional relationship of the element substrate 293 and the microlens array 299 can be adjusted with high accuracy. By assembling the line head 29 through such an adjustment, the microlens array 299 is mounted on the element substrate 293 in a state where the in-plane distances d21, d22 satisfy the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

Further, in the second adjustment example, the optical axis adjustment process is performed to the two target groups O295_1, O295_2 to adjust the relative positional relationship of the element substrate 293 and the microlens array 299, wherefore a more accurate adjustment is realized as compared to the first adjustment example.

THIRD ADJUSTMENT EXAMPLE

Both first and second adjustment examples were described on the assumption that the arrangement pitches of the microlenses ML in the microlens array 299 and those of the luminous element groups 295 in the element substrate 293 are perfectly identical and uniform. For example, in the second adjustment example, the respective in-plane distances d21, d22 of the two symmetry centers SC1, SC2 are zeroed. However, these members (the microlens array 299 and the element substrate 293) produced in an actual production process are possibly subject to various variations. These variations include the length difference between the element substrate 293 and the microlens array 299 in the longitudinal direction LD, non-uniform arrangement pitches of the microlenses ML in the microlens array 299, non-uniform arrangement pitches of the luminous element groups 295 in the element substrate 293 and differences between the arrangement pitches of the microlenses ML and those of the luminous element groups 295. Accordingly, it is not always possible to zero both of the in-plane distances d21, d22. In other words, there can be thought a case where it is impossible to zero the in-plane distance d22 if the in-plane distance d21 is zeroed.

Accordingly, technology for enabling the relative positional relationship of the element substrate 293 and the microlens array 299 to be adjusted with high accuracy even when there are variations described above is described next. In the third adjustment example described below, it is assumed as an example of variation that the microlens array 299 is shorter than the element substrate 293 in the longitudinal direction LD.

Figure 24:
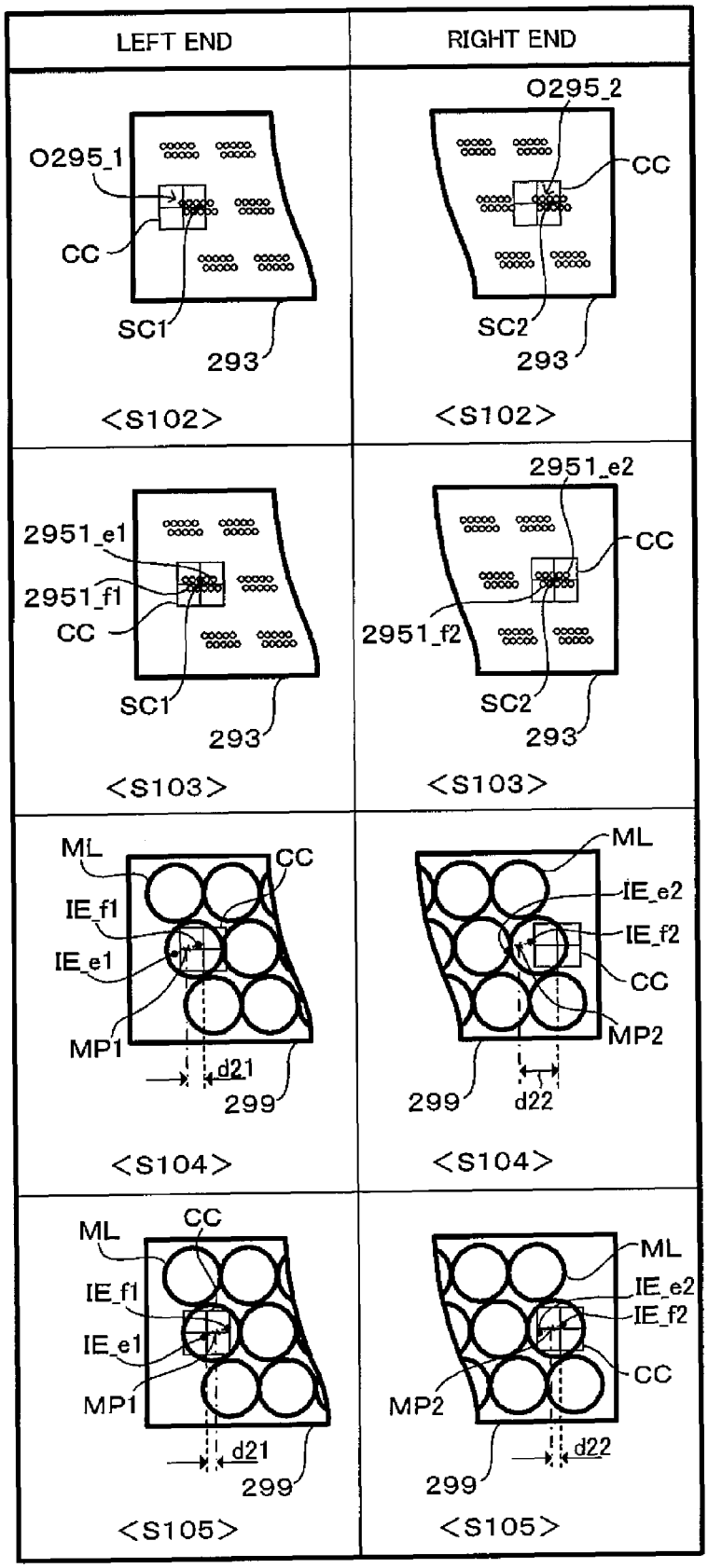
FIG. 24 is a group of front views showing an adjustment operation in the third adjustment example.

FIG. 24 is a group of front views showing an adjustment operation in the third adjustment example. In other words, FIG. 24 shows the adjustment operation observed by the observation optical systems. A line head adjustment apparatus of the third adjustment example is similar to that of the second adjustment apparatus. Since the flow of the adjustment operation performed in the third adjustment example is basically similar to that of the first adjustment example, the flow is described with reference to the flow chart of FIG. 18.

Operations in Steps S101 to S103 are not described since being similar to those of the second adjustment example. In Step S104, the microlens array 299 is temporarily mounted. In other words, in Step S104, the spacer 297 is placed on the element substrate 293 and the microlens array 299 is arranged on the spacer 297 as described with reference to FIG. 17. At this time, the microlens array 299 is arranged such that the plurality of respective microlenses ML face the corresponding luminous element groups 295 (array arrangement step).

Subsequently, the optical axis adjustment process is performed to the respective symmetry centers SC1, SC2. First in this optical axis adjustment process, two luminous elements 2951_*e*1, 2951_*f*1 point-symmetric with respect to the symmetry center SC1 are driven to emit lights, and two luminous elements 2951_*e*2, 2951_*f*2 point-symmetric with respect to the symmetry center SC2 are driven to emit lights. At this time, the corresponding microlenses ML are facing two target groups O295_1, O295_2. Accordingly, light beams emitted from the luminous elements 2951_*e*1, 2951_*f*1 are focused as images IE_e1, IE_f1 by the microlens ML, and light beams emitted from the luminous elements 2951_*e*2, 2951_2f are focused as images IE_e2, IE_f2 by the microlens ML. Here, a point MP1 is a midpoint between the images IE_e1 and IE_f1 and a point MP2 is a midpoint between the images IE_e2 and IE_f2. Then, Step S105 follows, in which the position of the microlens array 299 is adjusted such that in-plane distances d21, d22 of the respective symmetry centers SC1, SC2 satisfy a specified condition (position adjustment step). Specifically, in the third adjustment example, the position of the microlens array 299 is adjusted to equalize the respective in-plane distances d21, d22 of the symmetry centers SC1, SC2, that is, d21=d22. Thus, the in-plane distances d21, d22 having different lengths in the column "S104" in FIG. 24 become equal as shown in the column "S105" in FIG. 24. Upon completing the position adjustment step by performing the optical axis adjustment process in this way, the microlens array 299 and the spacer 297 are fixed to the element substrate 293 in Step S106. In this way, the microlens array 299 is mounted on the element substrate 293.

As described above, in the third adjustment example, the relative positional relationship of the element substrate 293 and the microlens array 299 is adjusted based on the comparison of the positions of the symmetry centers SC1, SC2 in the unmounted state of the microlens array 299 and the midpoints MP1, MP2 of the two luminous elements 2951 point-symmetric with each other in the state where the microlens array 299 is temporarily mounted. In other words, the relative positional relationship of the element substrate 293 and the microlens array 299 is adjusted to equalize the respective in-plane distances d21, d22 of the symmetry centers SC1, SC2. Thus, the relative positional relationship of the luminous elements 2951 and the microlenses ML can be adjusted with high accuracy. As a result, the relative positional relationship of the element substrate 293 and the microlens array 299 can be adjusted with high accuracy. By assembling the line head 29 through such an adjustment, the microlens array 299 is mounted on the element substrate 293 in a state where the in-plane distances d21, d22 satisfy the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

Further, in the optical axis adjustment process of the third adjustment example, an adjustment is made not to zero the two in-plane distances d21, d22, but to equalize the in-plane distances d21, d22. Such an adjustment process is particularly preferable in the case where there is any variation in the element substrate 293 and the microlens array 299 formed in the production process. In other words, if there is such a variation, there can be thought a case where it is impossible to zero both of the in-plane distances d21, d22. As a result, the optical axis adjustment process might not be able to be finished. On the contrary, in the optical axis adjustment process of the third adjustment example, a problem of being unable to finish the optical axis adjustment process can be advantageously avoided since the adjustment is made to equalize the in-plane distances d21, d22.

FOURTH ADJUSTMENT EXAMPLE

In the third adjustment example was described the adjustment method preferable in the case where the element substrate 293 or the microlens array 299 has a variation. However, not only the above-described variations, but also the curvatures of the element substrate 293 and the microlens array 299 might occur as problems resulting from the production process of these members. Accordingly, technology for enabling the relative positional relationship of the element substrate 293 and the microlens array 299 to be adjusted with high accuracy even when such curvatures are present is described in a fourth adjustment example described below.

Figure 25:
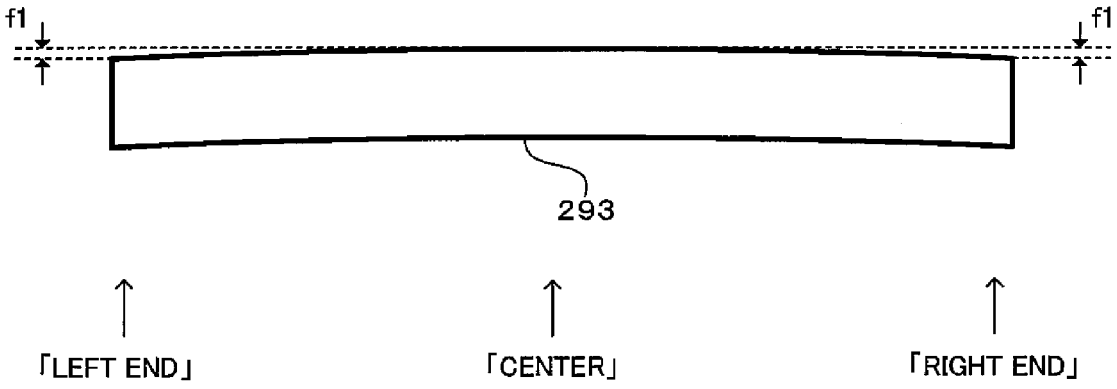
FIG. 25 is a diagram showing a curved state of the element substrate.
Figure 26:
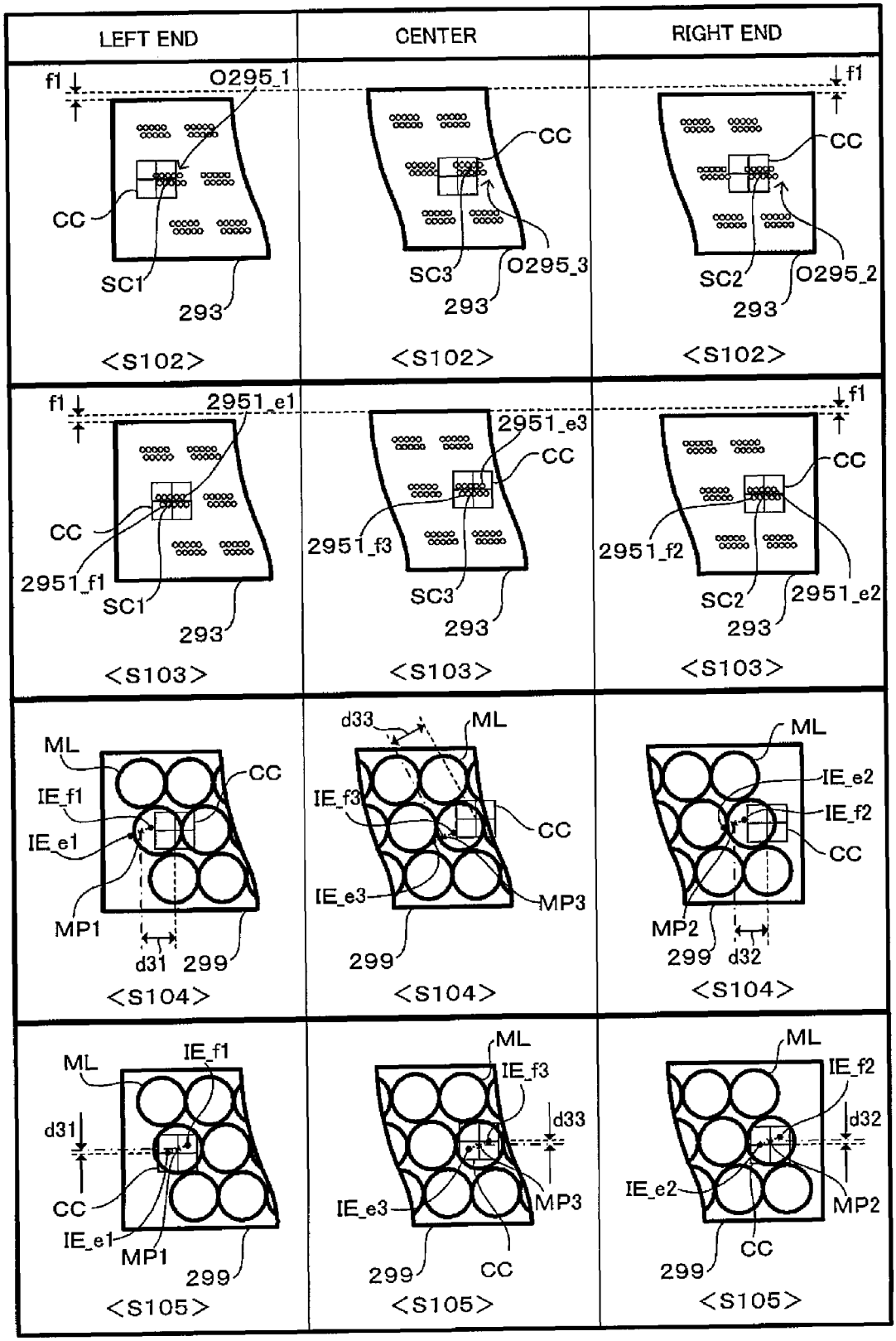
FIG. 26 is a group of front views showing an adjustment operation in the fourth adjustment example.

FIG. 25 is a diagram showing a curved state of the element substrate. In the following description, it is assumed that only the element substrate 293 is curved as shown in FIG. 25 and the microlens array 299 is not curved. FIG. 26 is a group of front views showing an adjustment operation in the fourth adjustment example. In other words, FIG. 26 shows the adjustment operation observed by observation optical systems. In the fourth adjustment example, three observation optical systems are provided in a one-to-one correspondence with three target groups O295. Since the flow of the adjustment operation performed in the fourth adjustment example is basically similar to that of the first adjustment example, the flow is described with reference to the flow chart of FIG. 18.

As shown in FIGS. 25 and 26, the element substrate 293 is curved in the fourth adjustment example. In other words, the right and the left ends of the element substrate 293 are displaced by a distance f1 in the width direction of the element substrate 299 relative to the center of the element substrate 293. Accordingly, in the fourth adjustment example, the optical axis adjustment process is performed to target groups O295_1, O295_2 and O295_3 at three positions, that is, "left end", "right end" and "center". In other words, the optical axis adjustment process is performed to a symmetry center SC1 of the target group O295_1 corresponding to the microlens ML located at the "left end", a symmetry center SC2 of the target group O295_2 corresponding to the microlens ML located at the "right end" and a symmetry center SC3 of the target group O295_3 corresponding to the microlens ML located at the "center" out of a plurality of microlenses ML belonging to the middle of the three lens rows MLR arranged in the width direction WD. The microlens ML located at the "center" is the (N+1)th microlens ML from left or right when the lens row MLR is comprised of (2N+1) microlenses ML or the N-th microlens ML from left or right when the lens row MLR is comprised of 2N microlenses ML, where N is an integer. In Step S103, aiming points of three crosshair cursors CC are adjusted to the respective positions of the symmetry centers SC1, SC2 and SC3, and the positions of the respective aiming points of these crosshair cursors CC are obtained as position information on the positions of the symmetry centers SC1, SC2 and SC3 (position information obtaining step). It is assumed that the observation optical systems are provided in conformity with the respective symmetry centers SC1, SC2 and SC3 in the fourth adjustment example. In other words, the observation optical systems are provided at three points, that is, "left end", "right end" and "center" in the fourth adjustment example.

In Step S104, the microlens array 299 is temporarily mounted. In other words, in Step S104, the spacer 297 is placed on the element substrate 293 and the microlens array 299 is arranged on the spacer 297 as described with reference to FIG. 17. At this time, the microlens array 299 is arranged such that the plurality of respective microlenses ML face the corresponding luminous element groups 295 (array arrangement step).

Subsequently, the optical axis adjustment process is performed to the respective symmetry centers SC1, SC2 and SC3. First in this optical axis adjustment process, two luminous elements 2951_*e*1, 2951_*f*1 point-symmetric with respect to the symmetry center SC1 are driven to emit lights, two luminous elements 2951_*e*2, 2951_*f*2 point-symmetric with respect to the symmetry center SC2 are driven to emit lights, and two luminous elements 2951_*e*3, 2951_*f*3 point-symmetric with respect to the symmetry center SC3 are driven to emit lights. At this time, the corresponding microlenses ML are facing the target groups O295_1, O295_2 and O295_3. Accordingly, light beams emitted from the luminous elements 2951_*e*1, 2951_*f*1 are focused as images IE_e1, IE_f1 by the microlens ML, light beams emitted from the luminous elements 2951_*e*2, 2951_*f*2 are focused as images IE_e2, IE_f2 by the microlens ML, and light beams emitted from the luminous elements 2951_*e*3, 2951_*f*3 are focused as images IE_e3, IE_f3 by the microlens ML. Here, a point MP1 is a midpoint between the images IE_e1 and IE_f1, a point MP2 is a midpoint between the images IE_e2 and IE_f2, and a point MP3 is a midpoint between the images IE_e3 and IE_f3. Then, Step S105 follows, in which the position of the microlens array 299 is adjusted such that in-plane distances satisfy a specified condition (position adjustment step). Specifically, in the fourth adjustment example, the position of the microlens array 299 is adjusted to minimize an average value of the respective in-plane distances d31, d32 and d33 of the symmetry centers SC1, SC2 and SC3, that is, av=(d31+d32+d33)/3. Thus, the respective in-plane distances d31, d32 and d33 of the symmetry centers SC1, SC2 and SC3 can be decreased as can be understood from the comparison of the columns "S104" and "S105" in FIG. 26. Upon completing the position adjustment step by performing the optical axis adjustment process in this way, the microlens array 299 and the spacer 297 are fixed to the element substrate 293 in Step S106. In this way, the microlens array 299 is mounted on the element substrate 293.

As described above, in the fourth adjustment example, the relative positional relationship of the element substrate 293 and the microlens array 299 is adjusted based on the comparison of the positions of the symmetry centers SC1, SC2 and SC3 in the unmounted state of the microlens array 299 and the midpoints MP1, MP2 and MP3 of the two luminous elements 2951 point-symmetric with each other in the state where the microlens array 299 is temporarily mounted. Thus, the relative positional relationship of the luminous elements 2951 and the microlenses ML can be adjusted with high accuracy. As a result, the relative positional relationship of the element substrate 293 and the microlens array 299 can be adjusted with high accuracy. By assembling the line head 29 through such an adjustment, the microlens array 299 is mounted on the element substrate 293 in a state where the in-plane distances d31, d32 and d33 satisfy the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

In the fourth adjustment example, the target group is provided at the position ("center" in this adjustment example) other than the "left end" and the "right end" and the optical axis adjustment process is performed to the symmetry centers SC of these three target groups. Therefore, the relative positional relationship of the element substrate 293 and the microlens array 299 can be adjusted with high accuracy also in consideration of the curvature of the element substrate 293.

FIFTH ADJUSTMENT EXAMPLE

In the above first to fourth adjustment examples, positional accuracy required for the line head 29 is not particularly considered. However, positional accuracy required for the line head 29 differs depending on the purpose of use of the line head 29. In other words, in the case of using the line head 29 in an image forming apparatus, positional accuracy required for the line head 29 varies depending on the resolution the image forming apparatus seeks to realize. Accordingly, in the fifth adjustment example, technology for easily realizing desired positional accuracy is described.

Figure 28:
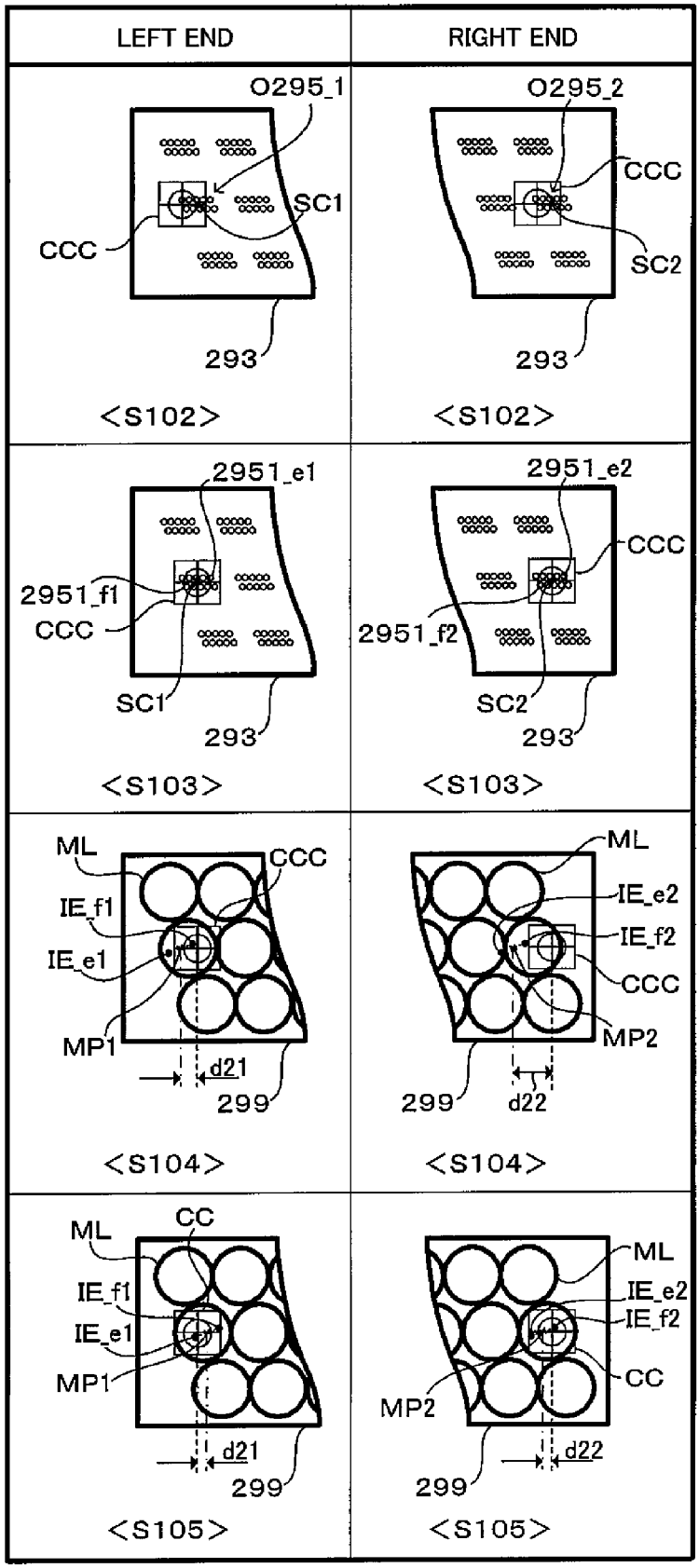
FIG. 28 is a group of front views showing an adjustment operation in the fifth adjustment example.

FIG. 27 is a group of diagrams showing a crosshair cursor used in the fifth adjustment example. The crosshair cursor CC used in the first to fourth adjustment examples is the one shown in an upper part of FIG. 27. The crosshair cursor CC is formed by two straight lines intersecting with each other at the aiming point AP. On the other hand, the crosshair cursor used in the fifth adjustment example is a circled crosshair cursor CCC shown in a lower part of FIG. 27. The circled crosshair cursor CCC has a circle CR having a radius "r" and centered on the aiming point AP where the two straight lines intersect. Thus, a distance from the aiming point AP to any point present inside the circle CR is shorter than "r". FIG. 28 is a group of front views showing an adjustment operation in the fifth adjustment example. In other words, FIG. 28 shows the adjustment operation observed by the observation optical systems. A line head adjustment apparatus of the fifth adjustment example is similar to that of the third adjustment apparatus. Since the flow of the adjustment operation performed in the fifth adjustment example is basically similar to that of the first adjustment example, the flow is described with reference to the flow chart of FIG. 18.

Operations in Steps S101 to S103 are not described since being similar to those of the third adjustment example. In other words, similar to the third adjustment example, target groups O295_1 and O295_2 are set at the "left end" and "right end" in the fifth adjustment example. However, the fifth adjustment example differs from the third adjustment example in that the crosshair cursors used upon obtaining the positions of the symmetry centers SC1, SC2 in Step S103 are the circled crosshair cursors CCC having the circle CR.

In Step S104, the microlens array 299 is temporarily mounted. In other words, in Step S104, the spacer 297 is placed on the element substrate 293 and the microlens array 299 is arranged on the spacer 297 as described with reference to FIG. 17. At this time, the microlens array 299 is arranged such that the plurality of respective microlenses ML face the corresponding luminous element groups 295 (array arrangement step).

Subsequently, the optical axis adjustment process is performed to the respective symmetry centers SC1, SC2. In the optical axis adjustment process, first, two luminous elements 2951_*e*1, 2951_*f*1 point-symmetric with respect to the symmetry center SC1 are driven to emit lights, and two luminous elements 2951_*e*2, 2951_*f*2 point-symmetric with respect to the symmetry center SC2 are driven to emit lights. At this time, the corresponding microlenses ML are facing the two target groups O295_1, O295_2. Accordingly, light beams emitted from the luminous elements 2951_*e*1, 2951_*f*1 are focused as images IE_e1, IE_f1 by the microlens ML, and light beams emitted from the luminous elements 2951_*e*2, 2951_*f*2 are focused as images IE_*e*2, IE_*f*2 by the microlens ML. Here, a point MP1 is a midpoint between the images IE_e1 and IE_f1 and a point MP2 is a midpoint between the images IE_e2 and IE_f2. Then, Step S105 follows, in which the position of the microlens array 299 is adjusted such that in-plane distances satisfy a specified condition (position adjustment step). Specifically, in the fifth adjustment example, the position of the microlens array 299 is adjusted such that the respective midpoints MP1, MP2 lie within the circles CR of the corresponding circled crosshair cursors CCC when viewed from the observation optical systems 991, 992. Thus, the in-plane distances d21, d22 of the symmetry centers SC1, SC2 are shorter than the distance "r". Upon completing the position adjustment step by performing the optical axis adjustment process in this way, the microlens array 299 and the spacer 297 are fixed to the element substrate 293 in Step S106. In this way, the microlens array 299 is mounted on the element substrate 293.

As described above, in the fifth adjustment example, the relative positional relationship of the element substrate 293 and the microlens array 299 is adjusted based on the comparison of the positions of the symmetry centers SC1, SC2 in the unmounted state of the microlens array 299 and the midpoints MP1, MP2 of the two luminous elements 2951 point-symmetric with each other in the state where the microlens array 299 is temporarily mounted. In other words, the relative positional relationship of the element substrate 293 and the microlens array 299 is adjusted such that both of the in-plane distances d21, d22 are shorter than the distance "r". Thus, the relative positional relationship of the luminous elements 2951 and the microlenses ML can be adjusted with high accuracy. As a result, the relative positional relationship of the element substrate 293 and the microlens array 299 can be adjusted with high accuracy. By assembling the line head 29 through such an adjustment, the microlens array 299 is mounted on the element substrate 293 in a state where the in-plane distances d21, d22 satisfy the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

Further, in the fifth adjustment example, the optical axis adjustment process can be completed when the in-plane distances d21, d22 become shorter than the distance "r". Particularly, in the method using the circled crosshair cursors CCC, the optical axis adjustment process can be completed when the midpoints MP1, MP2 enter the insides of the corresponding circles CR of the circled crosshair cursors CCC. Thus, it is not necessary to perform the optical axis adjustment process to such an extent as to zero the in-plane distances d21, d22. This is preferable since the optical axis adjustment process is simpler. Further, by suitably setting the distance "r", the optical axis adjustment process conforming to the desired positional accuracy of the line head can be performed and the desired positional accuracy can be easily realized.

SIXTH ADJUSTMENT EXAMPLE

The method using the circled crosshair cursor CCC as in the fifth adjustment example is also applicable, for example, to the construction in which three target groups are provided as described in the fourth adjustment example. Accordingly, the use of the circled crosshair cursors CCC in the adjustment method described in the fourth adjustment example is described in the sixth adjustment example below.

Figure 29:
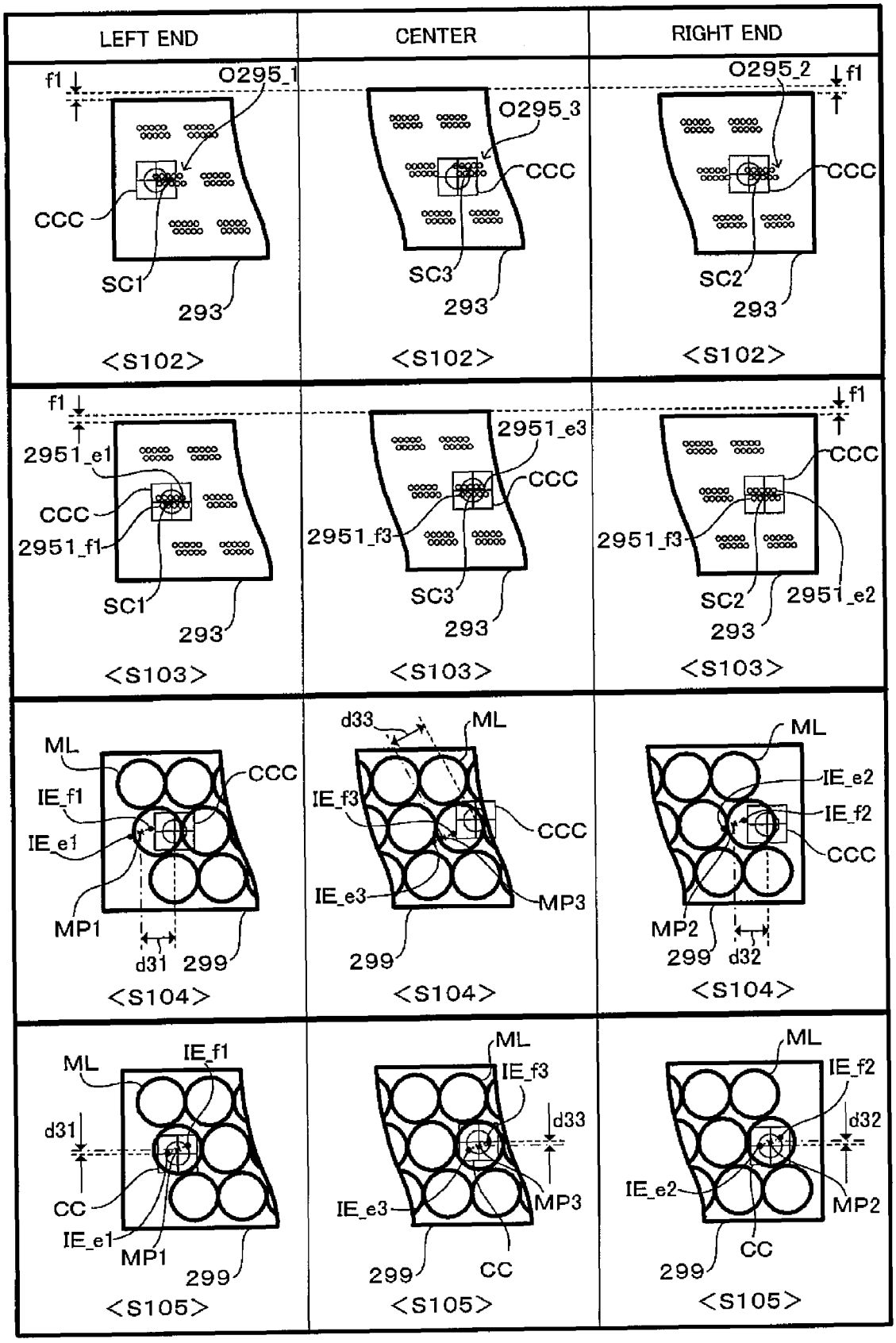
FIG. 29 is a group of front views showing an adjustment operation in the sixth adjustment example.

FIG. 29 is a group of front views showing an adjustment operation in the sixth adjustment example. In other words, FIG. 29 shows the adjustment operation observed by observation optical systems. A line head adjustment apparatus of the sixth adjustment example is similar to that of the fourth adjustment example. Since the flow of the adjustment operation performed in the sixth adjustment example is basically similar to that of the first adjustment example, the flow is described with reference to the flow chart of FIG. 18.

Operations in Steps S101 to S103 are not described since being similar to those of the fourth adjustment example. In other words, similar to the fourth adjustment example, target groups O295_1, O295_2 and O295_3 are set at the "left end", "right end" and "center" in the sixth adjustment example. However, the sixth adjustment example differs from the fourth adjustment example in that the crosshair cursors used upon obtaining the positions of the symmetry centers SC1, SC2 and SC3 in Step S103 are the circled crosshair cursors CCC having the circle CR.

Subsequently, the optical axis adjustment process is performed to the respective symmetry centers SC1, SC2 and SC3. First in this optical axis adjustment process, two luminous elements 2951_*e*1, 2951_*f*1 point-symmetric with respect to the symmetry center SC1 are driven to emit lights, two luminous elements 2951_*e*2, 2951_*f*2 point-symmetric with respect to the symmetry center SC2 are driven to emit lights, and two luminous elements 2951_*e*3, 2951_*f*3 point-symmetric with respect to the symmetry center SC3 are driven to emit lights. At this time, the corresponding microlenses ML are facing the target groups O295_1, O295_2 and O295_3. Accordingly, light beams emitted from the luminous elements 2951_*e*1, 2951_*f*1 are focused as images IE_e1, IE_f1 by the microlens ML, light beams emitted from the luminous elements 2951_*e*2, 2951_*f*2 are focused as images IE_e2, IE_2 by the microlens ML, and light beams emitted from the luminous elements 2951_*e*3, 2951_*f*3 are focused as images IE_e3, IE_f3 by the microlens ML. Here, a point MP1 is a midpoint between the images IE_e1 and IE_f1, a point MP2 is a midpoint between the images IE_e2 and IE_f2, and a point MP3 is a midpoint between the images IE_e3 and IE_f3. Then, Step S105 follows, in which the position of the microlens array 299 is adjusted such that in-plane distances satisfy a specified condition (position adjustment step). Specifically, in the sixth adjustment example, the position of the microlens array 299 is adjusted such that the respective midpoints MP1, MP2 and MP3 lie within the circles CR of the corresponding circled crosshair cursors CCC when viewed from the observation optical systems. Thus, the in-plane distances d31, d32 and d33 of the symmetry centers SC1, SC2 and SC3 are all shorter than the distance "r". Upon completing the position adjustment step by performing the optical axis adjustment process in this way, the microlens array 299 and the spacer 297 are fixed to the element substrate 293 in Step S106. In this way, the microlens array 299 is mounted on the element substrate 293.

As described above, in the sixth adjustment example, the relative positional relationship of the element substrate 293 and the microlens array 299 is adjusted based on the comparison of the positions of the symmetry centers SC1, SC2 and SC3 in the unmounted state of the microlens array 299 and the midpoints MP1, MP2 and MP3 of the two luminous elements 2951 point-symmetric with each other in the state where the microlens array 299 is temporarily mounted. In other words, the relative positional relationship of the element substrate 293 and the microlens array 299 is adjusted such that the in-plane distances d31, d32 and d33 of the symmetry centers SC1, SC2 and SC3 are all shorter than the distance "r". Thus, the relative positional relationship of the luminous elements 2951 and the microlenses ML can be adjusted with high accuracy. As a result, the relative positional relationship of the element substrate 293 and the microlens array 299 can be adjusted with high accuracy. By assembling the line head 29 through such an adjustment, the microlens array 299 is mounted on the element substrate 293 in a state where the in-plane distances d31, d32 and d33 satisfy the specified condition, that is, in the state where the relative positional relationship of the microlens array 299 and the element substrate 293 is adjusted with high accuracy. By performing an image formation using the line head 29 adjusted with high accuracy in this way, a satisfactory image can be formed.

Further, in the sixth adjustment example, the optical axis adjustment process can be completed when the in-plane distances d31, d32 and d33 become shorter than the distance "r". Particularly, in the method using the circled crosshair cursors CCC, the optical axis adjustment process can be completed when the images IE1, IE2 and IE3 enter the insides of the corresponding circles CR of the circled crosshair cursors CCC. Thus, it is not necessary to perform the optical axis adjustment process to such an extent as to zero the in-plane distances d31, d32 and d33. This is preferable since the optical axis adjustment process is simpler Further, by suitably setting the distance "r", the optical axis adjustment process conforming to the desired positional accuracy can be performed, and the desired positional accuracy can be advantageously easily realized.

G. Miscellaneous

As described above, in the above embodiment, the longitudinal direction LD and the main scanning direction MD correspond to the "first direction" of the invention, and the width direction WD and the sub scanning direction SD correspond to the "second direction" of the invention.

The invention is not limited to the above embodiment, and various changes other than the above can be made without departing from the gist thereof. For example, in the above-described second to sixth adjustment examples, all the microlenses ML facing the target groups belong to the same lens row MLR. In other words, the target groups are selected from the luminous element groups corresponding to the same lens row MLR. However, the setting mode of the target groups is not limited to this, and target groups may be selected from luminous element groups corresponding to a plurality of lens rows MLR.

Figure 30:
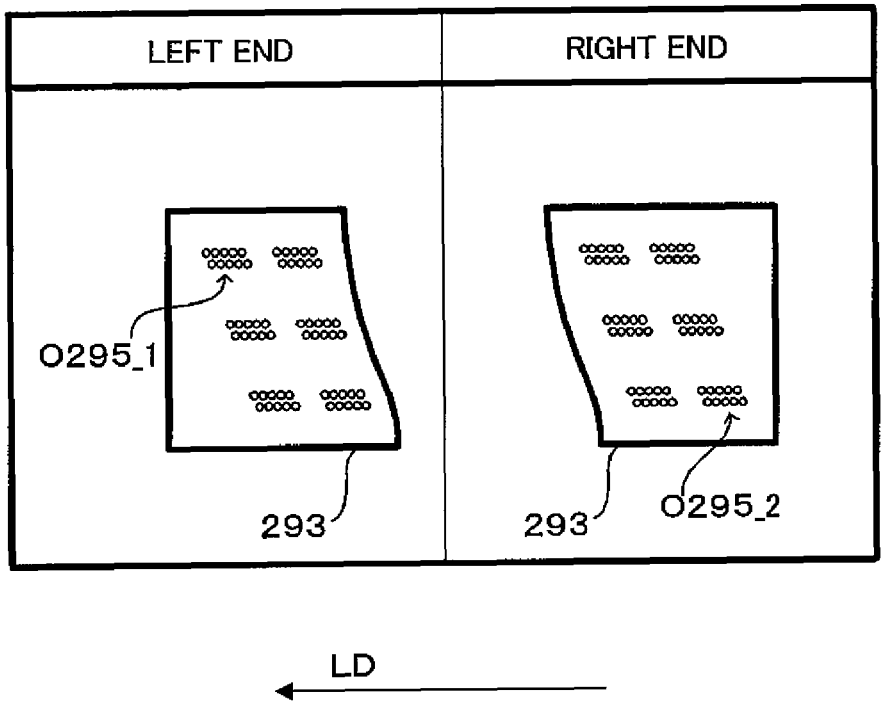
FIGS. 30 and 31 are diagrams showing a variation of the setting mode of the target groups.
Figure 31:
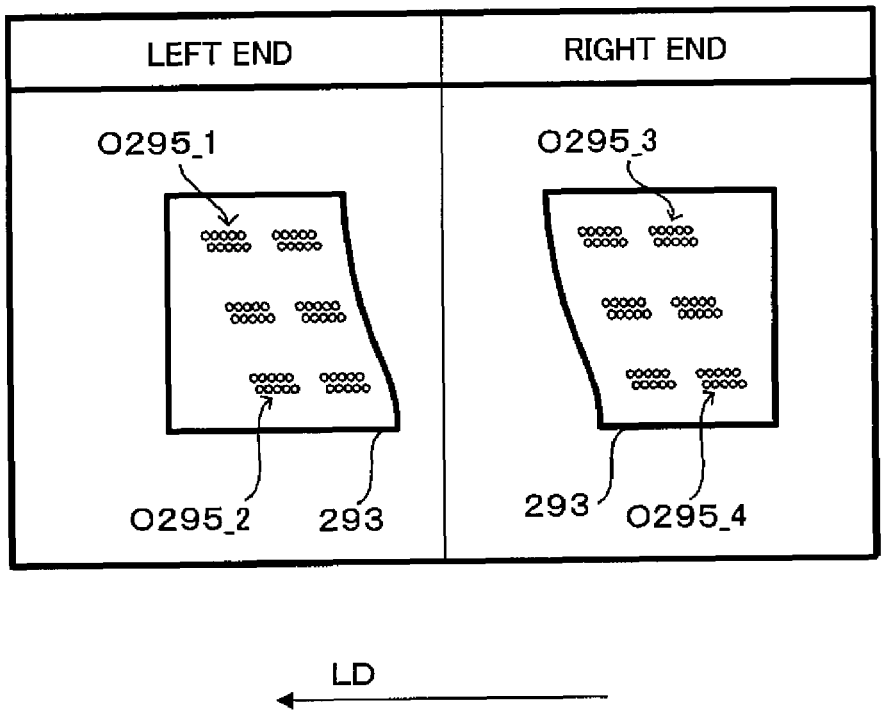

FIGS. 30 and 31 are diagrams showing a variation of the setting mode of the target groups. In FIG. 30, luminous element groups corresponding to two microlenses located at the opposite ends in the longitudinal direction are set as target groups O295_1, O295_2. At this time, in the position adjustment step, the optical axis adjustment process is performed to the two target groups O295_1, O295_2 located at the opposite ends in the longitudinal direction of the microlens array, and the relative positional relationship of the microlens array and the element substrate can be adjusted with high accuracy. In FIG. 31, luminous element groups located at the four corners of the element substrate 293 are set as target groups O295_1 to O295_4. In this case, it is preferable that the relative positional relationship of the microlens array 299 and the element substrate 293 can be adjusted with higher accuracy since the positional relationship of the microlens array 299 and the element substrate 293 is adjusted at the four corners.

In the above embodiment, as examples of the "specified condition" to be satisfied by the in-plane distances in the optical axis adjustment process, "that the in-plane distances are zero" is taken in the first and the second adjustment examples; "that the respective in-plane distances of the symmetry centers SC of the plurality of target groups are equal to each other" in the third adjustment example; "that the average value of the respective in-plane distances of the symmetry centers SC of the plurality of target groups is minimized" in the fourth adjustment example; and "that the in-plane distances are shorter than the specified distance "r"" in the fifth and sixth adjustment examples. However, the "specified condition" to be satisfied by the in-plane distances in the optical axis adjustment process is not limited to these and, for example, may be "that a deviation of the respective in-plane distances of the symmetry centers SC of a plurality of target groups is minimized". Specifically, instead of calculation to minimize the average value of the in-plane distances in the fourth adjustment example, calculation may be performed to minimize a deviation s below of the in-plane distances d31 to d33.

$$s=[\{(d31-av)^2+(d32-av)^2+(d33-av)^2\}/3]^{1/2}$$

Alternatively, calculation may be made to minimize the minimum of the in-plane distances d31 to d33.

In the above embodiment, the crosshair cursor CC or the circled crosshair cursor CCC is used to obtain the position information on the symmetry center SC using the observation optical system. However, it is not essential to use these crosshair cursors upon obtaining the position information on the symmetry center. In other words, the position information on the symmetry center SC may be obtained by letting a point cursor made up of one point function similar to the aiming points of the above-described crosshair cursors. Alternatively, a crosshair scale fixed to the observation optical system may be used. However, in this case, the observation optical system itself needs to be moved to obtain the position of the symmetry center SC and, hence, needs to be provided with a moving mechanism for this purpose. Therefore, in order to simplify the apparatus construction, a cursor movable relative to the observation optical system is preferable.

In the above embodiment, after the aiming point of the crosshair cursor CC or CCC is adjusted to the symmetry center SC in the position information obtaining step, such a crosshair cursor CC or CCC is fixed to the element substrate 293. However, it is also possible to move the crosshair cursor CC or CCC away from the symmetry center SC after the aiming point of the crosshair cursor CC or CCC is adjusted to the symmetry center SC in the position information obtaining step. In other words, in the position information obtaining step, it is intended to obtain the position information on the symmetry center SC in the unmounted state of the microlens array 299. Accordingly, the coordinates of the aiming point may be stored as the position information, for example, upon adjusting the aiming point of the crosshair cursor CC or CCC in the position information obtaining step, and then, the following steps may be performed. In other words, the following steps may be performed using the coordinates as the position information instead of using the aiming point of the crosshair cursor CC or CCC as the position information on the symmetry center SC in the first to sixth adjustment examples.

In the position adjustment step of the above embodiment, the relative positional relationship of the element substrate 293 and the microlens array 299 is adjusted by moving the microlens array 299. However, the mode for adjusting the relative positional relationship of these is not limited to this and, for example, an adjustment may be made by moving the element substrate 293 or by moving both the element substrate 293 and the microlens array 299. In response to this, a position adjuster may be constructed to move the element substrate 293 or to move both the element substrate 293 and the microlens array 299. However, in the construction in which the position of the aiming point of the crosshair cursor CC or CCC is used as the position information on the symmetry center SC, the crosshair cursor CC or CCC needs to be moved as the element substrate 293 is moved in the case where the element substrate 293 is moved in the position adjustment step. This is because, in the case of such a construction, the aiming point of the crosshair cursor CC or CCC functions as the position information on the symmetry center SC and, hence, the aiming point of the crosshair cursor CC or CCC needs to coincide with the symmetry center SC during the position adjustment step. Therefore, in order to simplify the construction, the construction of moving only the microlens array 299 for an adjustment is preferable.

Although the organic EL devices are used as the luminous elements 2951 in the above embodiment, the specific construction of the luminous elements 2951 is not limited to this. For example, LEDs (light emitting diodes) may be used as the luminous elements 2951. However, in order to use LEDs as the luminous elements 2951, LED chips are arrayed on the element substrate 293. As a result, a degree of freedom in arranging the luminous elements 2951 decreases. Therefore, the use of organic EL devices as the luminous elements 2951 is preferable because the luminous elements 2951 can be relatively freely arrayed on the element substrate 293.

Organic EL devices are preferably used as the luminous elements 2951 as described above, but it is also possible to use a shutter array (light valve) having a fluorescent tube such as a FL (fluorescent lamp) tube or light emitting elements such as inorganic EL devices as a light source. In other words, the respective shutters of the shutter array can function as the luminous elements 2951 by such a construction as to focus light beams having passed through the respective shutters for controlling the passage of light by means of the microlenses ML.

In the above embodiment, each luminous element group 295 is comprised of ten luminous elements 2951 arranged in point symmetry with respect to the symmetry center SC. However, the number of the luminous elements 2951 constituting the luminous element group 295 is not limited to this. Further, in the above embodiment, the luminous element group 295 is formed by arranging two luminous element rows 2951R in the width direction WD. However, the formation mode of the luminous element group 295 is not limited to this. The luminous element group 295 may be formed by arranging three luminous element rows 2951R in the width direction WD or may be formed by one luminous element row 2951R. In short, the present invention is, in general, applicable to line heads in which each luminous element group 295 is formed by arranging the luminous elements 2951 in point symmetry with respect to the symmetry center SC.

Figure 32:
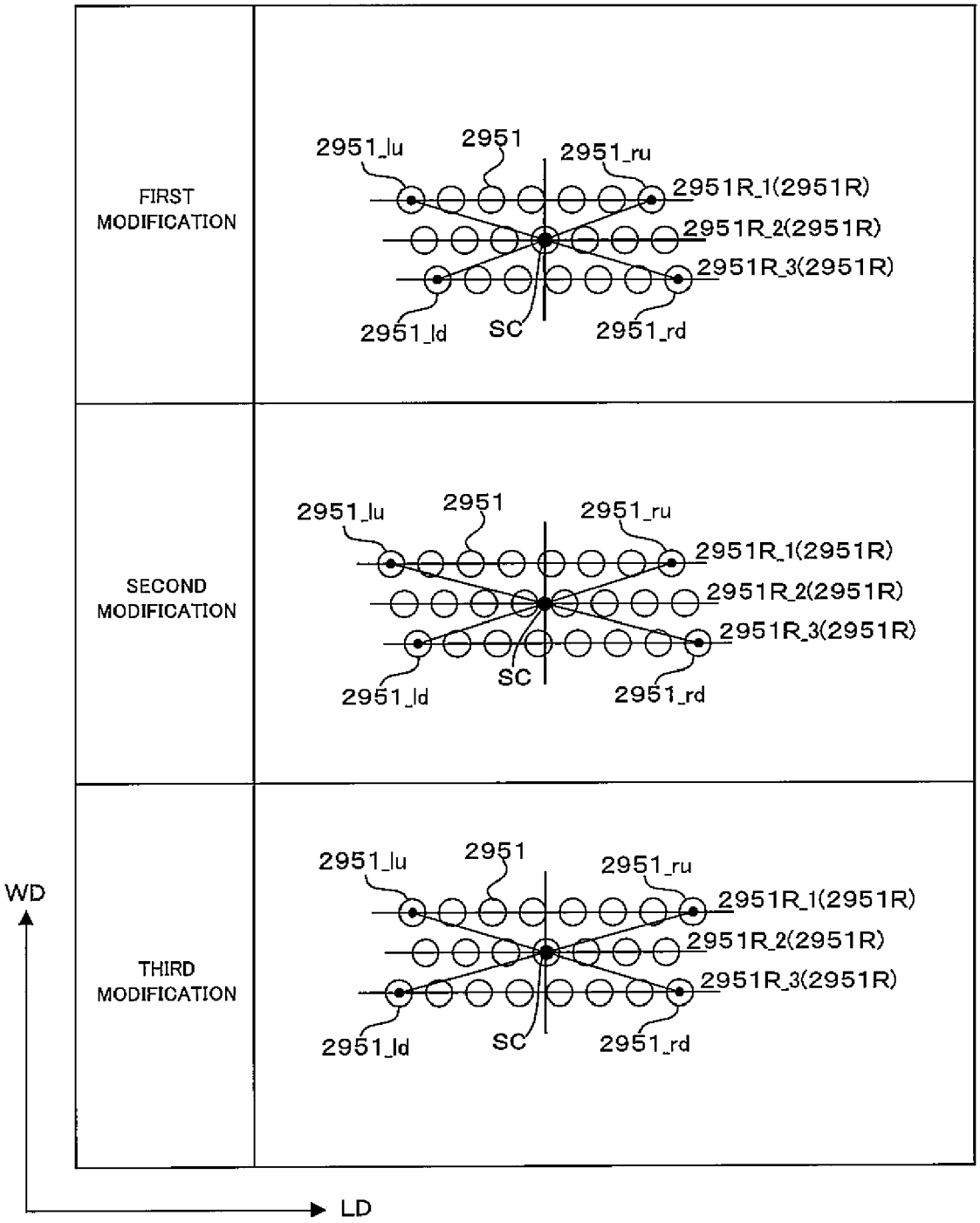
FIGS. 32 and 33 are diagrams showing modifications of the luminous element group.
Figure 33:
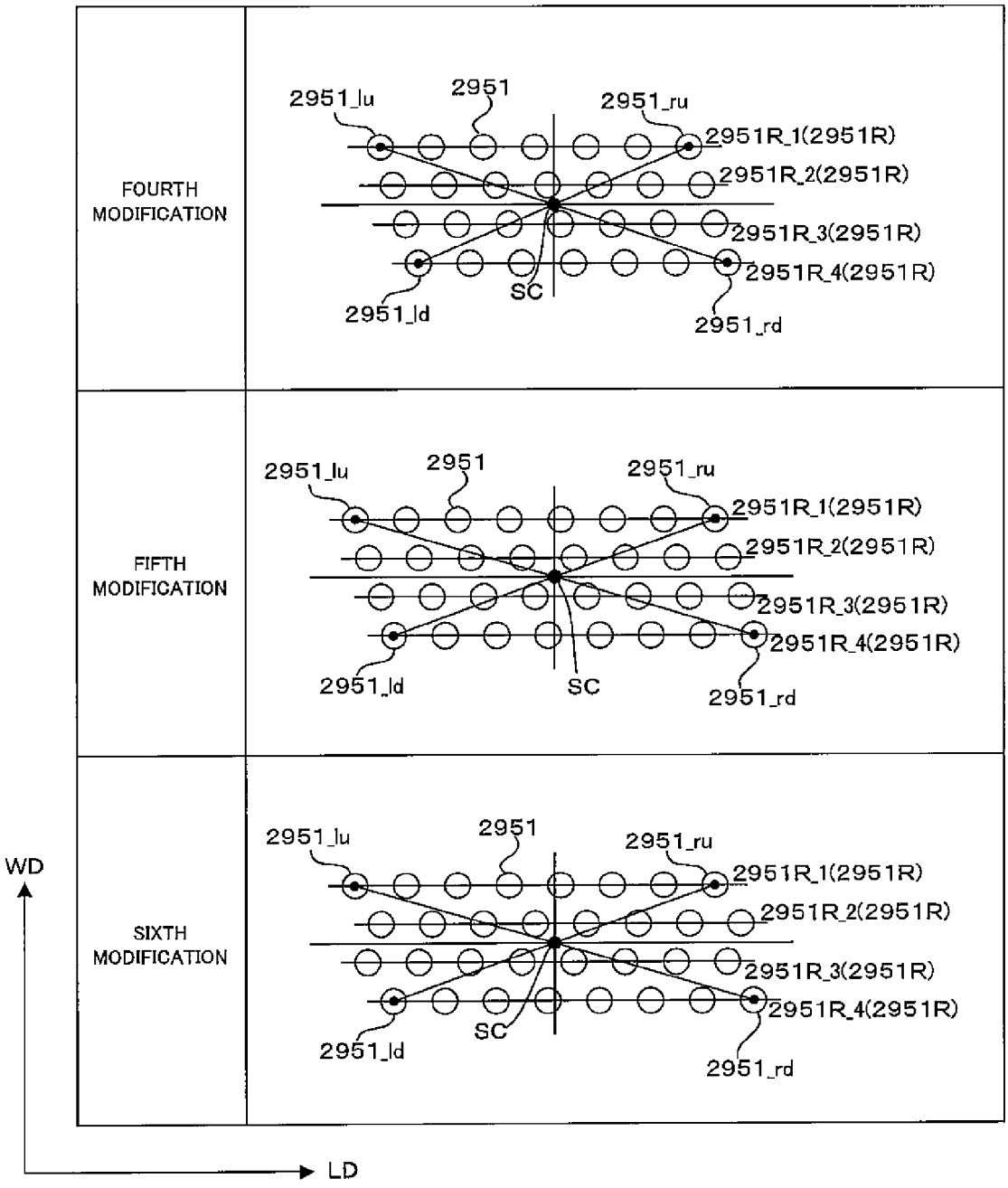

FIGS. 32 and 33 are diagrams showing modifications of the luminous element group 295. In a first modification shown in FIG. 32, three luminous element rows 2951R_1 to 2951R_3 are arranged in the width direction WD), and each of the luminous element rows 2951R_1 to 2951R_3 is comprised of seven luminous elements 2951 aligned in the longitudinal direction LD. The respective luminous elements 2951 are arranged in point symmetry with respect to the symmetry center SC, and one luminous element 2951 is located at the symmetry center SC.

In a second modification shown in FIG. 32, three luminous element rows 2951R_1 to 2951R_3 are arranged in the width direction WD, and each of the luminous element rows 2951R_1 to 2951R_3 is comprised of eight luminous elements 2951 aligned in the longitudinal direction LD. The respective luminous elements 2951 are arranged in point symmetry with respect to the symmetry center SC.

In a third modification shown in FIG. 32, three luminous element rows 2951R_1 to 2951R_3 are arranged in the width direction WD, and each of the luminous element rows 2951R_1 and 2951R_3 is comprised of eight luminous elements 2951 aligned in the longitudinal direction LD, whereas the luminous element row 2951R_2 is comprised of seven luminous elements 2951 aligned in the longitudinal direction LD. The respective luminous elements 2951 are arranged in point symmetry with respect to the symmetry center SC.

In a fourth modification shown in FIG. 33, four luminous element rows 2951R_1 to 2951R_4 are arranged in the width direction WD, and each of the luminous element rows 2951R_1 to 2951R_4 is comprised of seven luminous elements 2951 aligned in the longitudinal direction LD. The respective luminous elements 2951 are arranged in point symmetry with respect to the symmetry center SC.

In a fifth modification shown in FIG. 33, four luminous element rows 2951R_1 to 2951R_4 are arranged in the width direction WD, and each of the luminous element rows 2951R_1 to 2951R_4 is comprised of eight luminous elements 2951 aligned in the longitudinal direction LD. The respective luminous elements 2951 are arranged in point symmetry with respect to the symmetry center SC.

In a sixth modification shown in FIG. 33, four luminous element rows 2951R_1 to 2951R_4 are arranged in the width direction WED, and each of the luminous element rows 2951R_1 to 2951R_4 is comprised of eight luminous elements 2951 aligned in the longitudinal direction LD. The respective luminous elements 2951 are arranged in point symmetry with respect to the symmetry center SC.

In the respective first to sixth modifications, the symmetry center SC can be obtained as follows. Specifically, the symmetry center SC can be obtained as an intersection of a line connecting the left-up luminous element 2951_lu and the right-down luminous element 2951_rd and a line connecting the left-down luminous element 2951_ld and the right-up luminous element 2951_ru in FIGS. 32 and 33.

Although three lens rows MLR are arranged to form the microlens array 299 in the above embodiment, the formation mode of the microlens array 299 is not limited to this. In other words, the microlens array 299 may be formed by only one lens row MLR or by two lens rows MLR.

In the above embodiment, the microlenses ML having the optical property of inverting unity-magnification are used. However, the microlenses ML usable in the invention are not limited to these. In short, any microlenses ML having an optical property of inverting or non-unity-magnification can be used in the invention. More specifically, upon implementing the invention, microlenses ML having an optical property of any one of inverting magnification, inverting reduction, erecting magnification and erecting reduction other than inverting unity-magnification can be used.

In order to realize a highly accurate position adjustment in the optical axis adjustment process, it is desirable to detect deviations of the microlenses ML from ideal positions with high accuracy. In the above embodiment, such deviations are detected as in-plane distances. Accordingly, in light of a highly accurate position adjustment, the microlenses ML are preferably inverting magnifying systems or erecting magnifying systems (magnifying optical systems).

Figure 34:
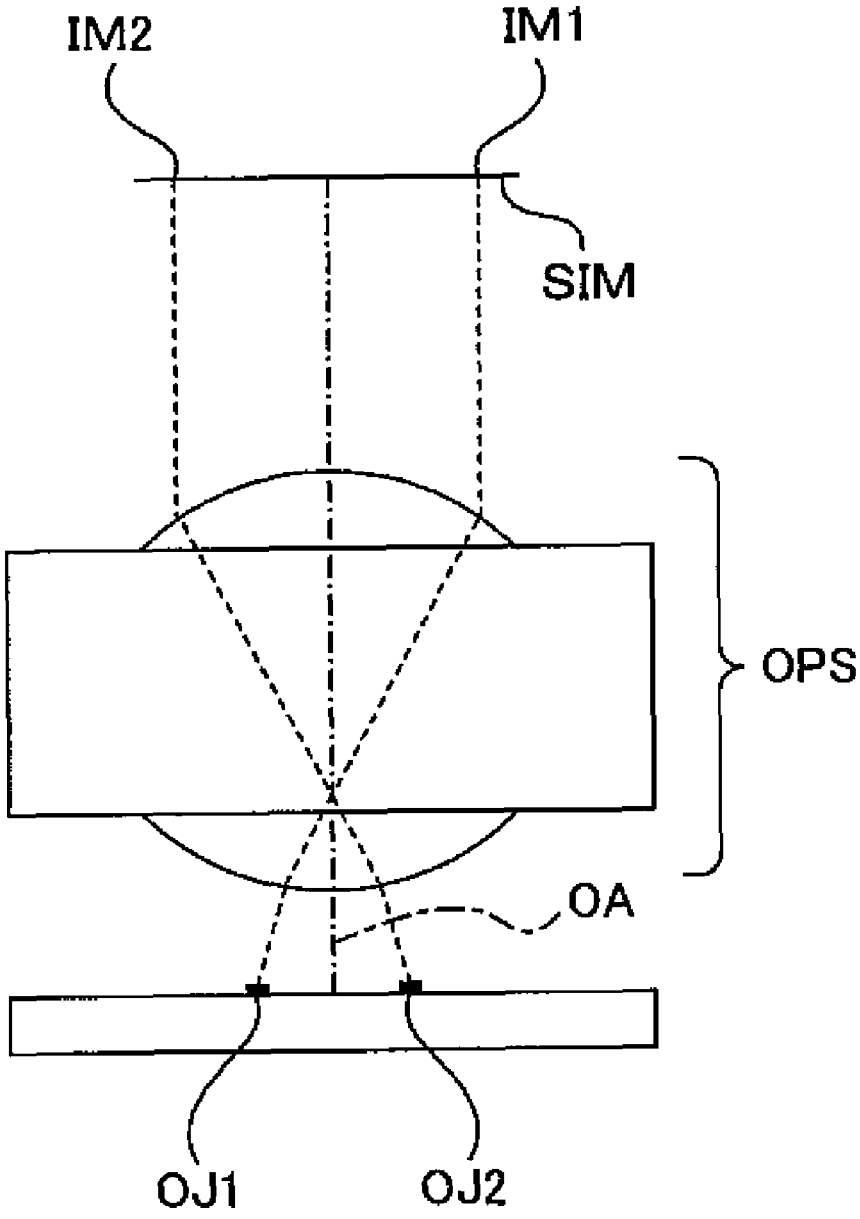
FIG. 34 is a diagram showing an optical property of inverting magnification.

FIG. 34 is a diagram showing an optical property of inverting magnification. In FIG. 34, an imaging optical system OPS having an optical property of inverting magnification is arranged to face two luminous elements OJ1, OJ2. Light beams emitted from the two luminous elements OJ1, OJ2 are focused on an image plane SIM by the imaging optical system OPS. At this time, the light beam emitted from the luminous element OJ1 is focused at an image position IM1 at a side opposite to the luminous element OJ1 with respect to the optical axis OA. A distance from the image position IM1 to the optical axis OA is longer than a distance from the luminous element OJ1 to the optical axis OA. Further, the light beam emitted from the luminous element OJ2 is focused at an image position IM2 at a side opposite to the luminous element OJ2 with respect to the optical axis OA. A distance from the image position IM2 to the optical axis OA is longer than a distance from the luminous element OJ2 to the optical axis OA.

The optical property of erecting magnification is described. The imaging optical system having an optical property of erecting magnification is arranged to face the luminous elements OJ1, OJ2. Light beams emitted from the two luminous elements OJ1, OJ2 are focused on the image plane SIM by the imaging optical system. At this time, the light beam emitted from the luminous element OJ1 is imaged at an image position IM1 at the same side as the luminous element OJ1 with respect to the optical axis OA. A distance from the image position IM1 to the optical axis OA is longer than a distance from the luminous element OJ1 to the optical axis OA. Further, the light beam emitted from the luminous element OJ2 is imaged at an image position IM2 at the same side as the luminous element OJ2 with respect to the optical axis OA. A distance from the image position IM2 to the optical axis OA is longer than a distance from the luminous element OJ2 to the optical axis OA.

As described above, in light of a highly accurate position adjustment, it is preferable to express a small deviation as a large in-plane distance. In order to increase the in-plane distance, the inverting optical system is particularly preferable out of the above-described inverting optical system and erecting optical system for the following reason.

As described above, in the erecting optical system, an object point OJ (corresponding to the luminous elements OJ1, OJ2 in the above description) and an image position IM (corresponding to the image positions IM1, IM2 in the above description) where a light beam from the object point OJ is focused are located at the same side with respect to the optical axis OA. In other words, when it is defined that D(SC), D(IM) denote a distance between a symmetry center SC and the optical axis OA and a distance between an image of a virtual object located at the symmetry center SC and the optical axis OA, the in-plane distance of the symmetry center SC in the erecting optical system is given as a difference between the two distances, that is, D(IM)−D(SC). On the other hand, in the inverting optical system, the object point OJ and the image position IM where the beam from the object point OJ is focused are located at the opposite sides with respect to the optical axis OA. Thus, the in-plane distance of the symmetry center SC in the inverting optical system is given as a sum of two distances, that is, D(IM)+D(SC). As a result, the in-plane distance tends to be larger in the inverting optical system than in the erecting optical system even if magnification is equal. Therefore, the inverting optical system is preferable since the position adjustment can be made with higher accuracy.

Optical microscopes, CCD (charge coupled device) cameras or the like can be used as the observation optical systems 99, 991 and 992. Particularly, in order to automate the optical axis adjustment process, the CCD camera is preferable. This is because the optical axis adjustment process can be automated using an image recognition technology by importing a video image obtained by the CCD camera into a computer. At this time, the array moving mechanism may include a micrometer head whose stroke is electrically controllable. In other words, the optical axis adjustment process can be automatically performed by controlling the array moving mechanism based on a video image obtained by the CCD camera by means of the computer.

In the case of using the image recognition technology by importing the video image obtained by the CCD camera to the computer as above, it is also possible not to use the crosshair cursor CC, CCC or the like in the position information obtaining step. In other words, the coordinates of the symmetry center SC may be obtained from the video image imported to the computer, and the following steps may be performed using these coordinates as the position information on the symmetry center SC.

In the case of automatically performing the optical axis adjustment process using the CCD camera, a video obtained by the CCD camera may be displayed on a monitor. This is because the automatically performed optical axis adjustment process can be confirmed by an administrator of the production process. At this time, in the case of performing the optical axis adjustment process using two observation optical systems 991, 992, it is preferable to display images obtained by the two observation optical systems 991, 992 side by side on the monitor.

Generally, focused states of light beams emitted from luminous elements of a line head slightly differ for the respective luminous elements. In the case of forming an image using the line head, such differences might influence image quality in some cases. Accordingly, a shipment inspection for inspecting the imaging states of all the luminous elements is necessary at the time of shipment of the line head in many cases. In the case of the construction provided with the above-described CCD camera, such a CCD camera may be used in the shipment inspection and this construction is preferable because it can be simplified.

In the above adjustment examples, the optical axis adjustment process may be performed using the image plane (plane corresponding to the photosensitive drum surface) where the spots SP are formed by the microlenses ML focusing the lights emitted from the luminous elements 2951 as the virtual perpendicular plane HPL (FIG. 21). This is because the line head 29 adjusted as above can form satisfactory spots on the image plane.

H. EXAMPLE

Next, an example of the invention is described, but the invention is not limited by the following example and, of course, can be suitably modified within a range applicable to the gist described above and below, and any of such modifications is embraced by the technical scope of the invention.

Figure 35:
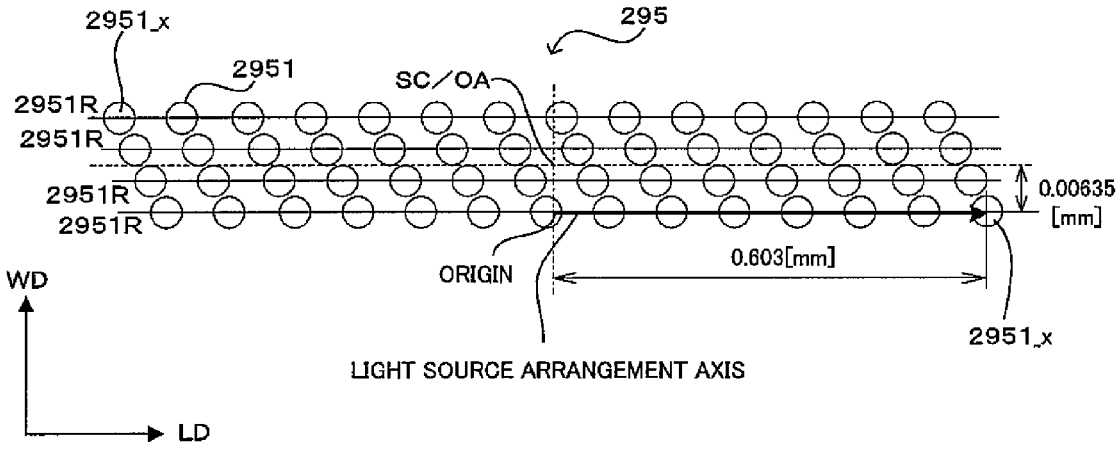
FIG. 35 is a diagram showing the configuration of a luminous element group according to the example of the invention.

FIG. 35 is a diagram showing the configuration of a luminous element group according to the example of the invention. As shown in FIG. 35, the luminous element group 295 is comprised of four luminous element rows 2951R arranged in the width direction WD. Each luminous element row 2951R is comprised of fourteen luminous elements 2951 aligned in the longitudinal direction LD. The respective luminous elements 2951 are arranged in point symmetry with respect to a symmetry center SC, and the symmetry center SC coincides with an optical axis OA of a microlens ML in FIG. 35. Luminous elements 2951 located at the ends in the longitudinal direction LD are defined as end luminous elements 2951_*x*. A distance between the optical axis OA and the end luminous elements 2951_*x* in the longitudinal direction LD is 0.603 [mm] and a distance between the optical axis OA and the end luminous elements 2951_*x* in the width direction WD is 0.00635 [mm]. Further, the diameter of the respective luminous elements 2951 is 40 [μm].

Figure 37:
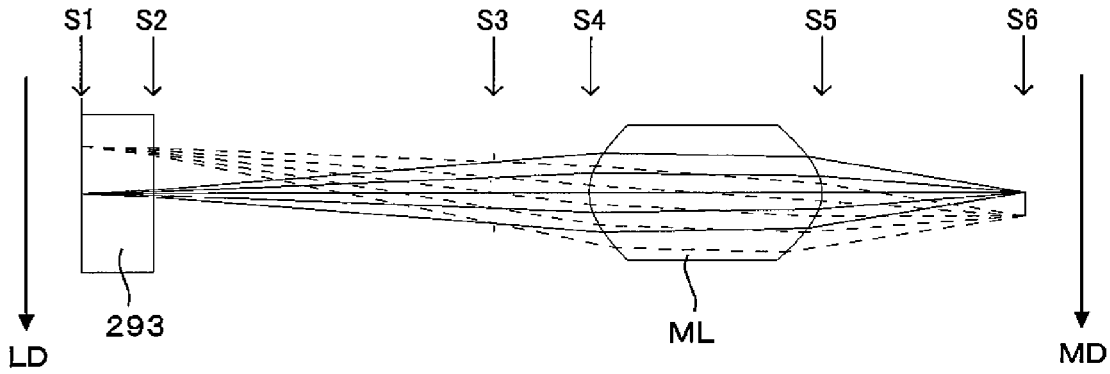
FIG. 37 is a sectional view of an optical system of this example along the main scanning direction.
Figure 38:
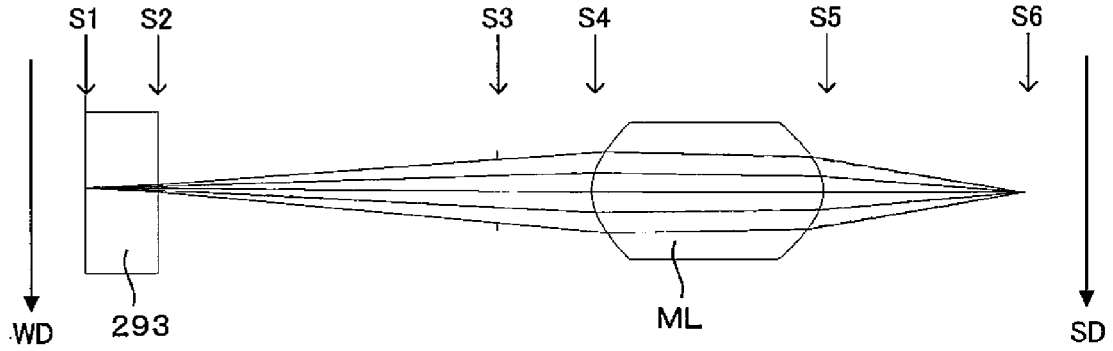
FIG. 38 is a sectional view of the optical system of this example along the sub scanning direction.

FIG. 36 is a table showing optical factors in this example, FIG. 37 is a sectional view of an optical system of this example along the main scanning direction, and FIG. 38 is a sectional view of the optical system of this example along the sub scanning direction. As shown in FIGS. 36 to 38, the microlens ML has aspheric lens surfaces (surface numbers S4, S5) in this example. Further, an aperture (surface number S3) is provided at a side of the microlens ML toward an object surface. This optical system is an inverting optical system having an optical magnification of −0.5× and adapted to form an inverted image.

In this example, the spot diameter of the spots SP in the case where light sources are virtually placed at positions on a light source arrangement axis shown in FIG. 35 is calculated by simulation. The light source arrangement axis is a coordinate axis parallel to the longitudinal direction LD and passing through the end luminous elements 2951_*x*, and an intersection of a perpendicular extending downward from the optical axis OA in the width direction WD with the light source arrangement axis serves as an origin. Further, the spot diameter is a diameter of a cross section in which a light quantity is $1/e^2$, where e is the base of natural logarithm, in relation to a peak light quantity in a light quantity distribution (light quantity profile).

Figure 39:
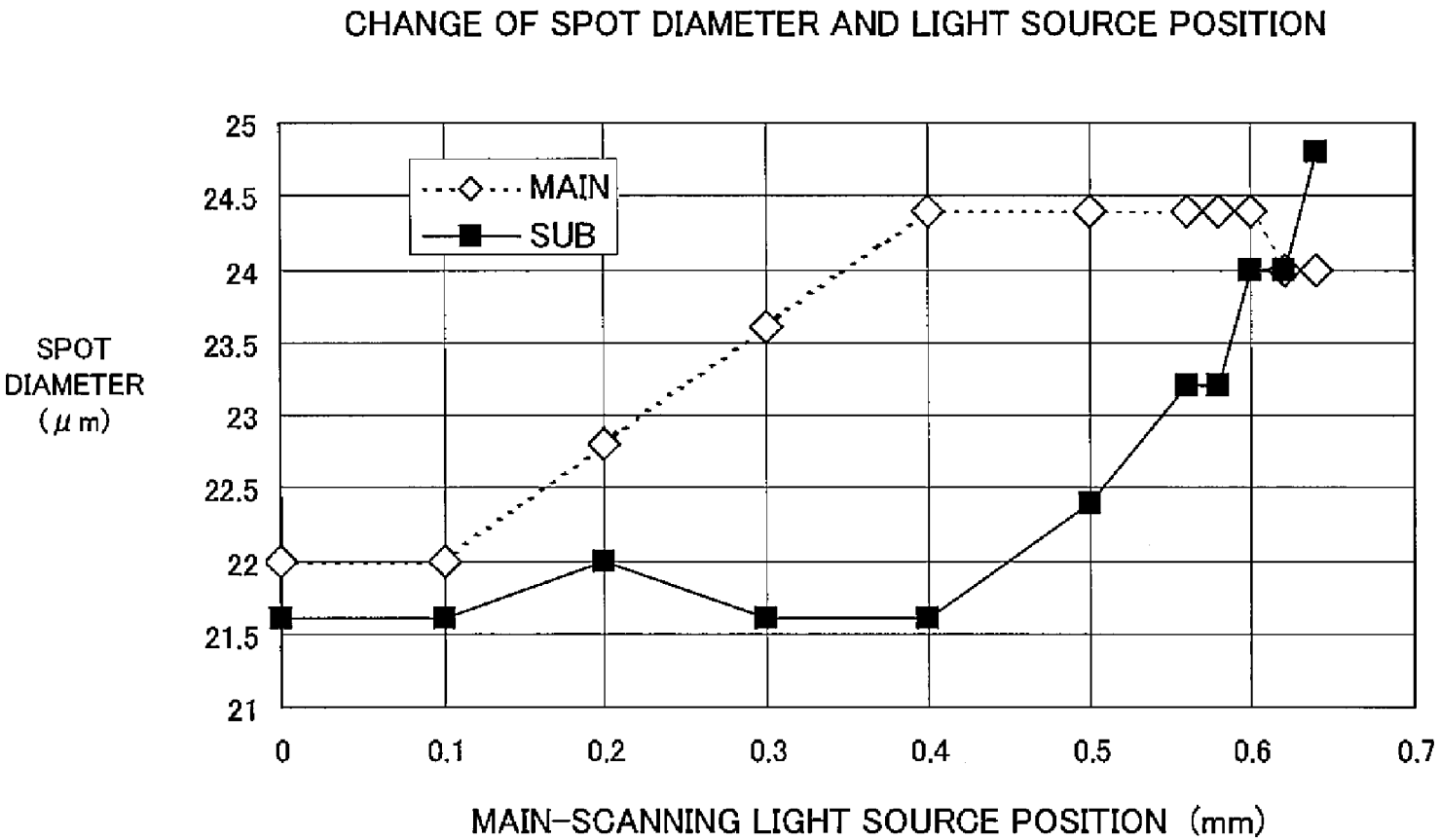
FIG. 39 is a graph showing the simulation result of the spot diameters.

FIG. 39 is a graph showing the simulation result of the spot diameters. As shown in FIG. 39, both the spot diameter (represented by white rhombuses in FIG. 39) in the main scanning direction MD and the spot diameter (represented by black rectangles in FIG. 39) in the sub scanning direction SD tend to increase as a main-scanning light source position becomes more distant from the origin. Here, the main-scanning light source position is a position on the light source arrangement axis.

The inventors of the present application studied to which degree the deviations of the microlens ML having such an optical property and the luminous element groups 295 were permissible. In such a study, how spots formed by two luminous element groups 295(1), 295(2) for forming spot groups SG(1), SG(2) adjacent in the main scanning direction MD were influenced by the above deviation was examined.

Figure 40:
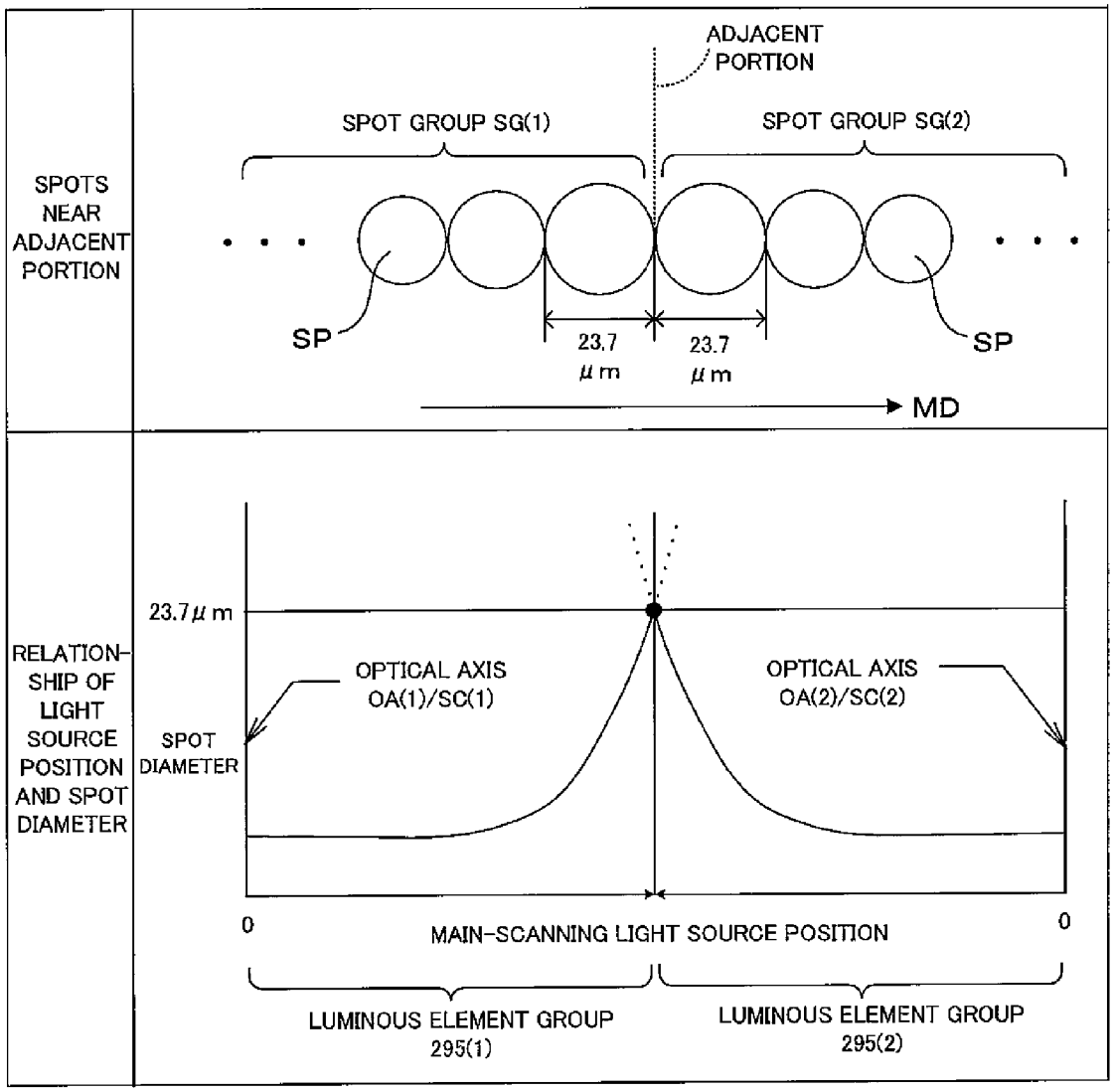
FIG. 40 is a diagram showing spots formed in the case of no deviation.
Figure 41:
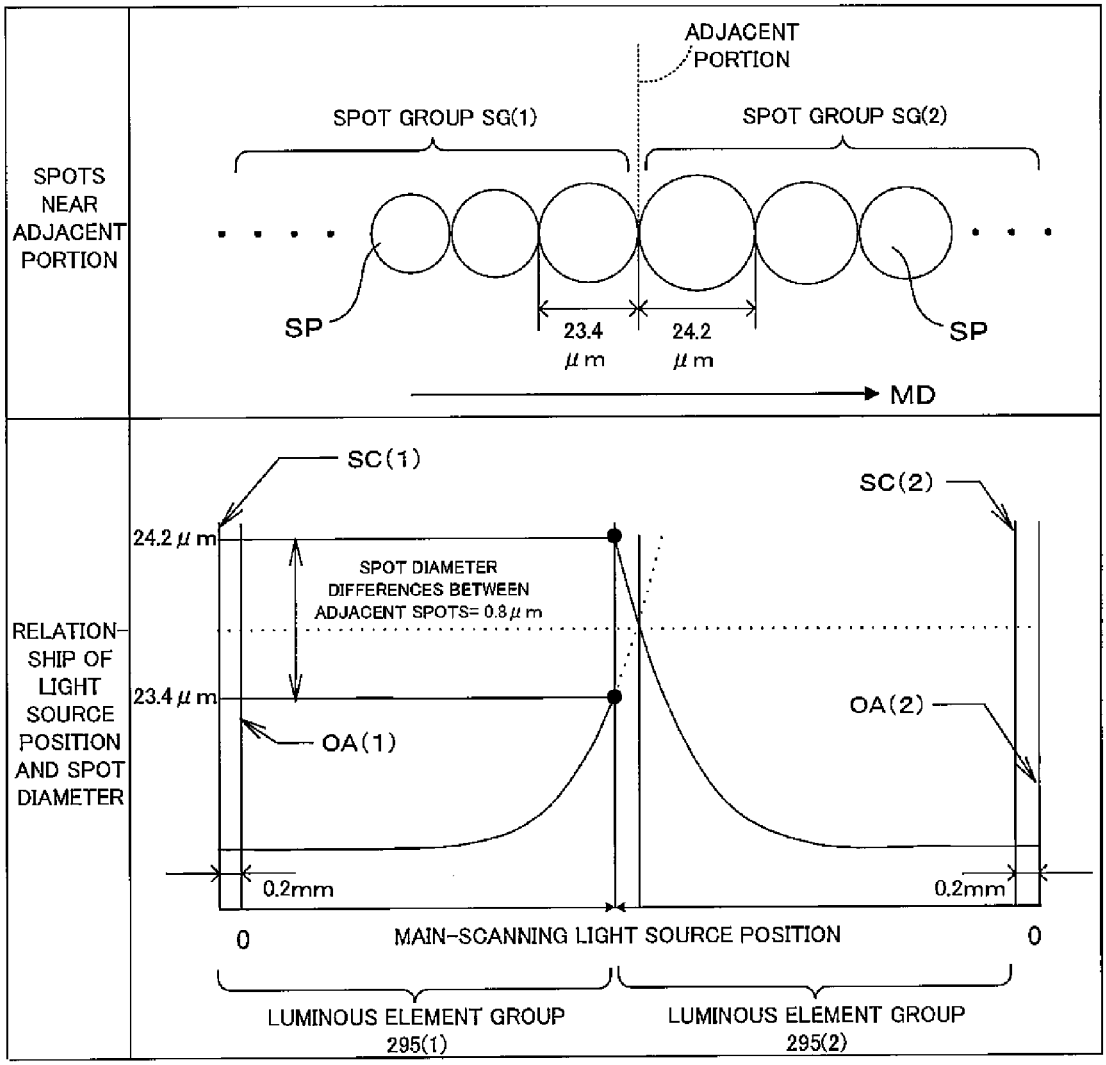
FIG. 41 is a diagram showing spots formed in the case of a deviation.

FIG. 40 is a diagram showing spots formed in the case of no deviation, and FIG. 41 is a diagram showing spots formed in the case of a deviation. FIG. 41 corresponds to a case where the symmetry center SC of the luminous element group 295 and the optical axis OA deviate by 0.2 [mm]. In the column "Relationship of Light Source Position and Spot Diameter" in FIGS. 40 and 41, the light source arrangement axis is set to extend rightward with the left end thereof as an origin "0" for the luminous element group 295(1), and the light source arrangement axis is set to extend leftward with the right end thereof as an origin "0" for the luminous element group 295(2). In this column, an optical axis OA(1) represents the position of the microlens ML facing the luminous element group 295(1) and an optical axis OA(2) represents the position of the microlens ML facing the luminous element group 295(2); and a symmetry center SC(1) represents the position of the symmetry center of the luminous element group 295(1) and a symmetry center SC(2) represents the position of the symmetry center of the luminous element group 295(2). In the column "Spots Near Adjacent Portion" in FIGS. 40 and 41, the vicinity where the spot groups SG(1) and SG(2) are adjacent is diagrammatically shown.

As shown in FIG. 40, in the case of no deviation, the spot diameter of the spots SP tends to increase toward the ends in each of the spot groups SG(1) and SG(2), but the spot diameters of the spots SP at the farthest ends are both equal and 23.7 [μm]. On the other hand, as shown in FIG. 41, in the case of a deviation, the spot diameters of the spots SP at the farthest ends differ in the respective spot groups SG(1) and SG(2). Specifically, the spot diameter of the spot SP at the right end of the spot group SG(1) is 23.4 [μm], whereas that of the spot SP at the left end of the spot group SG(2) is 24.2 [μm]. There is a spot diameter difference, 24.4 [μm]−23.4 [μm]=0.8 [μm], between the adjacent spots. Further, such a spot diameter difference occurs at every adjacent portion, that is, cyclically occurs in the main scanning direction MD.

If such a spot diameter difference exceeds 1 [μm], a cyclical pattern in a latent image formed by such spots is recognized by human eyes. Accordingly, the spot diameter differences between the adjacent spots are preferably below 0.8 [μm], in other words, a deviation of the symmetry center SC of the luminous element group 295 from the optical axis OA is preferably below 0.2 [mm] (FIG. 41). In order to make the deviation of the symmetry center SC of the luminous element group 295 from the optical axis OA smaller than 0.2 [mm], the inter-point distance db between the symmetry center projected point P(SC) and the center of gravity point BC of the spot group SG may be set to 0.3 [mm]. This is because the deviation of the symmetry center SC of the luminous element group 295 from the optical axis OA can be smaller than 0.2 [mm] by setting:

Inter-point distance db≦0.2 [mm]−(−0.5)×0.2 [mm]=0.3 [mm] since the optical system of this example is the inverting optical system having the optical magnification of −0.5×. By setting the inter-point distance db between the symmetry center projected point P(SC) and the center of gravity point BC of the spot group SG smaller than 0.3 [mm], the influence of the spot diameter difference on latent images is made inconspicuous and latent images can be properly formed.

The line head 29 of this example is preferable since the microlenses ML are formed by forming the aspheric lenses on the glass substrate 2991. This is because aberrations can be improved by adjusting the surface shapes of the microlenses ML in such a line head 29.

The line head 29 of this example is preferable since the apertures are provided at the side of the microlenses ML toward the object surface. This is because aberrations can be improved by adjusting the apertures in such a line head 29.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

an element substrate that includes luminous element groups as groups of a plurality of luminous elements; and a lens array that includes two-dimensionally arranged lenses which have an optical property of inverting or non-unity-magnification, focus light from the luminous element groups to form spot groups on a cylindrically-shaped image plane, and are provided corresponding to the respective luminous element groups, wherein the plurality of luminous elements are two-dimensionally arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the image plane and a center of gravity position of the spot group is shorter than a specified distance.

2. The line head according to claim 1, wherein the plurality of the luminous elements are arranged at mutually different positions in a first direction in each luminous element group, and the plurality of spots are formed at mutually different positions in the first direction when the luminous elements of the luminous element group emit light.

3. The line head according to claim 2, wherein a plurality of luminous element rows, in which a plurality of the luminous elements are aligned in the first direction, are arranged in a second direction perpendicular to or substantially perpendicular to the first direction in each luminous element group.

4. The line head according to claim 2, wherein the specified distance is an average of spot pitches in the first direction of the plurality of spots formed when the luminous elements of the luminous element group emit light.

5. The line head according to claim 1, wherein the specified distance is 0.3 mm.

6. The line head according to claim 1, further comprising a spacer disposed between the element substrate and the lens array, wherein the spacing between the element substrate and the lens array is defined by holding one side of the spacer in contact with the element substrate while holding the other side thereof in contact with the lens array.

7. The line head according to claim 1, wherein the luminous elements are organic EL devices.

8. The line head according to claim 1, wherein the lenses are arranged in the lens array by forming lenses on a glass substrate.

9. The line head according to claim 1, wherein the lenses are formed by forming aspheric lenses on a glass substrate.

10. The line head according to claim 1, wherein apertures are provided at sides of the lenses toward an object surface.

11. The line head according to claim 1, wherein in the lens array, three lens rows, in which a plurality of lenses are aligned in a first direction, are arranged in a second direction, and at a lens in the middle of the three lens rows, the intersection of the line extending from the symmetry center of the luminous element group in the optical axis direction of the lens with the image plane coincides with the center of gravity position of the spot group.

12. An exposure method using a line head, comprising:

exposing a cylindrically-shaped image plane using a line head that includes an element substrate having luminous element groups as groups of a plurality of luminous elements, and a lens array having two-dimensionally arranged lenses which have an optical property of inverting or non-unity-magnification, focus light from the luminous element groups to form spot groups on the image plane, and are provided corresponding to the respective luminous element groups, wherein the plurality of luminous elements are two-dimensionally arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the image plane and a center of gravity position of the spot group is shorter than a specified distance.

13. The exposure method using the line head according to claim 12, wherein, in the exposing, the image plane moves in a direction, the respective luminous elements are turned on to emit light at timings in conformity with the movement of the image plane, and the plurality of spots are formed in a direction perpendicular to or substantially perpendicular to the moving direction of the image plane.

14. The exposure method using the line head according to claim 12, wherein in the lens array, three lens rows, in which a plurality of lenses are aligned in a first direction, are arranged in a second direction, and at a lens in the middle of the three lens rows, the intersection of the line extending from the symmetry center of the luminous element group in the optical axis direction of the lens with the image plane coincides with the center of gravity position of the spot group.

15. An image forming apparatus, comprising:

a latent image carrier; and a line head including an element substrate that has Luminous element groups as groups of a plurality of luminous elements, and a lens array that has two-dimensionally-arranged lenses which have an optical property of inverting or non-unity-magnification, focus light from the luminous element groups to form spot groups on a cylindrically-shaped surface of the latent image carrier, and are provided corresponding to the respective luminous element groups, wherein the plurality of luminous elements are arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the surface of the latent image carrier and a center of gravity position of the spot group is shorter than a specified distance.

16. The image forming apparatus according to claim 15, wherein in the lens array, three lens rows, in which a plurality of lenses are aligned in a first direction, are arranged in a second direction, and at a lens in the middle of the three lens rows, the intersection of the line extending from the symmetry center of the luminous element group in the optical axis direction of the lens with the surface of the latent image carrier coincides with the center of gravity position of the spot group.

17. An image forming method, comprising:

forming a latent image on a cylindrically-shaped surface of a latent image carrier using a line head that includes an element substrate having luminous element groups as groups of a plurality of luminous elements, and a lens array having two-dimensionally arranged lenses which have an optical property of inverting or non-unity-magnification, focus light from the luminous element groups to form spot groups on the surface of the latent image carrier, and are provided corresponding to the respective luminous element groups, wherein the plurality of luminous elements are arranged in point symmetry in each luminous element group, a plurality of spots are formed as the spot group when the respective luminous elements of the luminous element group emit light, and an inter-point distance between an intersection of a line extending from a symmetry center of the luminous element group in an optical axis direction of the lens with the surface of the latent image carrier and a center of gravity position of the spot group is shorter than a specified distance.

18. The image forming method according to claim 17, wherein in the lens array, three lens rows, in which a plurality of lenses are aligned in a first direction, are arranged in a second direction, and at a lens in the middle of the three lens rows, the intersection of the line extending from the symmetry center of the luminous element group in the optical axis direction of the lens with the surface of the latent image carrier coincides with the center of gravity position of the spot group.

* * * * *